US011174071B2

(12) United States Patent
Burns et al.

(10) Patent No.: US 11,174,071 B2
(45) **Date of Patent: *Nov. 16, 2021**

(54) CONTAINER HAVING MULTIPLE LAYERS OF LOCKABLE CROSSBAR ASSEMBLIES FOR KEEPING PRODUCTS INSIDE CONTAINER

(71) Applicant: Bradford Company, Holland, MI (US)

(72) Inventors: Allen L. Burns, Holland, MI (US); Michael Weller, Howell, MI (US)

(73) Assignee: Bradford Company, Holland, MI (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/791,212

(22) Filed: Feb. 14, 2020

(65) Prior Publication Data

US 2020/0198835 A1 Jun. 25, 2020

Related U.S. Application Data

(63) Continuation-in-part of application No. 15/464,954, filed on Mar. 21, 2017, now Pat. No. 10,604,334.

(60) Provisional application No. 62/328,683, filed on Apr. 28, 2016, provisional application No. 62/407,149, filed on Oct. 12, 2016, provisional application No. 62/415,593, filed on Nov. 1, 2016.

(51) Int. Cl.
*B65D 19/08* (2006.01)
*B65D 25/04* (2006.01)

(52) U.S. Cl.
CPC ..... *B65D 19/08* (2013.01); *B65D 25/04* (2013.01); *B65D 2519/00034* (2013.01); *B65D 2519/00805* (2013.01)

(58) Field of Classification Search
CPC ..... B65D 85/68; B65D 19/06; B65D 19/18; B65D 19/44; B65D 2519/00582; B65D 2519/00577; B65D 2519/00676; B65D 2519/00378; B65D 2519/00532; B65D 2519/00666; B65D 2519/00701; B65D 2519/0082; B65D 88/546; B65D 90/12; B65D 81/07; B65D 25/04; B42F 15/0094; B42F 15/007
USPC ..... 206/425; 211/46, 162; 312/184; 220/544–546, 529, 532–533, 535, 220/538–542, 549–551
See application file for complete search history.

(56) References Cited

U.S. PATENT DOCUMENTS 3,710,974 A * 1/1973 Hage ..... A47B 88/994 220/541
4,067,630 A 1/1978 Stark et al.
4,091,745 A 5/1978 Patch
(Continued)

FOREIGN PATENT DOCUMENTS

DE 4336623 5/1995
DE 102012017295 3/2014

*Primary Examiner* — Robert Poon
(74) *Attorney, Agent, or Firm* — Wood Herron & Evans LLP

(57) ABSTRACT

A container for holding product therein during shipment and for reuse has tracks supported by each side of the container. Opposed linear tracks are supported by each side of the container. At least one lockable crossbar assembly travels along corresponding tracks at the same level. At least one lockable crossbar assembly has locking assemblies to fix the position of the lockable crossbar assembly relative to the tracks and keep product inside the container during shipment.

13 Claims, 57 Drawing Sheets

(56) References Cited

U.S. PATENT DOCUMENTS

| | | | | |
|---|---|---|---|---|
| 4,256,425 | A | 3/1981 | Burgess et al. | |
| 4,420,086 | A | 12/1983 | Bardes | |
| 4,492,263 | A | 1/1985 | Gebhard | |
| 4,494,896 | A | 1/1985 | DiFranco | |
| 4,553,888 | A | 11/1985 | Crissy et al. | |
| 4,688,976 | A | 8/1987 | Rowley et al. | |
| 4,911,312 | A | 3/1990 | Jeruzal | |
| 4,919,277 | A | 4/1990 | Jeruzal | |
| 4,921,100 | A | 5/1990 | Krause | |
| 5,005,712 | A | 4/1991 | Niederprum | |
| 5,037,256 | A | 8/1991 | Schroeder | |
| 5,197,762 | A | 3/1993 | Abramov | |
| 5,328,259 | A | 7/1994 | Meriaux | |
| 5,378,093 | A | 1/1995 | Schroeder | |
| 5,472,301 | A | 12/1995 | Wallen | |
| 5,582,495 | A | 12/1996 | Schroeder | |
| 5,785,475 | A | 7/1998 | Winstel et al. | |
| 6,039,522 | A | 3/2000 | Cardona | |
| 6,123,208 | A | 9/2000 | Haenszel | |
| 6,164,440 | A | 12/2000 | Van Bree | |
| 6,224,307 | B1 | 5/2001 | Johnson et al. | |
| 6,540,096 | B1 | 4/2003 | Bazany et al. | |
| 6,786,687 | B1 | 9/2004 | Schroeder | |
| 7,293,946 | B1 | 11/2007 | Fuller | |
| 7,380,558 | B2 | 6/2008 | Krause et al. | |
| 7,410,335 | B2 | 8/2008 | Scott et al. | |
| 8,388,285 | B2 | 3/2013 | Langh | |
| 8,616,370 | B2 | 12/2013 | Allegretti et al. | |
| 10,604,333 | B2 | 3/2020 | Bradford et al. | |
| 10,604,334 | B2 | 3/2020 | Bradford et al. | |
| 2006/0014618 | A1 | 1/2006 | Farley et al. | |
| 2008/0023470 | A1* | 1/2008 | Bradford | B65D 19/18 220/1.5 |
| 2008/0078729 | A1 | 4/2008 | Bazany et al. | |
| 2009/0000975 | A1* | 1/2009 | Schenker | B65D 25/06 206/425 |
| 2015/0053691 | A1* | 2/2015 | Sanger | B65D 19/08 220/544 |
| 2015/0090722 | A1 | 4/2015 | Sanger | |
| 2015/0101956 | A1 | 4/2015 | Dobrinski et al. | |
| 2015/0136787 | A1* | 5/2015 | Bublitz | B65D 90/12 220/544 |
| 2016/0039355 | A1 | 2/2016 | Settelmayer | |

* cited by examiner

10g

10g

CONTAINER HAVING MULTIPLE LAYERS OF LOCKABLE CROSSBAR ASSEMBLIES FOR KEEPING PRODUCTS INSIDE CONTAINER

This application is a continuation-in-part application of U.S. patent application Ser. No. 15/464,954 which claims the benefit of U.S. Provisional Patent Application Ser. No. 62/328,683 filed Apr. 28, 2016 and U.S. Provisional Patent Application Ser. No. 62/407,149 filed Oct. 12, 2016 and U.S. Provisional Patent Application Ser. No. 62/415,593 filed Nov. 1, 2016. Each of these applications is fully incorporated by reference herein.

FIELD OF THE INVENTION

Field of the Invention

The present invention relates to containers for use in shipping and, more particularly, to containers with lockable crossbar assemblies for supporting dunnage for shipping and storing product.

Background of the Invention

Different container structures are utilized by manufacturers to ship a variety of different products to end users, which may be, for example, assembly plants. In the automobile industry, for example, an assembly plant assembling a particular automobile might utilize a number of different parts from different manufacturers. These manufacturers ship their respective parts to the assembly plant in container structures where the parts are then removed from dunnage or support members inside the container structure and assembled into a finished automobile.

Access to the product in the containers is of particular concern. Specifically, in the automotive industry, the containers full of product are positioned on an assembly line adjacent to a work area, which is associated with a particular product to be installed on a manufactured vehicle. For example, a container full of interior door panels is usually positioned next to a particular station on an assembly line where interior door panels are installed so that a line worker may easily access the door panels inside the container. The product or part is taken directly from the container and used on the line. Some existing containers are difficult to access, which makes removal of the parts therein difficult and time-consuming. For example, some containers are configured so that a line worker must walk around the container to remove parts or products from opposite ends of the container. As may be appreciated, a line worker only has a certain amount of time to install a part. Any delay in access and removal of the part from the container is undesirable.

In some automotive manufacturing plants, turntables may be provided which enable a container to be rotated. However, the installation of such turntables adds to the cost of production, takes up valuable floor space, and reduces plant flexibility.

In many containers, a line worker or employee must insert or remove parts from a distal or rear part of the container. The size and/or weight of the parts or workpieces may cause stress or strain on the line worker and, more particularly, on the back of the worker when inserting or removing parts from such a container. Such ergonomically unfriendly movements may cause physical trauma, pain and other injuries that may lead to lost production time.

In some situations, in order to alleviate such stress and/or strain on his or her body, the line worker may move to the rear or opposite end of the container to remove parts from inside the container. This requires space around the container which may not be available, depending on the physical layout of the plant or facility. The length (front to back) of certain containers may be limited because the container manufacturer needs to eliminate the need for a line worker to walk around the container to remove product from inside the container. Such containers having a reduced length reduce the number of parts or products which may be shipped and/or stored in the container. The more containers needed to ship a predetermined number of parts, the greater the cost to the shipper.

In other containers, a line worker or employee must lean forward and bend down into the container to insert or remove a part from a lower portion of the container. This movement by the line worker is ergonomically unfriendly because the line worker must lean forward and bend down and lift a part up and over a wall into the container to remove the part from inside the container. Similarly, when a part must be inserted into a container, the line worker may have to lean forward and insert the part, which may be heavy, into its proper location inside the container, again experiencing ergonomically unfriendly movements. Such movements may be necessary with many top loading containers and/or containers having multiple layers or levels of parts.

Depending upon the number of times the line worker repeats this unnatural motion into the interior of the container, strain in the back, legs and arms may result. The size and/or weight of the parts may increase the strain on the line worker. Thus, simply removing multiple parts during a work day may cause physical trauma, pain and other injuries that may lead to lost production time.

U.S. Pat. Nos. 8,770,430; 9,073,665; 9,016,507; 9,120,597 and 9,260,240, each fully incorporated herein, disclose containers have crossbar assemblies movable along straight or linear tracks. U.S. Pat. Nos. 9,051,112; 9,051,113; 9,211,999; 9,382,039; 9,409,706 and 9,422,081, each fully incorporated herein, disclose containers having crossbar assemblies movable along non-linear tracks, such as L-shaped or U-shaped tracks.

However, in any of the containers identified above, when the container is empty or partially empty of products, the movable crossbar assemblies, and dunnage suspended by such crossbar assemblies, may undesirably move inside the container during shipment, possibly creating noise and potentially damaging a portion of the container.

Accordingly, there is a need for a container which has at least one crossbar assembly which may be locked in a desired location inside the container.

There is further a need for a container which has at least one crossbar assembly which may be secured in a desired location quickly and easily by an operator.

There is further a need for a selectively lockable/unlockable crossbar assembly for use in a shipping container which extends between tracks and which may be locked in a desired location quickly and easily by an operator.

SUMMARY OF THE INVENTION

The present invention provides a container for holding product therein during shipment. The container comprises a base and two opposed sides. The base and sides may be part of a metal frame or part of a plastic pallet box. In some embodiments, a plurality of track supports may be supported by the container. In some instances, multiple track supports may be secured to each of the opposed sides of the container, such as the corner posts of a metal frame.

A plurality of opposed tracks may be supported by each of the opposed sides of the container. At least one of the tracks on each side of the container may be linear. In some embodiments, all the tracks supported by the sides of the container may be linear.

For purposes of this document, the term "track" may be a unitary member or multiple components secured together. The present invention is not intended to be limited to the tracks like those illustrated and described herein. For example, a "track" may comprise a rail attached to one or more sides of a container or a groove therein. The term "track" is intended to include any number of stationary objects along which crossbar assemblies, as defined and/or illustrated herein, may slide or move during the loading or unloading of product from dunnage inside the container. For purposes of this document, the term "track" is not intended to be limited to an element separable from the shell of the container. It is within the contemplation of the inventors that one or more tracks, or a portion thereof, may be movable to assist in selectively locking or unlocking the position of one of more crossbar assemblies.

The container further comprises a plurality of lockable crossbar assemblies for keeping product inside the container during shipment. Each lockable crossbar assembly extends between opposed tracks of the same layer or level. Each lockable crossbar assembly may be locked in a selected position in any known manner. Each lockable crossbar assembly may have one or more locking assembly. One flocking assembly may include an inter-engaging locking pin which may be moved between an extended position and a retracted position. A lockable crossbar assembly may have two locking assemblies, one on each end of the lockable crossbar assembly. An operator may lock the lockable crossbar assembly in a fixed position by extending the locking pins so they enter openings in the tracks of the container and/or openings in the container. An operator may unlock the lockable crossbar assembly so it can move along a path defined by opposed tracks by retracting the locking pins so they exit openings in the tracks. The locking pins may be biased in an extended position by at least one spring or biasing mechanism. Movement of the locking pins may be accomplished by an operator pulling a cord or other mechanism extending between the locking assemblies to retract the locking pins out of their extended positions and out of engagement with openings in the tracks. A portion of each lockable crossbar assembly remains inside the tracks regardless of whether the lockable crossbar assembly is in a locked or unlocked position.

Regardless of the size or shape of the tracks, a portion of each lockable crossbar assembly remains inside an interior of the track regardless of whether the lockable crossbar assembly is in a locked or unlocked position. In other words, regardless of whether the lockable crossbar assembly is in a locked or unlocked position, end portions of each lockable crossbar assembly remains engaged with the tracks, causing the lockable crossbar assembly to travel along a predetermined path defined by the tracks.

The container further comprises a plurality of stops in the tracks for stopping movement of the lockable crossbar assemblies. The stops may be outside the tracks. Regardless of their location, each stop functions to stop movement, usually downward movement, of a lockable crossbar assembly.

According to another aspect of the present invention, the container has a base and opposed sides. The base and sides may be part of a metal frame or part of a plastic pallet box or a combination thereof. The container further comprises a plurality of tracks supported by each of the opposed sides of the container at different levels. At least one of the tracks on each side of the container is generally linear. A plurality of lockable crossbar assemblies are movable along corresponding tracks along a path defined by opposed tracks. Each one of the lockable crossbar assemblies extends between opposed tracks at one of the levels and is engaged with the opposed tracks. Each one of the lockable cross assemblies is lockable in a locked position in which locking pins extend through openings in the opposed tracks to keep products inside the container. A portion of each lockable crossbar assembly remains attached to the tracks regardless of whether the lockable crossbar assembly is in the locked position or an unlocked position in which the lockable crossbar assembly is free to move along the path defined by the opposed tracks.

The end members of each lockable crossbar assembly may be made of plastic or any other desired material. Each side of the container may have linear tracks along which the lockable crossbar assembly moves to move the lockable crossbar assembly to a lower position for loading or unloading products. When the lockable crossbar assembly is in its raised and locked position, products are trapped inside dunnage inside the container. Each end member may have at least one head located inside the interior of the track and at least one head located outside the track so the end member remains engaged with the track.

According to another aspect of the present invention, the container has a base and opposed sides. The container further comprises first and second linear tracks supported by each of the opposed sides of the container. One of the first and second tracks is between the base and the other of the first and second tracks at different vertically spaced levels. A first lockable crossbar assembly extends between the first tracks and is engaged with the first tracks. The first lockable crossbar assembly is lockable in at least one locked position and has locking pins extending through openings in the first tracks when the first lockable crossbar assembly is in one of the locked positions. A second lockable crossbar assembly extends between the second tracks and is engaged with the second tracks. The second lockable crossbar assembly is lockable in at least one locked position and has locking pins extending through openings in the second tracks when the second lockable crossbar assembly is in one of the locked positions. A portion of each lockable crossbar assembly remains inside the tracks regardless of whether the lockable crossbar assembly is in the locked position or an unlocked position in which the lockable crossbar assembly is free to move along the path defined by the opposed tracks.

Any of the tracks may have openings therein and removable caps for covering and/or closing the openings. If one or more of the dunnage supports or lockable crossbar assembly needs to be removed or inserted, a person may remove and/or insert one or more lockable crossbar assembly via the openings in opposed tracks.

The ease of operation and other objects and advantages of the present invention shall be made apparent from the accompanying drawings and the brief description thereof.

BRIEF DESCRIPTION OF THE DRAWINGS

The accompanying drawings, which are incorporated in and constitute a part of this specification, illustrate embodiments of the invention and, together with a general description of the invention given above and the detailed description of the embodiments given below, serve to explain the principles of the invention.

DETAILED DESCRIPTION OF THE INVENTION

Figure 1:
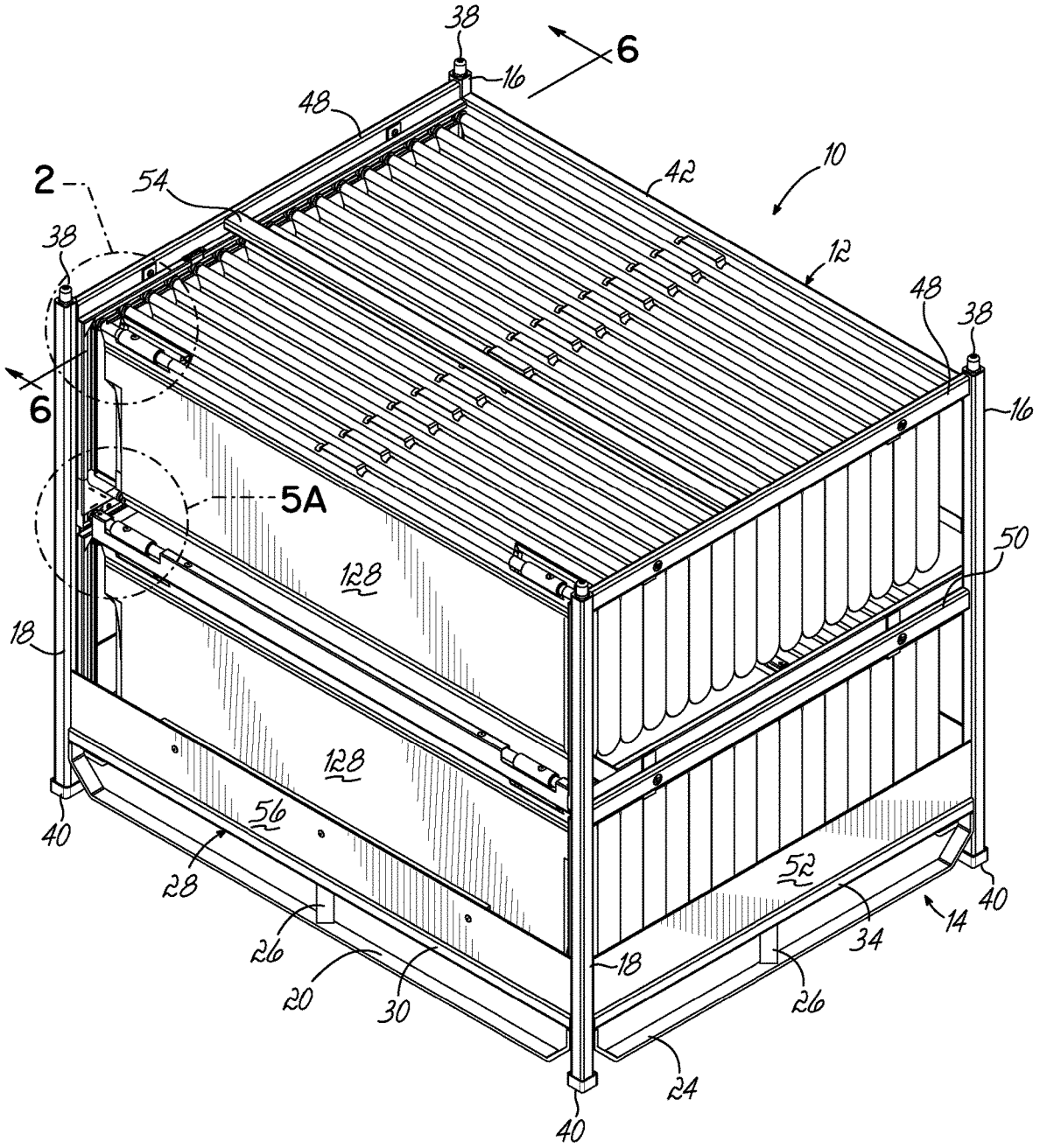
FIG. 1 is a perspective view of one embodiment of a reusable and returnable container.

Referring to FIG. 1, there is illustrated one embodiment of reusable and returnable container 10 for holding products 5 therein. The reusable and returnable container 10, as shown, comprises an outer metal frame 12 having a base 14, two rear corner posts 16 and two front corner posts 18, all four corner posts 16, 18 extending upwardly from the base 14.

Figure 1A:
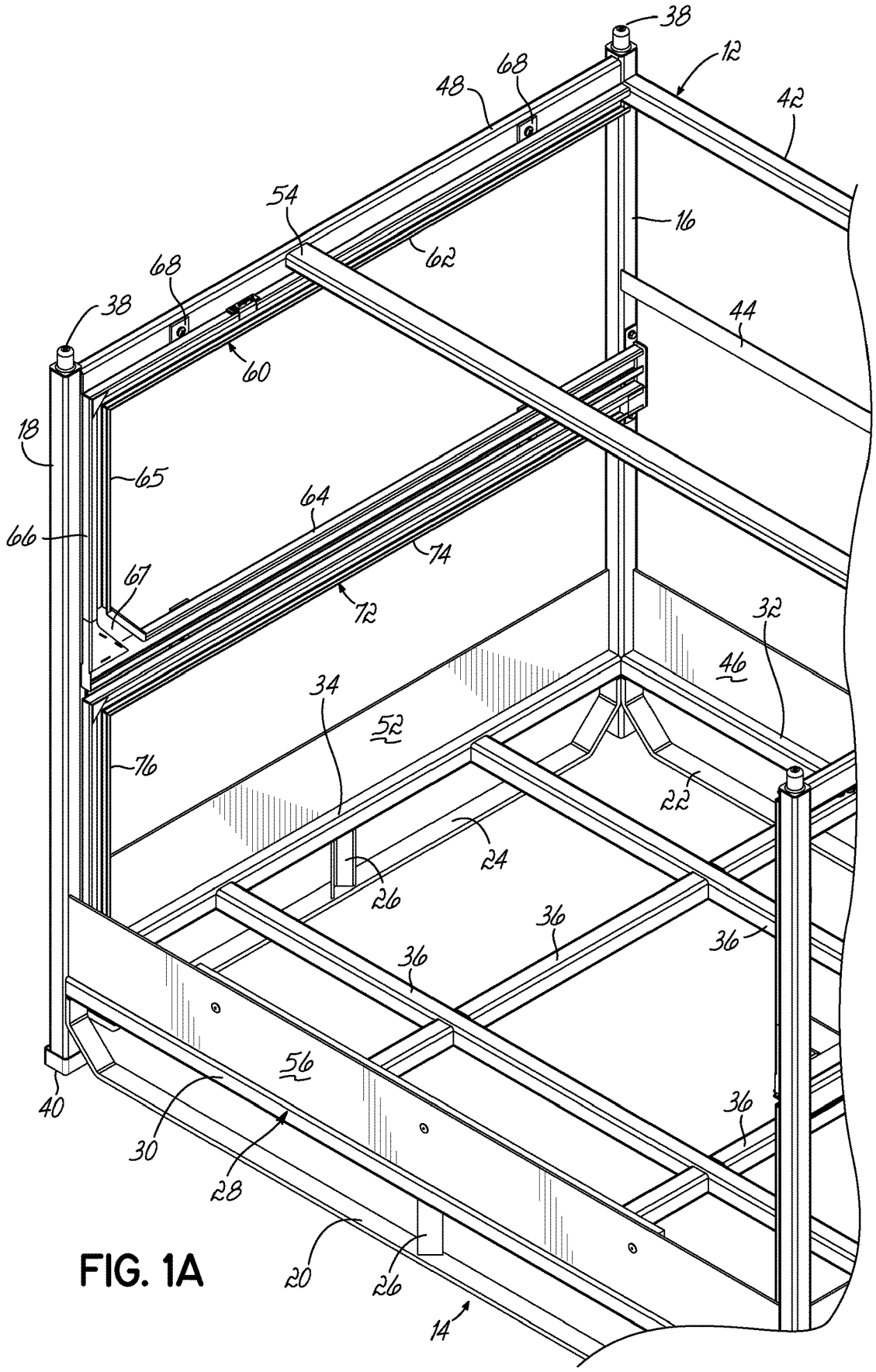
FIG. 1A is a perspective view of a portion of the frame of the container of FIG. 1 showing the tracks, but not the dunnage and crossbar assemblies.

As best shown in FIG. 1A, the base 14 of outer metal frame 12 is generally rectangular in shape and comprises a front perimeter member 20, a rear perimeter member 22 and two side perimeter members 24 (only one being shown). The perimeter members 20, 22 and 24 of the base 14 may be secured together or secured to the rear corner posts 16 and front corner posts 18 via any conventional means, including welding. A plurality of stubs 26 extend upwardly from the base 14 and are secured thereto via any conventional means, including welding.

As best shown in FIG. 1A, a generally rectangular sub-base 28 is spaced above the base 14 by the stubs 26 and secured to the stubs 26 by any conventional means, including welding. The sub-base 28 comprises a front perimeter member 30, a rear perimeter member 32 and two side perimeter members 34 (only one being shown). The perimeter members 30, 32 and 34 of the sub-base 28 may be secured together or secured to the rear corner posts 16 and front corner posts 18 via any conventional means, including welding. Although one stub 26 is shown extending upwardly from each of the perimeter members 20, 22 and 24 of base 14 to corresponding perimeter members 30, 32 and 34 of sub-base 28, any number of stubs or members (or a single continuous member) may be used to space the sub-base 28 above the base 14. The stubs 26 are limited to those shown.

Figure 6:
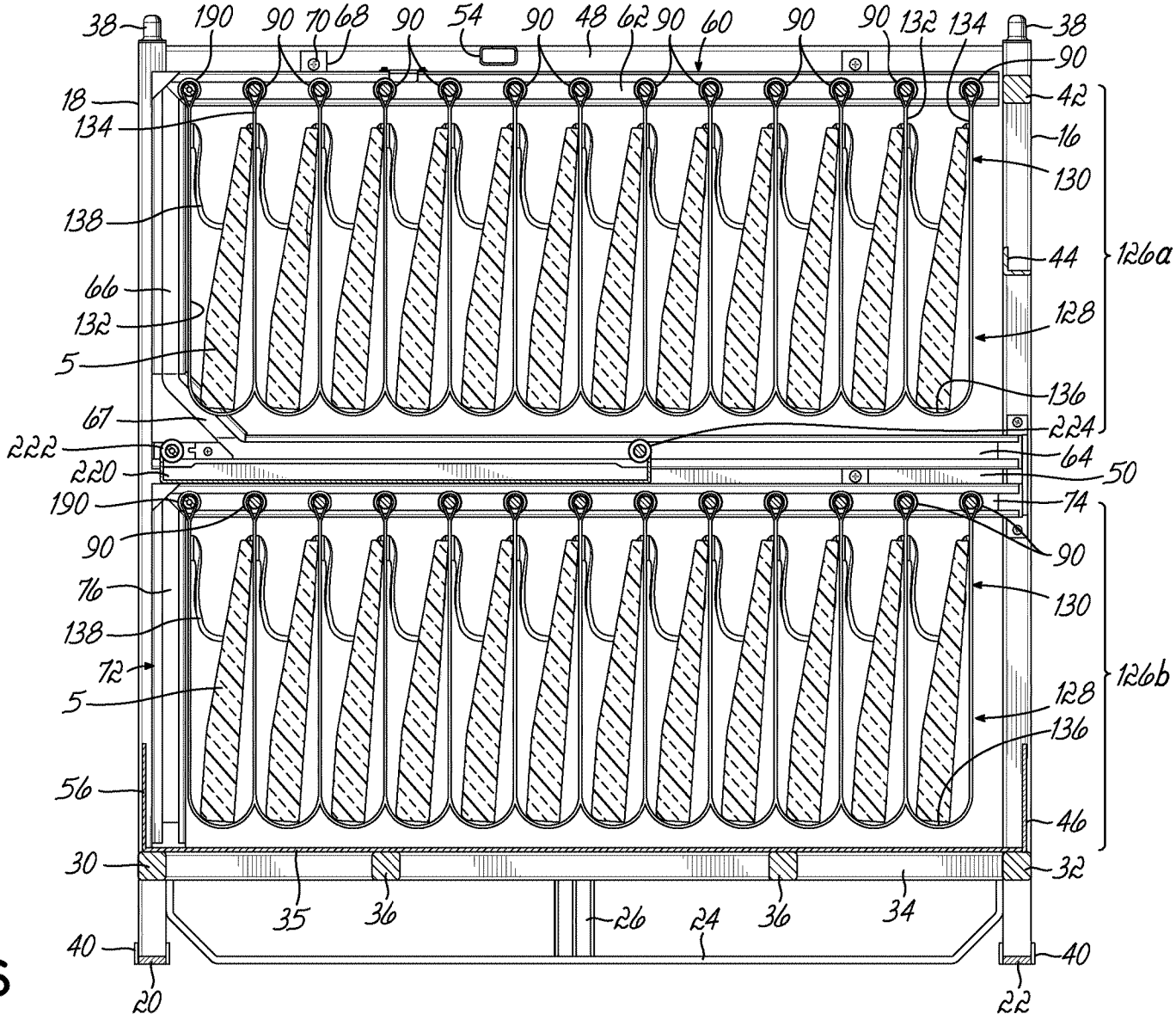
FIG. 6 is a cross-sectional view of one side of the container of FIG. 1 loaded with products.

As best shown in FIG. 1A, the sub-base 28 of the container 10 further comprises a plurality of intersecting interior members 36 extending between opposed perimeter members 30, 32 and 34 of sub-base 28 and secured thereto. Although four interior members 36 are shown in the sub-base 28 of the container 10, any number of interior members, including a solid member, may be used. Each of the interior members 36 of the sub-base 28 is generally rectangular in cross-section and has a hollow interior. As best shown in FIG. 6, a floor 35 rests on top of the sub-base 28 of the frame 12. Although the floor 35 is shown as one piece, the floor may comprise multiple pieces and may be made of any desired material. One suitable material is corrugated plastic.

Figure 2:
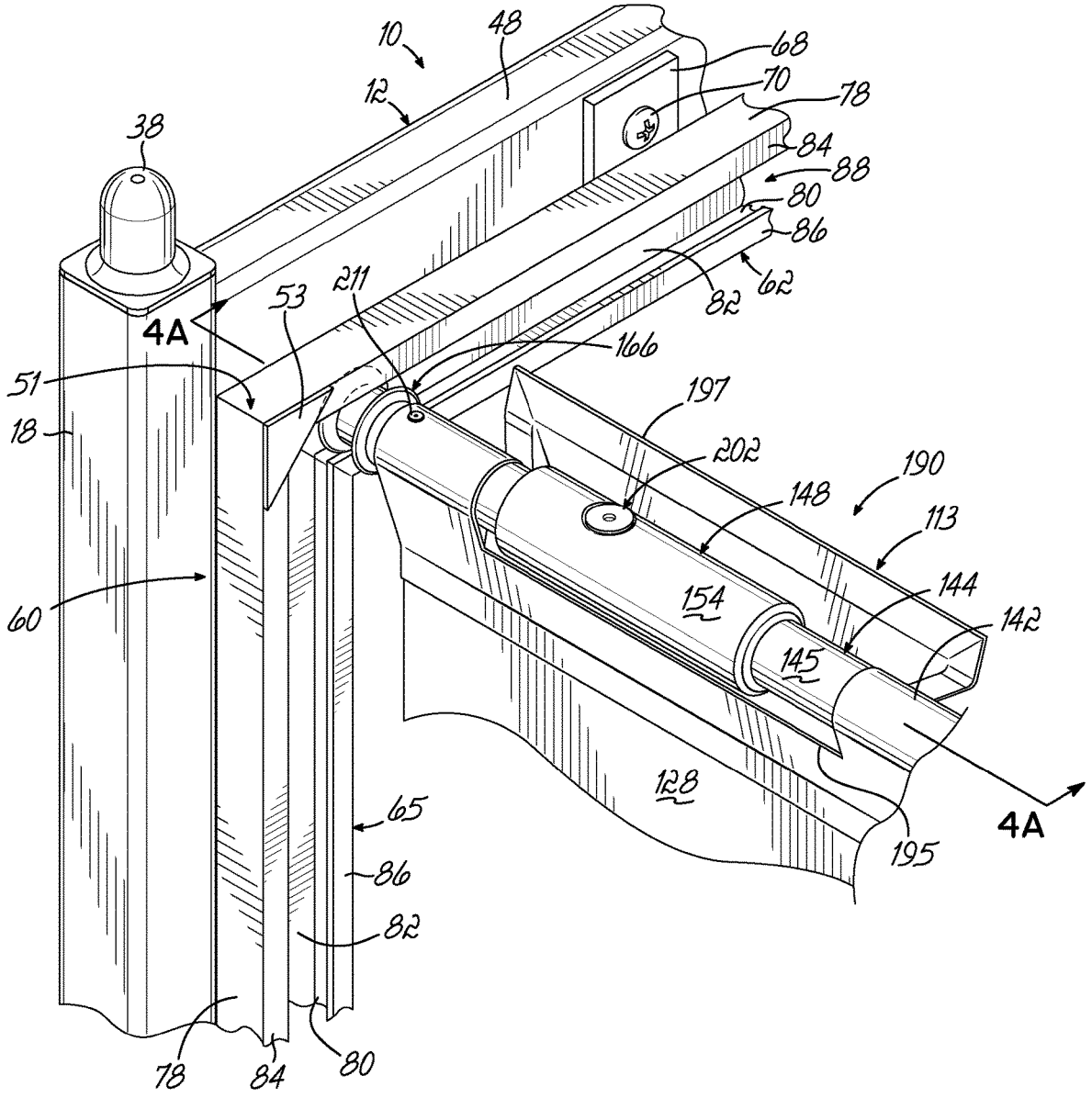
FIG. 2 is an enlarged view of the encircled area 2 of FIG. 1.

As best shown in FIG. 2, each of the front corner posts 18 and each of the rear corner posts 18 is generally rectangular in cross-section, has a hollow interior, and a knob 38 at the top thereof for stacking purposes so that multiple containers 10 may be stacked upon one another. The knobs 38 of a first container fit inside the hollow interiors of the corner posts of another or second container located above the first container for stacking purposes. As shown in the drawings, a cap 40 adapted to receive one of the knobs 38 may be located at the bottom of each corner post.

As best shown in FIG. 1A, frame 12 further comprises an upper rear member 42, middle rear member 44 and lower rear member 46, each rear member 42, 44, 46 extending between the two rear corner posts 16 and being secured thereto. The frame 12 further comprises, on each side of the container, an upper side member 48 generally co-planar with the upper rear frame member 42, a middle side member 50 generally co-planar with the middle rear frame member 44, and a lower side member 52 generally co-planar with the lower rear frame member 42. Each of the side members 48, 50 and 52 extends between one of the rear corner posts 16 and one of the front corner posts 18 and is secured thereto.

The frame 12 may further comprise a top brace 54 extending between the upper side members 48 and secured thereto by any conventional means, including welding. The frame 12 further comprises a front brace 56 extending between the front corner posts 18 and secured thereto by any conventional means, including welding. If desired, the top brace 54 and/or front brace 56 may be omitted in any of the embodiments shown or described herein.

Although one configuration of frame is illustrated, the present invention may be used with other types or configurations of frames.

Although not shown, container 10 may further comprise any number of generally vertically oriented spaced track supports made of any desired material secured to the upper and middle side members 48, 50 on each side of container 10, as disclosed in U.S. Pat. No. 9,211,999. The track supports may be secured to the frame 12 with fasteners (not shown) or via welding. The apparatus used to hold the tracks in place is not intended to be limiting and is not intended to be part of the present invention.

Figure 1B:
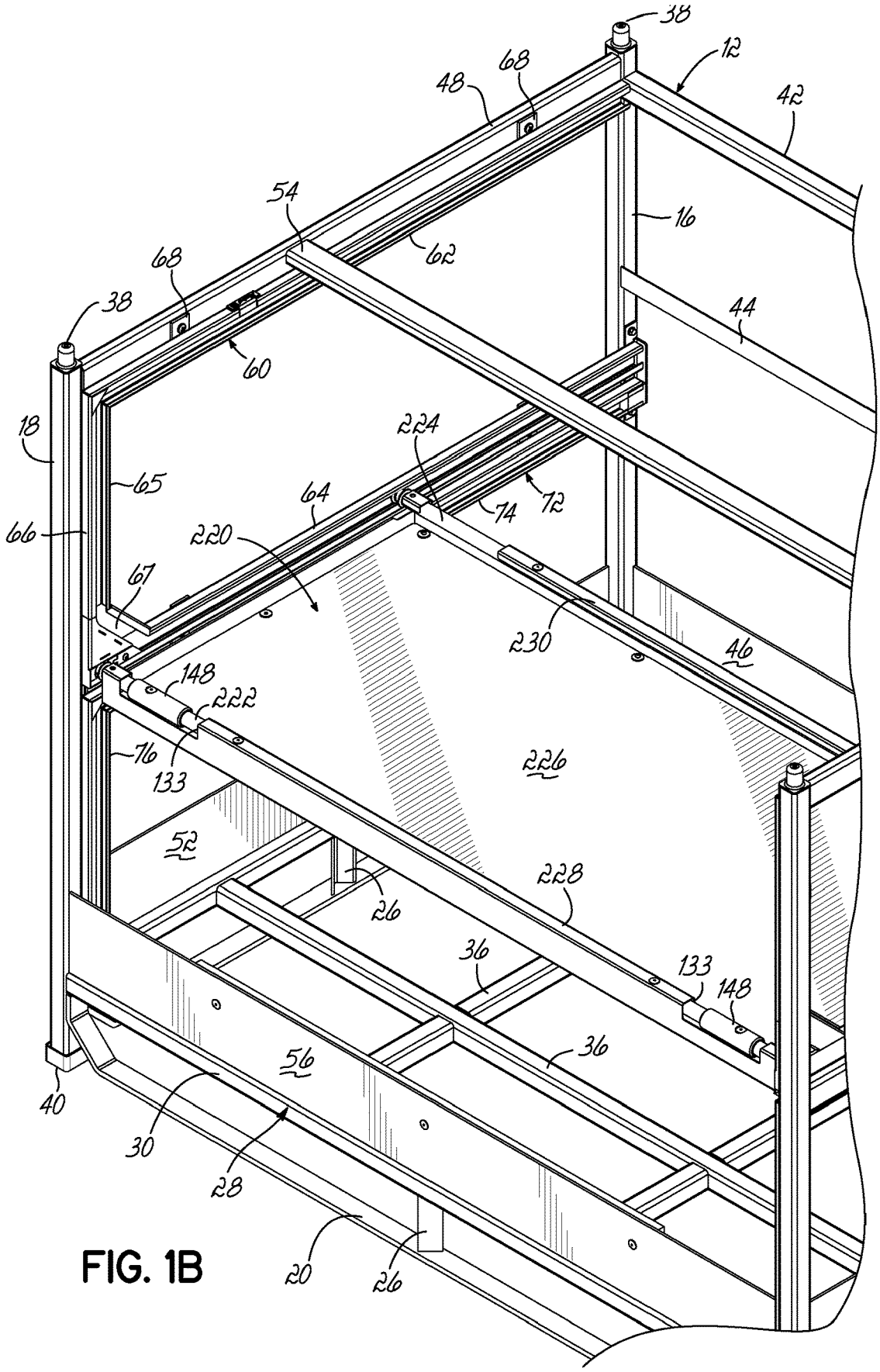
FIG. 1B is an enlarged perspective view of a portion of the container of FIG. 1 showing the shelf assembly and tracks, but not the dunnage and crossbar assemblies.

As shown in FIG. 1B and FIG. 2, a stationary generally U-shaped upper track 60 is secured via mounting brackets 68 to each side of the container 10 in any desired manner, such as welding, for example. Each generally U-shaped upper track 60 comprises stationary generally parallel horizontally oriented upper and lower portions 62, 64, respectively, vertically spaced apart from each other at different levels. A connecting portion 66, including a straight portion 65 and an angled portion 67 below the straight portion 65, joins the generally parallel generally horizontally oriented upper and lower portions 62, 64, respectively, of each generally U-shaped upper track 60 on each side of the container. The angled portion 67 is angled with respect to the straight portion 65 of the connecting portion 66 and angled relative to the generally horizontally oriented lower portion 64 of the generally U-shaped track 60. The connecting portion 66 of the generally U-shaped upper track 60 may comprise a generally vertically oriented piece welded or otherwise secured to the generally horizontally oriented upper and lower portions 62, 64, respectively, of each generally U-shaped upper track 60.

Figure 4A:
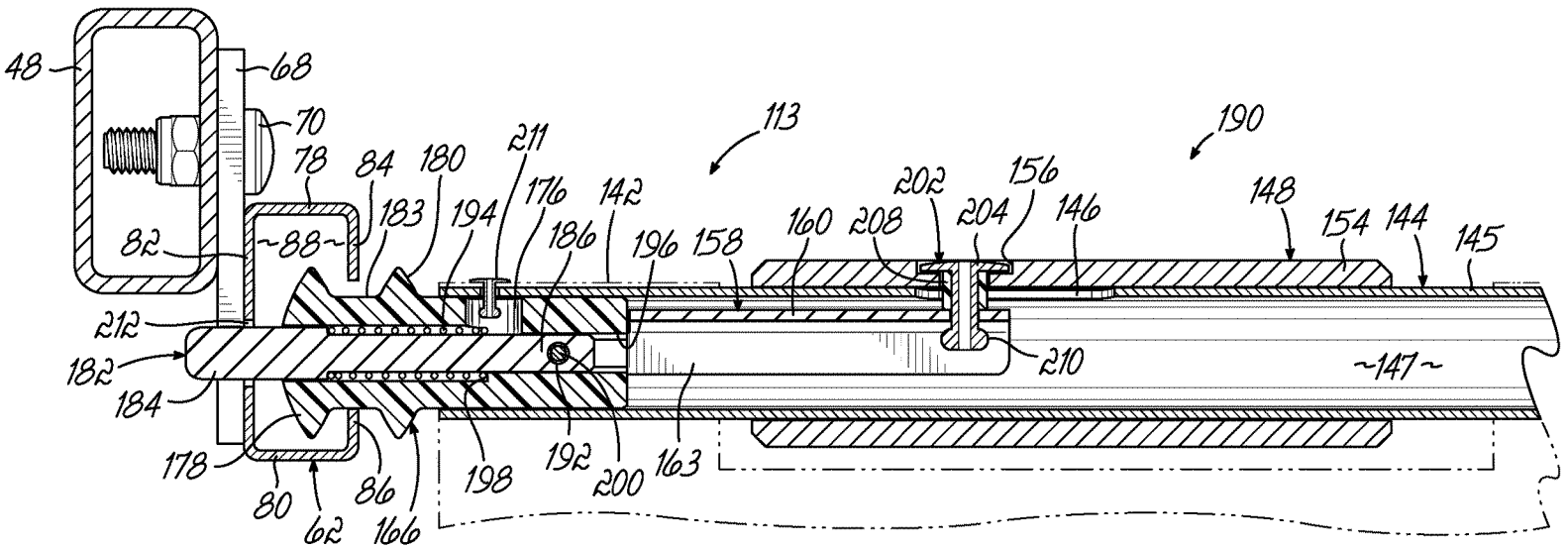
FIG. 4A is a cross-sectional view taken along the line 4A-4A of FIG. 2, showing a lockable crossbar assembly locked in a predetermined position.
Figure 4B:
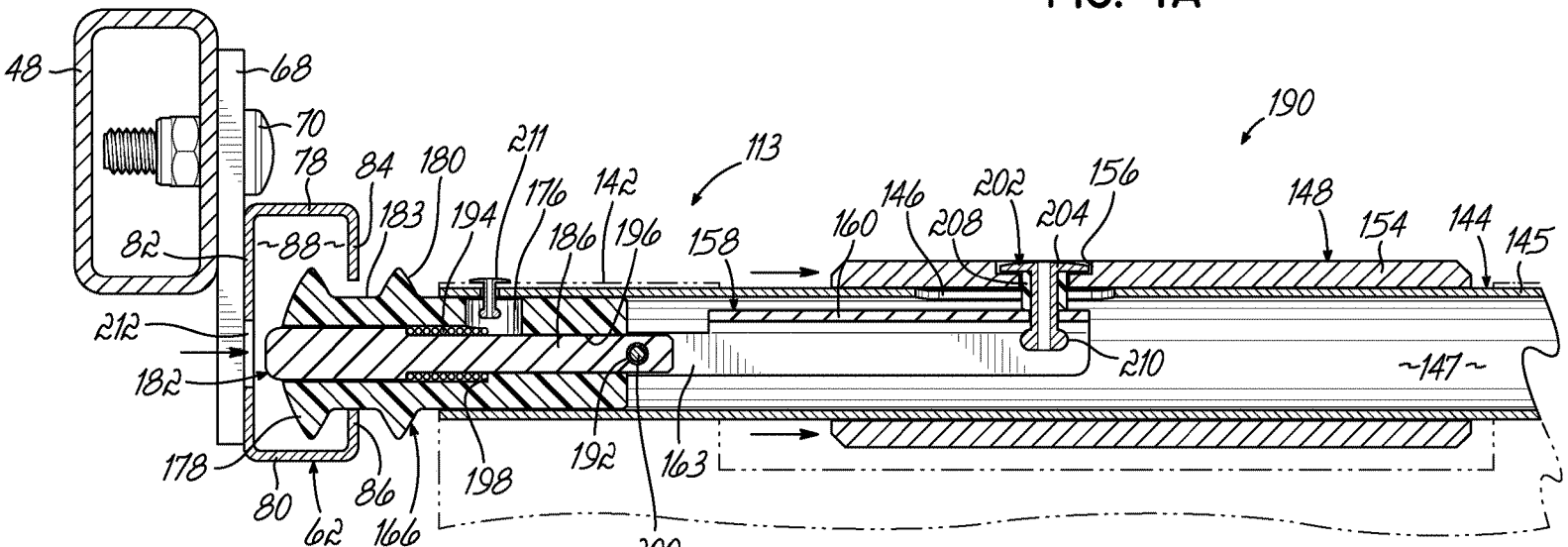
FIG. 4B is a cross-sectional view of the portion of lockable crossbar assembly of FIG. 4A, showing one of the locking pins being retracted out of engagement with one of the openings in one of the tracks.

As best shown in FIGS. 2, 4A and 4B, mounting brackets 68, welded or otherwise secured to the generally horizontally oriented upper portion 62 of the generally U-shaped upper track 60, are secured via fasteners 70, shown as being screws, to one of the upper side members 48 of frame 12. On each side of the container, the generally U-shaped upper track 60 may be secured in any desired manner to the container side. The apparatus used to hold the tracks in place is not intended to be limiting.

As best shown in FIG. 2, the generally horizontally oriented upper portion 62 and generally vertically oriented straight portion 65 of connecting portion 66 of generally U-shaped upper track 60 may be fixedly secured to the container 10. Each track does not move after the container is assembled and do not move relative to the frame 12 of container 10 during the loading or unloading of parts or products. On each side of the container, the top of the generally vertically oriented straight portion 65 may connect or communicate with the front end of the generally horizontally oriented upper portion 62 of generally U-shaped upper track 60 at corner 51. The interior 88 of the generally horizontally oriented upper portion 62 connects with the interior of the generally vertically oriented straight portion 65 so that one of the crossbar assemblies 90, 190 may move along a continuous path in both a horizontal and vertical direction. The generally horizontally oriented upper portion 62 and generally vertically oriented straight portion 65 may be separate pieces welded or joined together or may be a unitary generally L-shaped piece of track fixedly secured to one of the sides of the container 10. In either event, a corner piece 53 may be welded or otherwise secured to each corner 51 to prevent the end members or portions of the crossbar assemblies 90, 190 from coming out of the tracks at corners 51.

As best shown in FIG. 1A, on each side of the container 10, a stationary generally L-shaped lower track 72 may be secured to one of the frames 12 and, in particular, to one of the rear corner posts 16, one of the front corner posts 18 and/or one of the middle side members 50 with a bracket and fastener or any other desired manner, such as welding, for example. Again, the apparatus used to hold the tracks in place is not intended to be limiting.

Each generally L-shaped lower track 72 is spaced below the generally horizontally oriented lower portion 64 of the generally U-shaped track 60. As shown in FIGS. 1A and 6, each L-shaped lower track 72 has a first generally horizontally oriented portion 74 extending from front to back inside the container and a second generally vertically oriented portion 76 extending from top to bottom inside the container. As shown in FIG. 1B, the first generally horizontally oriented portion 74 of generally L-shaped lower track 72 is below and generally parallel to the generally horizontally oriented lower portion 64 of the generally U-shaped upper track 60. For purposes of this document, the description of the positioning of various components is described with respect to the container 10 being in the position illustrated in FIG. 1.

Figure 1C:
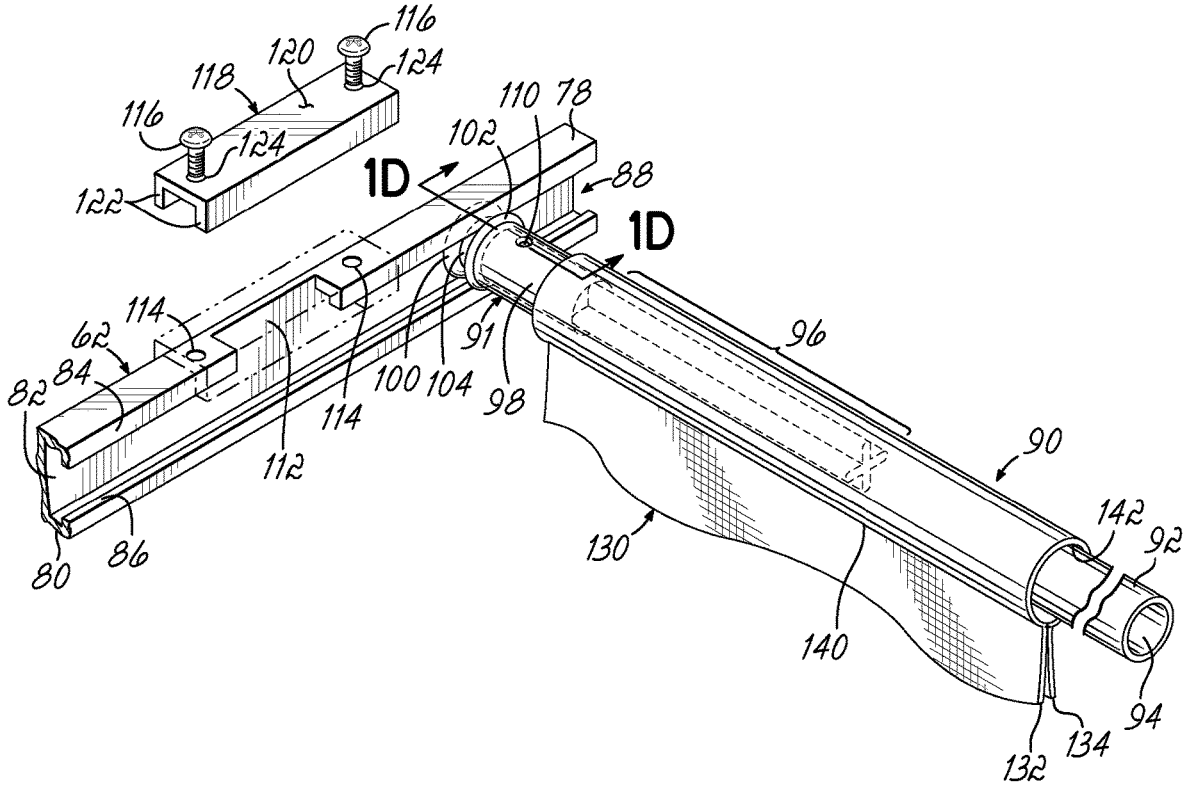
FIG. 1C is an enlarged perspective view of a portion of the container of FIG. 1.

Each generally U-shaped upper track 60 and each generally L-shaped lower track 72 are fixed in a stationary position on one side of the container. The tracks are arranged in corresponding pairs at the same vertical levels. Each track may be one-piece or multiple pieces. Although the drawings disclose one generally U-shaped upper track 60 and one generally L-shaped lower track 72 on each side of the container, the container may have any number of different levels or layers of tracks of any desired shape. As best shown in FIG. 1C, the generally horizontally oriented upper portion 62 of each of the generally U-shaped upper tracks 60, along with the generally horizontally oriented portion 74 of each of the generally L-shaped lower tracks 72 each may have an opening therein covered with a cover to remove damaged components. One such cover is shown in FIG. 1C and described in U.S. Pat. No. 9,211,999. However, any other cover may be used.

As best shown in FIGS. 4A and 4B, each generally U-shaped upper track 60, and each generally L-shaped lower track 72, has a generally C-shaped cross-section. Each track, regardless of shape, has an upper wall 78, a lower wall 80 joined to the upper wall 78 by a side wall 82, and an upper lip 84 extending downwardly from the upper wall 78 and lower lip 86 extending upwardly from the lower wall 80 defining an interior 88 of the track.

Referring to FIG. 6, container 10 comprises upper and lower vertically spaced layers or levels 126*a*, 126*b* of dunnage 128. However, in accordance with the present invention, the container may comprise any number of levels of vertically spaced dunnage. As shown in FIG. 6, each level 126*a*, 126*b* of dunnage 128 comprises a plurality of unlockable crossbar assemblies or dunnage supports 90 and at least one lockable crossbar assembly 190. At each vertical level 126*a* and 126*b*, the front crossbar assembly is a lockable crossbar assembly 190 of the set of crossbar assemblies extending between corresponding tracks at the same level.

For purposes of this document, lockable crossbar assembly 190 and unlockable crossbar assemblies 90 extending between the generally horizontally oriented upper portions 62 of the generally U-shaped upper tracks 60 at the same level on opposed sides of the container will be considered upper crossbar assemblies or a first set of crossbar assemblies. The lockable crossbar assembly 190 and unlockable crossbar assemblies 90 extending between the generally L-shaped lower tracks 72 at the same level on opposed sides of the container will be considered lower crossbar assemblies or a second set of crossbar assemblies.

Figure 1D:
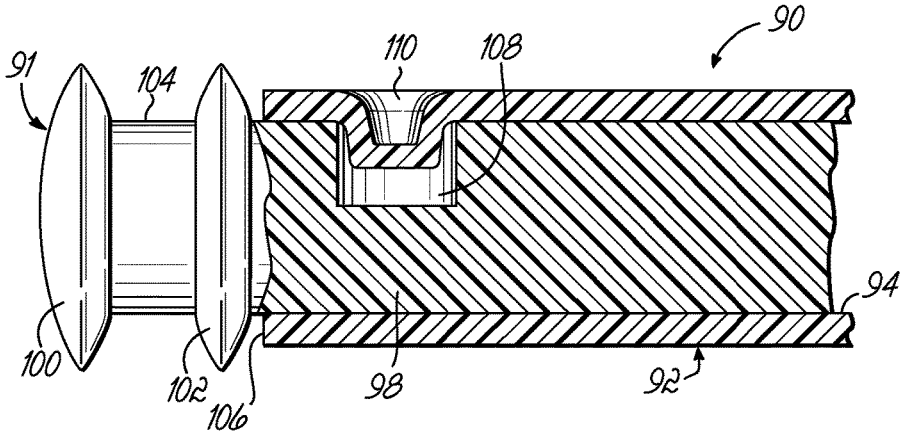
FIG. 1D is a cross-sectional view taken along the line 1D-1D of FIG. 1C.

FIGS. 1C and 1D illustrate the details of one of the unlockable crossbar assemblies 90, while FIGS. 2, 3, 4A and 4B illustrate the details of each of the lockable crossbar assemblies 190.

Although one configuration of unlockable crossbar assembly and one configuration of lockable crossbar assembly and one configuration of track is illustrated being used in container 10, any combination of crossbar assembly and rail/track disclosed or shown herein may be used in any container shown or described herein. One or more of the crossbar assemblies disclosed herein may support dunnage so the dunnage may slide or move inside any of the containers shown or disclosed herein. Alternatively, one or more of the crossbar assemblies may be used in any known manner, including those disclosed herein without supporting dunnage.

As shown in FIG. 1C, each unlockable crossbar assembly or dunnage support 90 includes a pair of end members 91 and a tubular crossbar 92 having a hollow interior 94 extending therebetween. The end members 91 are preferably made of injection molded plastic, such as nylon, but may be made of any other material. The tubular crossbar 92 is preferably made of metal, but may be made of other suitable material, such as plastic or fibrous material.

As shown in FIG. 1C, each end member 91 preferably has a first portion 96 having an X-shaped cross-sectional configuration, and a second portion 98 having a circular cross-sectional configuration. Although one configuration of end member 91 is illustrated, any type or configuration of end member may be used with the present invention.

In this embodiment, each end member 91 has outer and inner heads 100, 102, respectively at the end of the end member 90. Outer head 100 is furthest from the first portion 96 of the end member 90, and inner head 102 is spaced inwardly from outer head 100. The outer and inner heads 100, 102 are spaced from one another to define a groove 104 therebetween which receives and retains the lips 84, 86 of either the generally U-shaped upper track 60 or the generally L-shaped lower track 72. As shown in FIG. 1C, outer head 100 is located inside the interior 88 of either the generally U-shaped upper track 60 or the generally L-shaped lower track 72, and inner head 102 is located outside the interior 88 of either the generally U-shaped upper track 60 or the lower generally L-shaped lower track 72. Outer head 100 keeps the end member 91 engaged with the track, while inner head 102 keeps the dunnage material out of the interior 88 of the track, thereby ensuring that the end members 91 may move smoothly along either the generally U-shaped upper track 60 or the generally L-shaped lower track 72. Though the outer and inner heads 100, 102 of each end member 91 are illustrated being a certain shape, they may be other shapes or configurations, such as thicker or thinner. This is true for any of the heads of any of the end members shown or described herein.

As shown in FIG. 1D, each end of tubular crossbar 92 fits over at least one of the first and second portions 96, 98, respectively, of an end member 91. An end surface 106 of tubular crossbar 92 abuts inner head 102 of end member 91. Each end member 91 of each unlockable crossbar assembly 90 is adapted to engage and move along one of the tracks. The end members 91 preferably slide along the length or width of the tracks; however, different end members may rotate, and/or slide or a combination thereof, along the tracks. Although one configuration of track and end member is shown and described, other types of end members and tracks may be used if desired.

As best shown in FIG. 1D, each unlockable crossbar assembly 90 includes a pair of end members 91 (only one being shown in FIG. 1D). Each end member 91 has a groove 108 formed in the second portion 98 therein. Unlockable crossbar assembly 90 further includes a tubular crossbar 92 having a hollow interior 94 extending therebetween. As shown in FIG. 1C, each end of tubular crossbar 92 fits over at least one of the first and second portions 96, 98, respectively, of an end member 91. An end surface 106 of tubular crossbar 92 abuts inner head 102 of end member 91. As shown in FIG. 1D, tubular crossbar 92 has two detents 110 therethrough (one at each end) in which the material of the tubular crossbar 92 is pressed downwardly into the groove 108. This attachment between each of the two end members 91 and the tubular crossbar 92 enables some movement therebetween. Such interaction between the end members 91 and tubular crossbar 92 allows for a tolerance of approximately one-quarter inch on each side. The detents 110 prevent separation of the tubular crossbar 92 from the end members 91 while allowing some movement therebetween as the detents 110 move within the grooves 108 formed in the end members 91.

FIG. 1C illustrates an unlockable crossbar assembly 90 used to support one side of one of the pouches. FIG. 1C illustrates another feature or aspect of the invention. Generally horizontally oriented upper portion 62 of generally U-shaped upper track 60 has an opening or cut-out 112 formed therein. Holes 114 are formed in the upper wall 78 of the generally horizontally oriented upper portion 62 of generally U-shaped upper track 60, which are sized and threaded to receive fasteners 116. Although fasteners 116 are illustrated to be screws, they may be any other fastener. A cap 118 is removably secured to the generally horizontally oriented upper portion 62 of generally U-shaped track 60 to cover the opening or cut-out 112. As best seen in FIG. 1C, cap 118 has a generally inverted U-shaped cross-sectional configuration, including a top portion 120 and side portions 122 extending downwardly from the top portion 120. Holes 124 are formed through the top portion 120 of the cap 118 and sized to receive fasteners 116, as shown in FIG. 1C. The fasteners 116 are adapted to pass through the holes 124 in the cap 118 and into the holes 114 in the upper wall 70 of the generally horizontally oriented upper portion 62 of generally U-shaped upper track 60. Caps of alternative shapes or sizes may be used. A cap may be secured to the track in a snap-fit manner without the use of fasteners.

When one of the end members or any part of any of the crossbar assemblies, lockable or not, is damaged or needs to be replaced for any reason, one may remove cap 118 after loosening fasteners 116, thereby exposing the opening or cut-out 112 of the generally horizontally oriented upper portion 62 of generally U-shaped upper track 60. The damaged crossbar assembly or dunnage support may then be removed or inserted as necessary to repair or replace the damaged part or parts. The lower generally L-shaped lower track 72, or any track described or illustrated herein, may have the same cut-out and cap for the same purpose.

Although one configuration of dunnage support in the form of an unlockable crossbar assembly is illustrated, the present invention may be used with any type or configuration of dunnage support for supporting dunnage so the dunnage may slide or move inside the container. Although the drawings show each dunnage support 90 comprising multiple components in an assembly, it is within the scope of the present invention that each dunnage support be a unitary member as disclosed in U.S. Pat. No. 9,120,597 or U.S. patent application Ser. No. 14/281,246 or U.S. patent application Ser. No. 14/539,115, each of which is fully incorporated by reference herein.

Figure 1E:
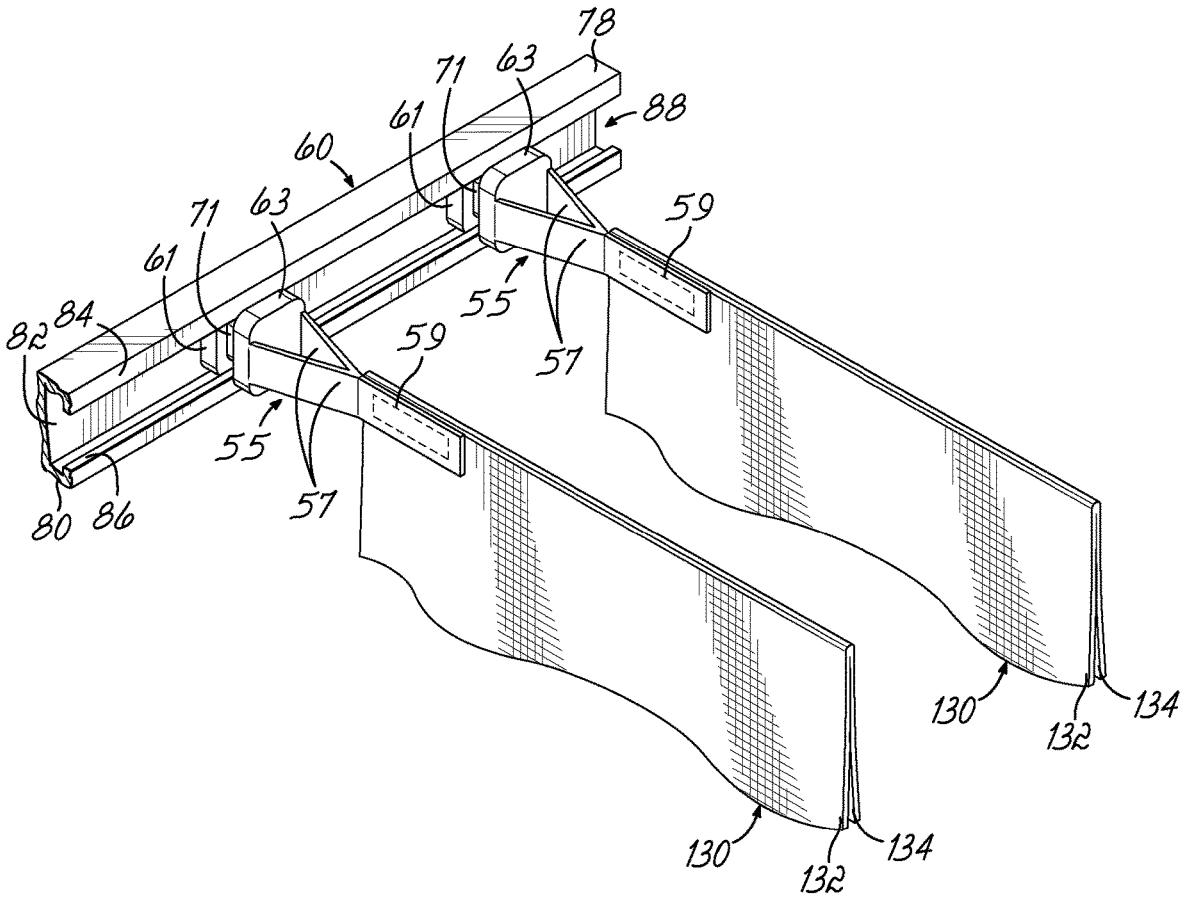
FIG. 1E is an enlarged perspective view of another version of dunnage support.
Figure 1F:
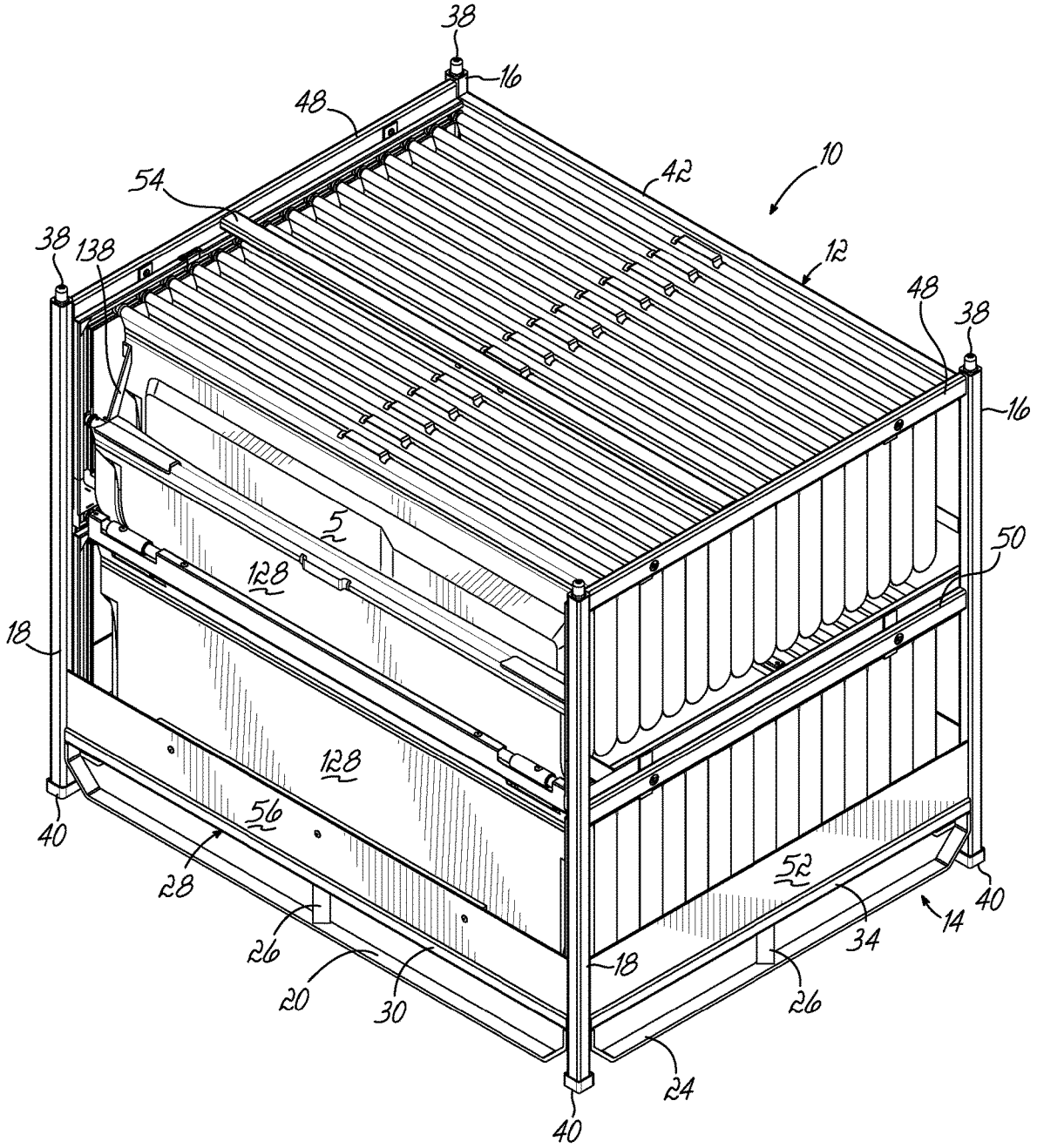
FIG. 1F is a perspective view of the container of FIG. 1 showing a front crossbar assembly of an upper level of dunnage being suspended.

For example, FIG. 1E illustrates another version of unlockable dunnage support 55 used to support one side of one of the pouches 130. Dunnage support 55 does not extend from one track to the other track, unlike unlockable dunnage support 90. Rather, each pouch 130 is supported by four dunnage supports 55, two dunnage supports 55 at opposite ends of each pouch wall 132, 134.

As shown in FIG. 1E, each dunnage support 55 comprises an outer head 61 and inner head 63 spaced inwardly from outer head 61. The outer and inner heads 61, 63, respectively, of each end member 55 are spaced from one another to define a groove 71 therebetween. The groove 71 of each end member 55 receives and retains the lips 84, 86 of one of the generally L-shaped tracks 60 during travel of the dunnage support 55 along a path defined by the tracks. As shown in FIG. 1E, outer head 61 is located inside the interior 88 of the generally L-shaped track 60, and inner head 63 is located outside the interior 88 of the generally L-shaped track 60. Outer head 63 keeps the end member 55 engaged with the track. Inner head 63 keeps the dunnage material out of the interior 88 of the track, thereby ensuring that the end members 55 may move smoothly along the generally L-shaped tracks 60 or any other tracks shown or described herein.

Though the outer head 61 and inner head 63 of end member 55 are illustrated being a certain shape, they may be other shapes or configurations, such as thicker or thinner. For example, although the outer head 61 and inner head 63 of end member 55 are illustrated being generally rectangular, they may be disk-shaped like the heads 100, 102 of dunnage support 90 shown in FIGS. 1C and 1D.

Figure 7A:
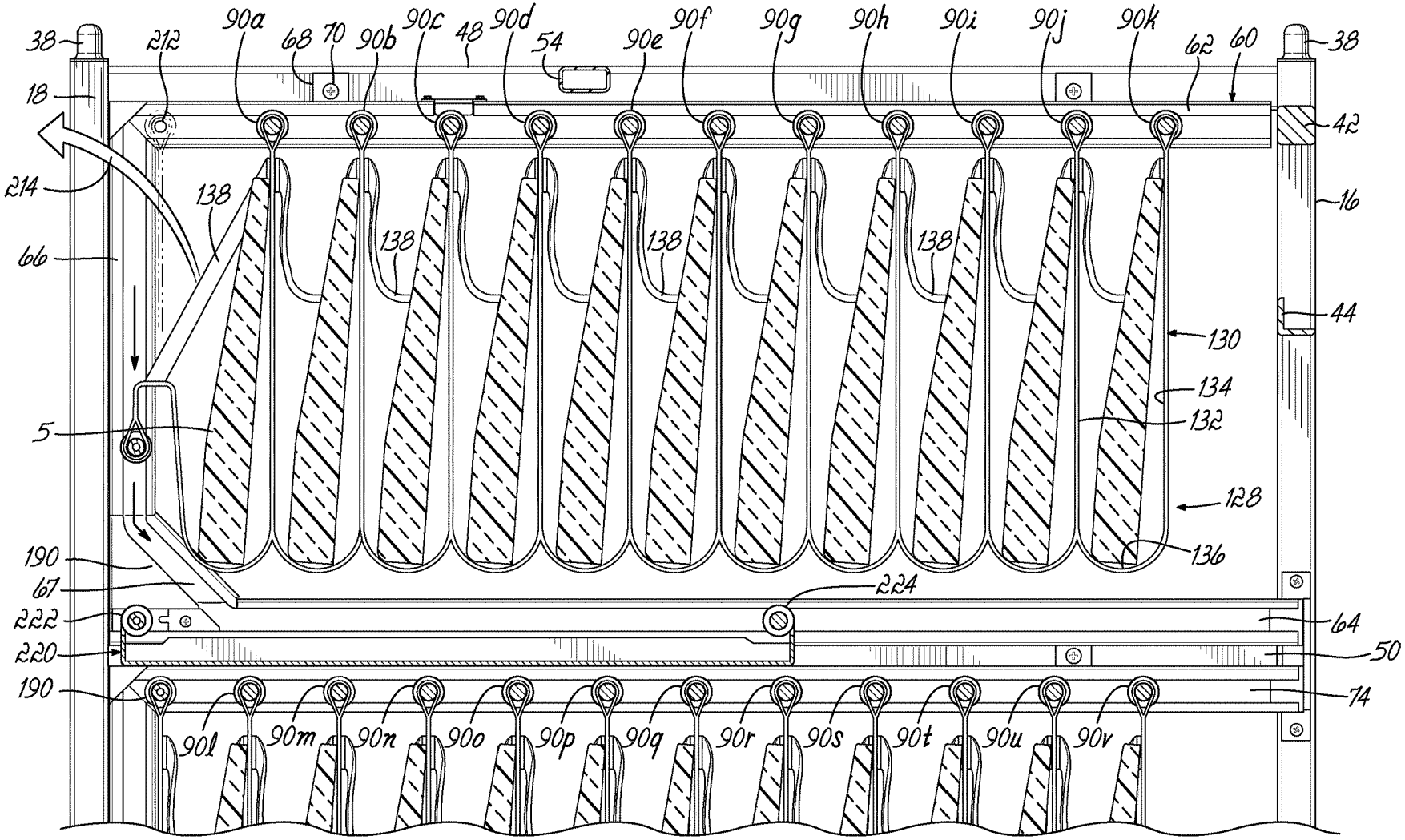
FIG. 7A is a cross-sectional view of a portion of the container of FIG. 1, showing the front product of an upper layer of products being removed.
Figure 7B:
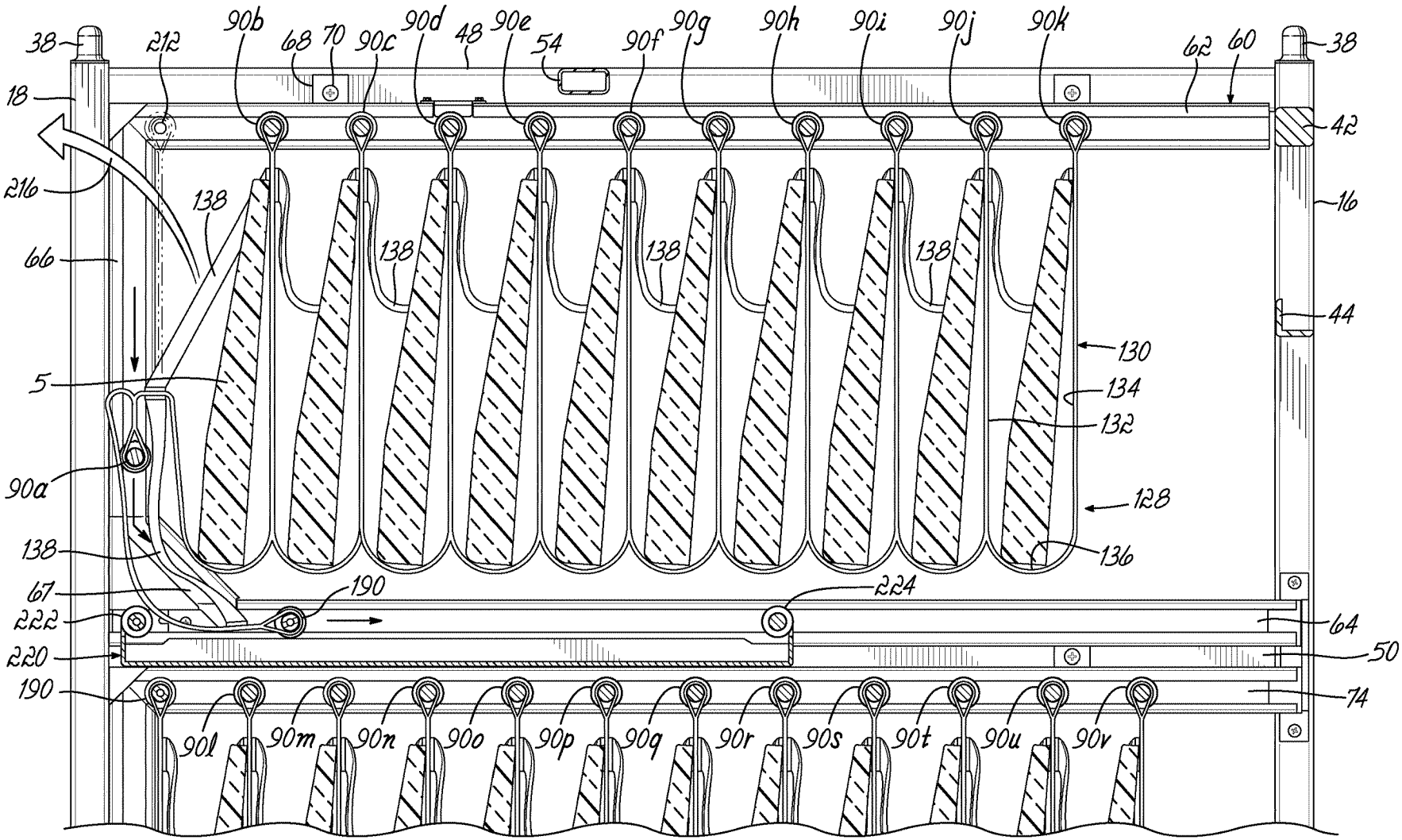
FIG. 7B is a cross-sectional view of a portion of the container of FIG. 1, showing the second product of the upper layer of products being removed.

As shown in FIG. 7B, end member 55 has connecting straps 57 secured at one end to the end member 55 and secured at the other end to the pouch 130 with stitches 59. When viewed from the top, these straps 57 have a generally V-shaped configuration. Although two connecting straps 57 are shown per end member 55, only one connecting strap or any number of connectors may be used to join the dunnage pouch 130 to the end member 55.

Figure 3:
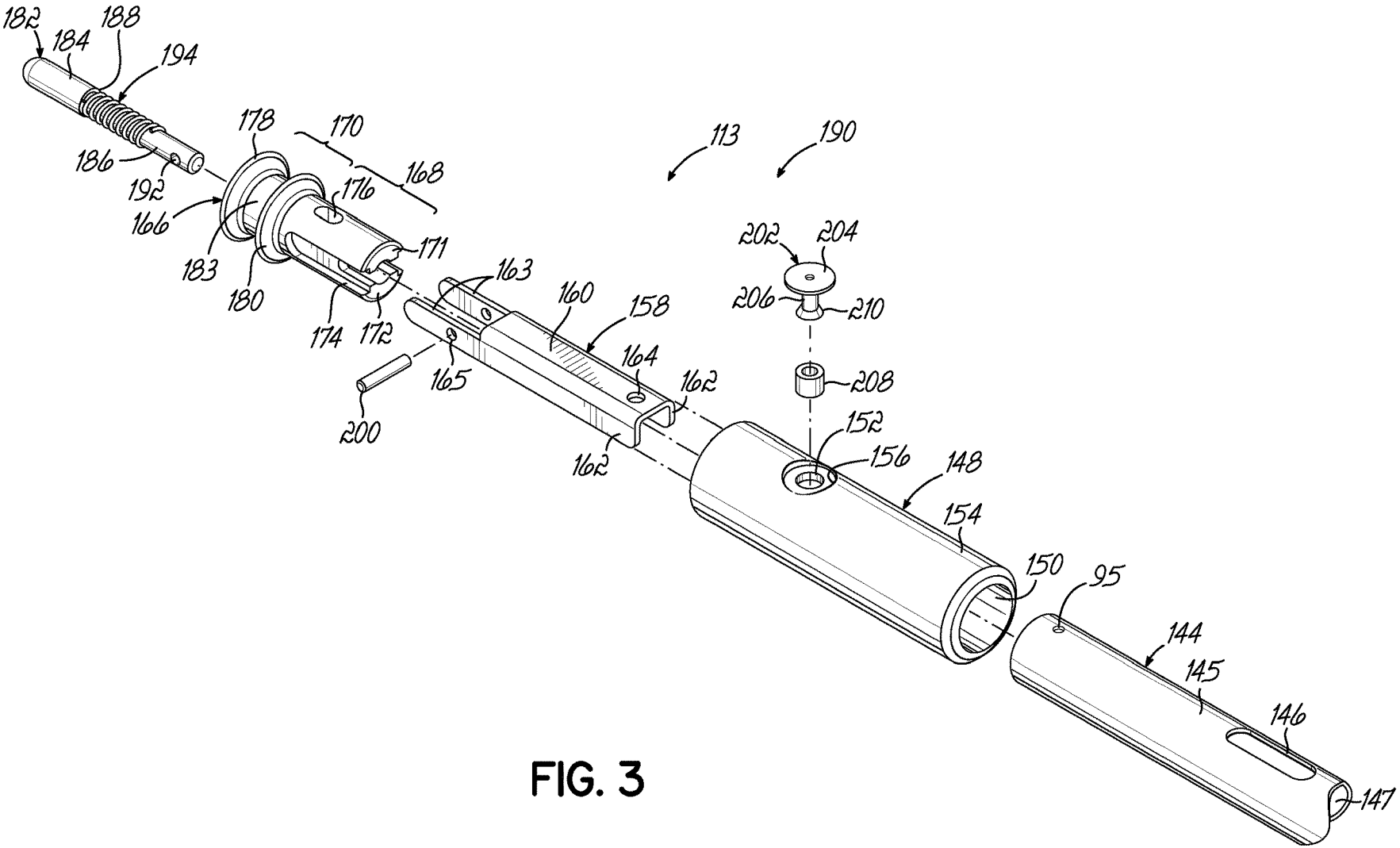
FIG. 3 is a partially disassembled view taken of one of the locking assemblies of one of the lockable crossbar assemblies.

FIGS. 2, 3, 4A and 4B illustrate the components and operation of one of the lockable crossbar assemblies 190. Each lockable crossbar assembly 190 has two locking assemblies 113 between which is a crossbar 144. As shown in FIG. 3, each lockable crossbar assembly 190 has a crossbar 144 having an outer wall 145 defining a hollow interior 147. The outer wall 145 of the crossbar 144 has a slot 146 at each end (only one being shown in FIG. 3). The crossbar 144 may be made of metal or any other suitable material, such as plastic or fibrous material.

As best shown in FIG. 3, each locking assembly 113 of each lockable crossbar assembly 190 comprises a handle 148 having a hollow interior 150 inside which is located a portion of crossbar 144. The handle 148 has an opening 152 extending through its wall 154 and a recess 156 surrounding the opening 152. The opening 152 is illustrated as being circular, but may be another shape; same with recess 156.

As best shown in FIG. 3, each locking assembly 113 of each lockable crossbar assembly 190 further comprises a key 158, which is a unitary part having a top portion 160 and two side portions 162 of a length greater than the top portion 160, resulting in legs 163. The top portion 160 of key 158 has an opening 164, and each of the legs 163 has an opening 165.

As best shown in FIG. 3, each locking assembly 113 of each lockable crossbar assembly 190 further comprises an end member 166 having two spaced heads 178, 180 like end members 91 of unlockable crossbar assemblies 90, shown in detail in FIGS. 1C and 1D. The end members 166 are preferably made of injection molded plastic, such as nylon, but may be made of any other material.

As shown in FIG. 3, each end member 166 has an inner portion 168 and an outer portion 170. The inner portion 168 has upper and lower portions 171, 172, respectively, separated by grooves 174 on each side, the grooves 174 being adapted to receive the legs 163 of the unitary key 158. The upper portion 171 of the inner portion 168 of end member 166 has a detent 176. The outer portion 170 of end member 166 has a pair of heads 178, 180 at the end of the end member 166. Outer head 178 is furthest from the inner portion 168 of the end member 166, and inner head 180 is spaced inwardly from outer head 178. The outer and inner heads 178, 180, respectively, are spaced from one another to define a groove 183 therebetween which receives and retains the lips 84, 86 of either the generally U-shaped upper track 60 or the generally L-shaped lower track 72 or the lips of any of the tracks described or shown herein. Though the heads 178, 180 of each end member 166 are illustrated being a certain shape, they may be other shapes or configurations, such as thicker or thinner.

As shown in FIGS. 4A and 4B, outer head 178 is located inside the interior 88 of either the generally U-shaped upper track 60 or the generally L-shaped lower track 72, and inner head 180 is located outside the interior 88 of either the generally U-shaped upper track 60 or the generally L-shaped lower track 72. Outer head 178 keeps the end member 166 engaged with the track, while inner head 180 keeps the dunnage material out of the interior 88 of the track, thereby ensuring that the end members 166 may move smoothly along either the generally U-shaped upper track 60 or the generally L-shaped lower track 72, thereby ensuring that the end members 166 may move smoothly along the tracks at the same container level. The end members 166 of each of the lockable crossbar assemblies 190 function and travel along the tracks as do the end members 91 of each of the unlockable crossbar assemblies 90.

As best shown in FIG. 3, each locking assembly 113 of each lockable crossbar assembly 190 further comprises a locking pin 182. The locking pin 182 has an outer portion 184 and an inner portion 186, the diameter of the outer portion 184 being larger than the diameter of the inner portion 186, thereby creating a shoulder 188 between the inner and outer portions 186, 184. An opening 192 extends through the inner portion 186 of the locking pin 182. A spring 194 surrounds the inner portion 186 of locking pin 182 and abuts the shoulder 188 of locking pin 182.

As best shown in FIGS. 4A and 4B, upon assembly, the locking pin 182 and spring 194 extend into a bore 196 extending through the end member 166. The end member 166 has a shoulder 198 below the detent 176. The spring 194 is shown in a relaxed position in FIG. 4A. In FIG. 4A, the spring 194 extends between the shoulder 188 of locking pin 182 and the shoulder 198 of end member 166, thus extending the locking pin 182 to an extended position. In its extended position, the outer portion 184 of the locking pin 182 extends through an opening 212 in one of the side walls 82 of one of the tracks.

In FIG. 4B, the spring 194 is shown in a compressed position between the shoulder 188 of the locking pin 182 and the shoulder 198 of end member 166. As the locking pin 182 moves inwardly towards the center of the lockable crossbar assembly 190 by a user moving the handle 148 inwardly towards the center of the lockable crossbar assembly 190, the spring 194 is compressed between shoulder 188 of the movable locking pin 182 and shoulder 198 of the end member 166. When an operator lets go of the handle 148, the spring 194 biases or forces the locking pin 182 outwardly (to the left as shown in FIGS. 4A and 4B) to an extended position.

As best shown in FIGS. 3, 4A and 4B, upon assembly, the legs 163 of the key 158 reside in the grooves 174 of the end member 166 and are held therein by pin 200. Pin 200 also extends through opening 192 in the locking pin 182 and through openings 165 of key 158, thereby connecting the locking pin 182 to the key 158. A rivet 202 joins key 158, handle 148 and crossbar 144. More particularly, rivet 202 has a generally planar upper portion 204 which resides in the recess 156 of handle 148 upon assembly. Rivet 202 has a neck 206 surrounded by a sleeve 208 and a lower portion 210. As shown in FIGS. 4A and 4B, the neck 206 of the rivet 202 and sleeve 208 travel along the slot 146 of crossbar 144 when the handle 148 is moved. The neck 206 of the rivet 202 extends through the sleeve 208 and through opening 164 in the key 158, the lower portion 210 of rivet 202 keeping the rivet 202 in place.

In operation, inward movement of the handles 148 by an operator causes inward movement of the keys 158, which causes inward movement of the locking pins 182. Inward movement of the locking pins 182 compresses the springs 194 against the outward bias of spring 194. The crossbar 144 and end member 166 do not move axially upon movement of the handles 148. As shown in FIGS. 4A and 4B, inward movement of the handles 148 by an operator causes the locking pins 182 to move from extended locked positions extending through openings 212 in side walls 82 of the generally horizontally oriented upper portions 62 of generally U-shaped upper tracks 60, for example. Although one locking assembly 113 (left side) of the lockable crossbar assembly 190 is shown in FIGS. 4A and 4B, the right side is a mirror image. To unlock the lockable crossbar assembly 190 from a locked position shown in FIG. 4A to an unlocked position shown in FIG. 4B, an operator must move handles 148 of the locking assemblies 113 inwardly towards each other, compressing springs 194 of the lockable crossbar assembly 190 and moving two locking pins 182 inwardly through openings 212 in side walls 82 of the generally horizontally oriented upper portions 62 of generally U-shaped upper tracks 60. Once the locking pins 182 are in their unlocked position shown in FIG. 4B, an operator is free to move the lockable crossbar assembly 190 to its desired position, including another position along the generally U-shaped upper tracks 60.

Figure 26:
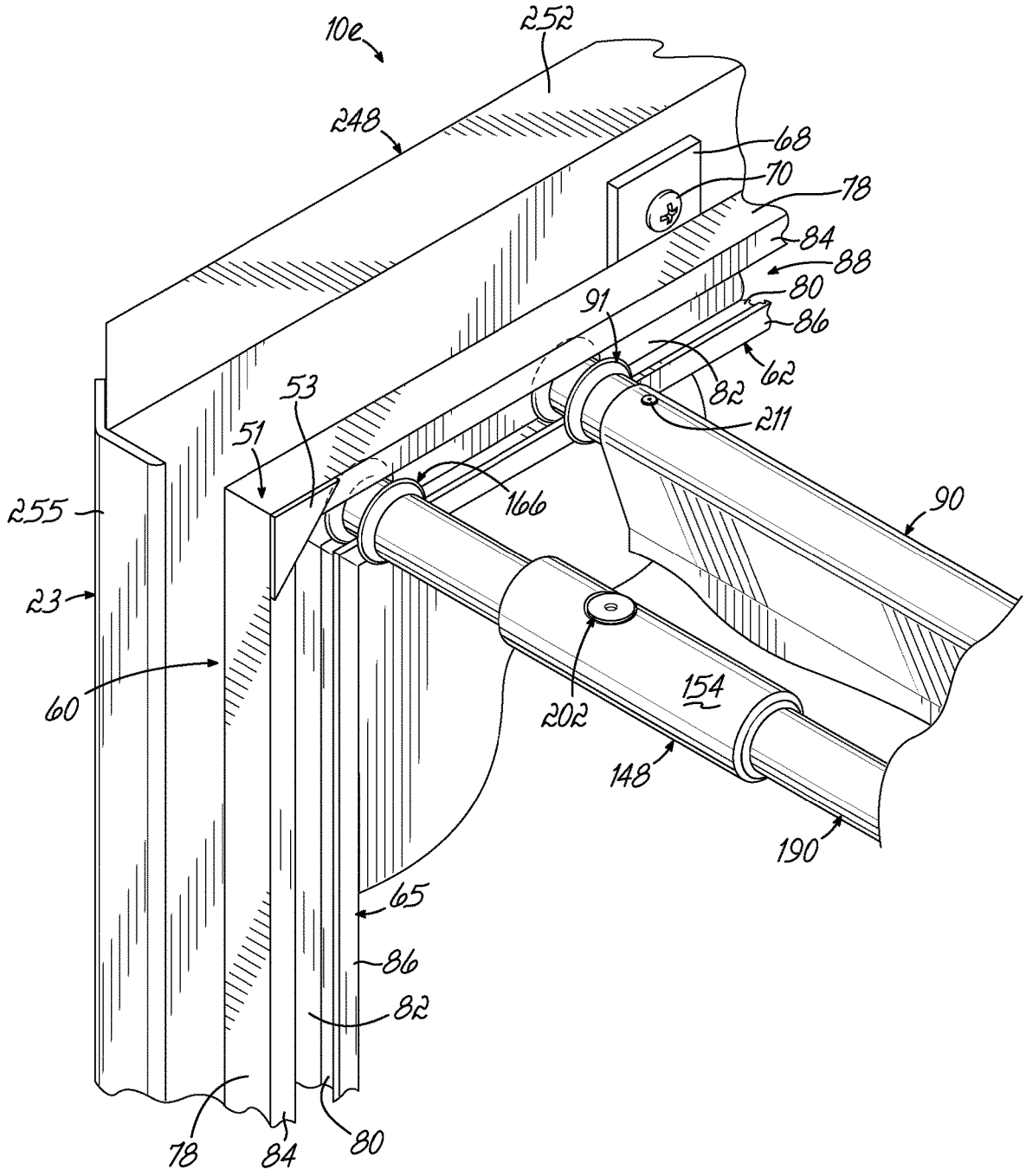
FIG. 26 is an enlarged view of the encircled area 26 of FIG. 25.

As shown in FIGS. 2, 4A and 4B, a rivet 211 at each end secures dunnage 128 to the end member 166 of lockable crossbar assembly 190. The rivet 211 extends into the detent 176 of the end member 166 and allows limited movement of the dunnage, as seen in FIGS. 4A and 4B. As best shown in FIG. 26, such rivets 211 may be used at each end of an unlockable crossbar assembly to secure limit movement of the dunnage relative to the crossbar assembly. Such rivets may be used with any of the crossbar assemblies disclosed herein, lockable or not, with any of the end members disclosed herein.

Although one configuration of lockable crossbar assembly 190 is illustrated in container 10, any type or configuration of lockable crossbar assembly disclosed herein may be used in any container shown or disclosed herein and be selectively locked and/or unlocked in a fixed position. The lockable crossbar assembly 190 may support dunnage so the dunnage may move inside the container. Alternatively, as described below, a lockable crossbar assembly 190 may be used to keep the unlockable crossbar assemblies 90 in a predetermined location for a predetermined time period, i.e., during shipping.

Although the drawings show only one set of openings 212 extending through side walls 82 of the generally horizontally oriented upper portions 62 of the generally U-shaped upper tracks 60 near the upper corners of the tracks, any number of openings extending through track side walls anywhere along the path of the generally U-shaped upper tracks 60 may be used at any desired locations in any of the embodiments shown or described herein to hold any of the lockable crossbar assemblies in a desired location. The location and number of openings adapted to receive and retain any number of lockable crossbar assemblies for supporting dunnage so the crossbar assemblies and hanging dunnage may be fixed inside the container is not intended to be limited by the drawings. Regardless of the shape of the track, the track may have any number of openings at any locations along the track into which a portion of the lockable crossbar assembly may fit to keep the lockable crossbar assembly fixed in a stationary position.

As best shown in FIG. 6, container 10 comprises two layers or level's 126*a* and 126*b* of vertically spaced dunnage 128, each level being in the form of a plurality of pouches 130, and are suspended by and supported by a plurality of crossbar assemblies 190, 90. As shown in FIG. 6, each pouch 130 has a front wall 132, a rear wall 134, a bottom 136 and two flexible straps 138 extending therebetween (one on each side). In some applications, all the pouches may be made of one piece of material, the front wall 132 of one pouch 130 being the rear wall 134 of the pouch 130 in front of it. Alternatively, the pouches 130 may be formed from any number of pieces of material.

The flexible straps 138 may be considered space limiters because they limit the distance adjacent crossbar assemblies may travel from each other. Each flexible strap 138 is preferably made of elastic material which has some stretch, such as nylon, but may be made of any other material, including non-elastic material, such as some plastics. In some applications, the flexible straps 138 may be omitted.

As shown in FIGS. 1E and 6, each of the two flexible straps 138 extending between the front and rear walls of one pouch 130 are sewn or otherwise secured below the crossbar assemblies 90, 190 and proximate a side edge of a pouch 130 so as to enable products 5 to be inserted or removed from the pouches 130 without interference from the flexible straps 138. The flexible straps 138 serve two functions. First, the flexible straps 138 limit the distance adjacent crossbar assemblies may be moved apart. An operator may move the pouches 130 together forwardly as a group so the operator need not reach backwardly too far. By pulling on the front pouch, the operator may move each of the pouches 130 towards the front of the container and towards the operator, providing an ergonomic benefit.

Second, as seen in FIGS. 1E and 7A, the flexible straps 138 suspend one of the crossbar assemblies 90, 190 extending between the generally vertically oriented straight portions 65 of generally U-shaped upper tracks 60 while the adjacent crossbar assembly 90, 190 remains extending between the generally horizontally oriented upper portions 62 of the generally U-shaped upper tracks 60 without the front crossbar assembly falling to the bottoms of the generally vertically oriented connecting portions 66 of the generally U-shaped upper tracks 60. As shown in FIG. 1E, this suspension of the front crossbar assembly creates an opening 191 for removal or insertion of products 5.

As shown in FIG. 6, the front crossbar assembly 190 of the upper level 126*a* of crossbar assemblies extending between the generally U-shaped upper tracks 60 is a lockable crossbar assembly 190, which may be fixed in a desired location during shipment or at any desired time. All the other crossbar assemblies of the upper level 126*a* of crossbar assemblies 90 extending between the generally U-shaped upper tracks 60 are illustrated, being unlockable crossbar assemblies 90. However, any number of crossbar assemblies extending between the generally U-shaped upper tracks 60 may be lockable crossbar assemblies 190.

Similarly, the front crossbar assembly of the lower crossbar assemblies extending between the generally L-shaped lower tracks 72 is a lockable crossbar assembly 190. The other crossbar assemblies of the lower level 126*b* of dunnage 128 and extending between the generally L-shaped lower tracks 72 are unlockable crossbar assemblies 90. However, any number, including all of the crossbar assemblies extending between the generally L-shaped lower tracks 72, may be lockable crossbar assemblies 190.

As shown in FIG. 6, the top of the front wall 132 of the front pouch 130 of each level or layer of dunnage is attached to one of the lockable crossbar assemblies 190, and the rear wall 134 of the same pouch 130 is attached to an adjacent unlockable crossbar assembly 90. For all the remaining pouches, the top of the front wall 132 of a pouch 130 is attached to one of the unlockable crossbar assemblies 90, and the rear wall 134 of the pouch 130 is attached to an adjacent unlockable crossbar assembly 90.

Although the dunnage 128, as shown, comprises pouches, the dunnage may assume other shapes or configurations. A pouch 130 is supported by two adjacent crossbar assemblies. As shown in FIG. 1C, the fabric of the pouch 130 is sewn or otherwise secured together along a seam 140 to make a pocket 142 in which is located a tubular crossbar 92 of a crossbar assembly.

As shown in FIG. 2, the pocket 142 of fabric surrounding each lockable crossbar assembly 190 may have two cut-outs 195 (only one being shown) to allow access to the handle 148 of one of the locking assemblies 113 of lockable crossbar assembly 190. Each cut-out 195 creates a flap 197, which may be secured over the handle 148 with hook and loop fasteners or any other known closing means or mechanism.

Unlockable crossbar assemblies 90 and lockable crossbar assemblies 190 support pouches 130. Each of the crossbar assemblies is adapted to move from back to front inside the interior of the container 10. The end members 91 of the unlockable crossbar assemblies 90 and the end members 166 of the lockable crossbar assemblies 190 move along the non-linear stationary tracks 60, 72.

Multiple pouches 130 are shown being formed or created from one piece of material draped or laying over multiple crossbar assemblies and secured to itself along seams 140, as shown in FIG. 1C. Alternatively, each pouch 130 may be matte from its own piece of material, in which case the pouches 130 would not be interconnected other than via straps or space limiters 138.

Although not shown, elastic straps extending between adjacent pouches may be omitted and replaced with two side sewn locations as shown in U.S. Pat. No. 9,211,999.

FIGS. 7A-7E illustrate a method of unloading product 5 from the pouches 130 of the container 10. This unloading method comprises the first step of unlocking the front lockable upper crossbar assembly 190 of the upper crossbar assemblies extending between the generally horizontally oriented upper portions 62 of generally U-shaped upper tracks 60 and moving it from its locked position shown in FIG. 6 into the connecting portions 66 of the generally U-shaped upper tracks 60 to a position shown in FIG. 7A. As shown in FIG. 7A, the elastic straps or space limiters 138 limit the distance the front wall of the front pouch may travel from the rear wall of the front pouch, thus presenting the front product 5 in a position in which an operator may quickly and easily remove the front product 5. As shown in FIG. 7A, the next step comprises removing the front product 5 (closest to the front of the container) out of the dunnage pouch 130 in the upper or top level of dunnage 126*a* in the direction of arrow 214.

As shown in FIG. 7A, when front upper lockable crossbar assembly 190 is located extending between the connecting portions 66 of the generally U-shaped upper tracks 60, and next crossbar assembly, which is an unlockable crossbar assembly 90*a*, is located extending between the generally horizontally oriented upper portions 62 of the generally U-shaped upper tracks 60, an operator may easily remove a product inside the front pouch 130 because the lockable crossbar assembly 190 is below the next crossbar assembly 90*a*.

As shown in FIG. 7B, this is also true as regards crossbar assemblies 90*a*, 90*b* when an operator is unloading a second product 5 from the upper layer of dunnage. This orientation of the crossbar assemblies 90*a*-90*k*, due to the configuration of the generally U-shaped upper tracks 60, helps an operator from an ergonomic standpoint, reducing the stress and strain on the body of the operator when unloading product from the upper layer or level of dunnage. Thus, the unique configuration of the upper generally U-shaped upper tracks 60 inside the container 10 may reduce the container owner's costs because workers or operators may have fewer injuries/days off due to injury.

As shown in FIG. 7B, the next step comprises moving crossbar assembly 90*a* (second from the front) from its position extending between the generally horizontally oriented upper portions 62 of the generally U-shaped upper tracks 60 (shown in FIG. 7A) into the connecting portions 66 of the generally U-shaped upper tracks 60. In addition, the front lockable crossbar assembly 190 is moved from its position shown in FIG. 7A extending between the connecting portions 66 of generally U-shaped tracks 60 to a position shown in FIG. 7B extending between the generally horizontally oriented lower portions 64 of the generally U-shaped upper tracks 60. During this step, the lockable front crossbar assembly 190 moves toward the rear of the container, the end members 166 of lockable crossbar assembly 190 moving along the generally horizontally oriented lower portions 64 of the generally U-shaped upper tracks 60.

Figure 7C:
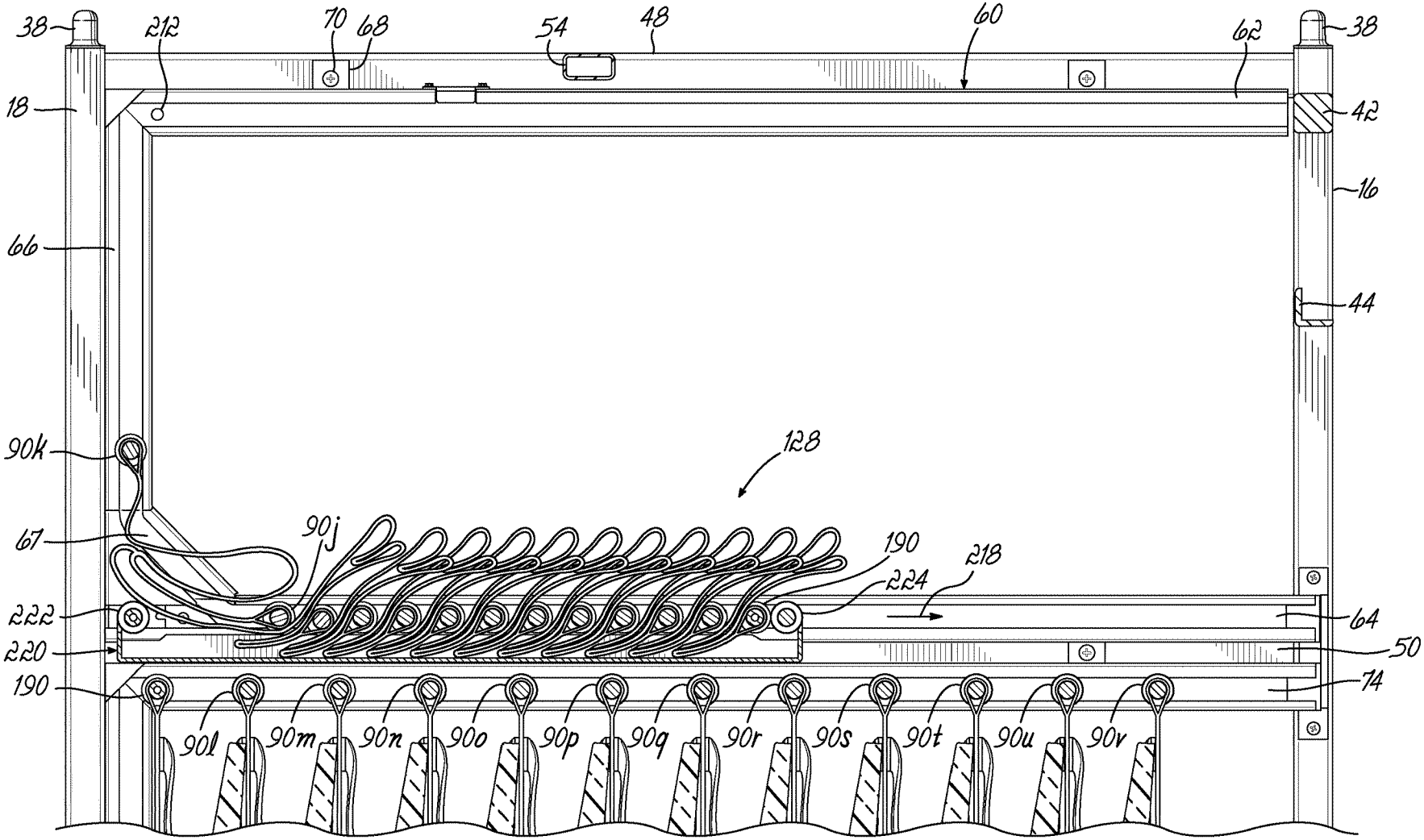
FIG. 7C is a cross-sectional view of a portion of the container of FIG. 1, showing the upper layer of dunnage being empty and resting on the movable shelf assembly.
Figure 7D:
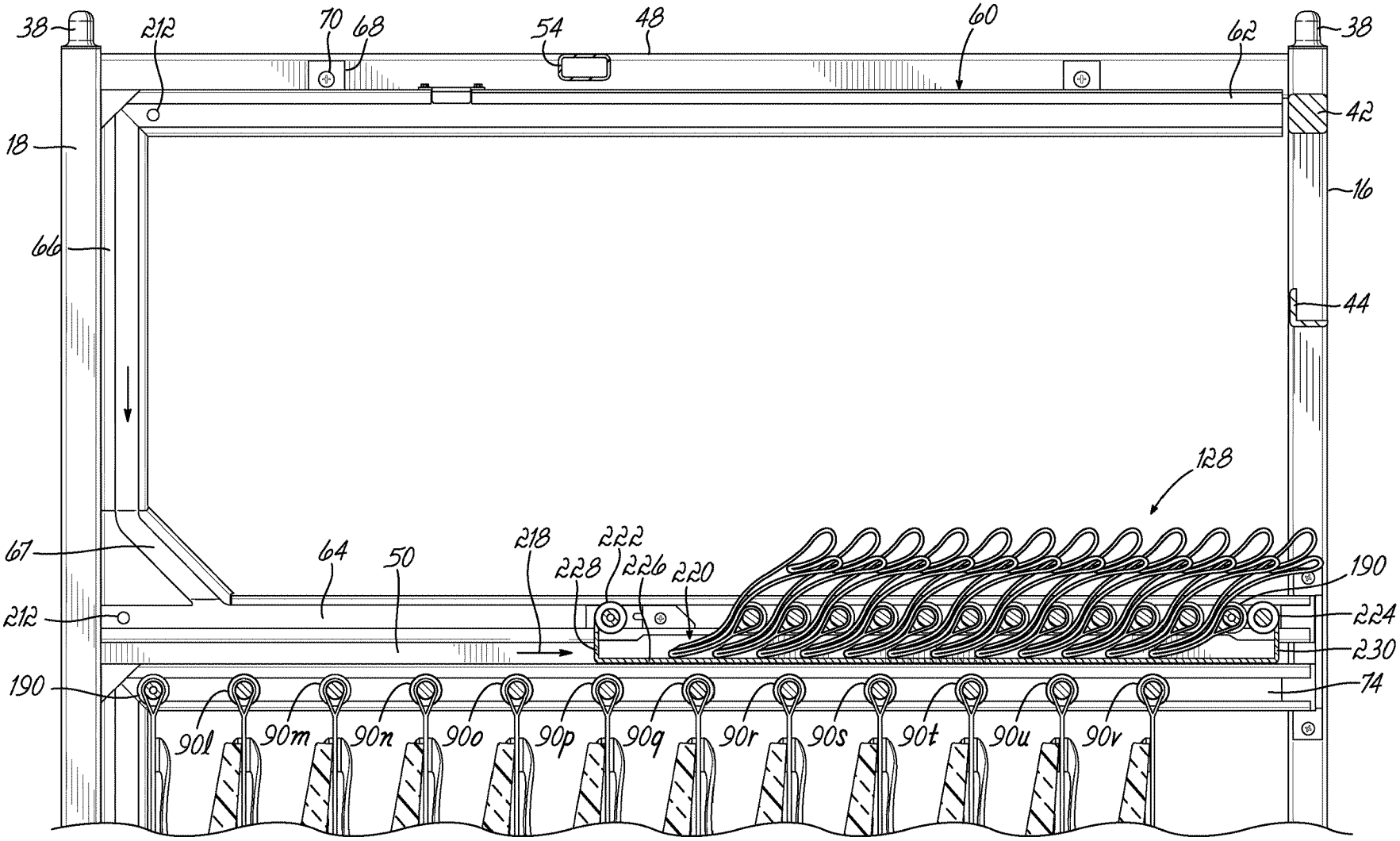
FIG. 7D is a cross-sectional view of a portion of the container of FIG. 1, showing the shelf assembly being moved rearwardly with the empty dunnage of the upper layer of dunnage on the shelf assembly.

As shown in FIG. 7B, the next step comprises removing another product 5 from the other pouch 130 of the upper or top level of dunnage 126*a* in the direction of arrow 216. Each time a product 5 is removed from a pouch 130 of the upper level of dunnage 126*a*, the upper crossbar assemblies and associated dunnage are moved along the generally U-shaped upper tracks 60 in a generally counter-clockwise direction, as shown in FIGS. 7A-7C. During this unloading process, the end members at the ends of the crossbar assemblies move along the generally U-shaped upper tracks 60, as shown in FIGS. 7A-7C.

Although the drawings show one front lockable crossbar assembly 190 followed by eleven unlockable upper crossbar assemblies 90*a*-90*k* supporting pouches 130, the container may be used with any number of lockable or unlockable upper crossbar assemblies and any number of pouches in the upper level of dunnage 126*a*. Similarly, although the drawings show one lower lockage crossbar assembly 190 and eleven lower crossbar assemblies 90*l*-90*v* supporting lower pouches 130, the container may be used with any number of lockable or unlockable lower crossbar assemblies and any number of pouches in the lower level of dunnage 126*b*. The amount of lockable/unlockable crossbar assemblies and pouches may be different in each level and need not be identical.

As shown in FIG. 7C, once all of the product 5 in the pouches 130 of the top level of dunnage 126*a* have been removed, the operator moves the upper crossbar assemblies 190, 90*a*-90*k* along with associated empty pouches 130 of the top level of dunnage 126*a* rearwardly along the generally horizontally oriented lower portions 64 of generally U-shaped upper tracks 60 in the direction shown by arrows 218 to a resting position on top of a movable shelf assembly 220.

Figure 5A:
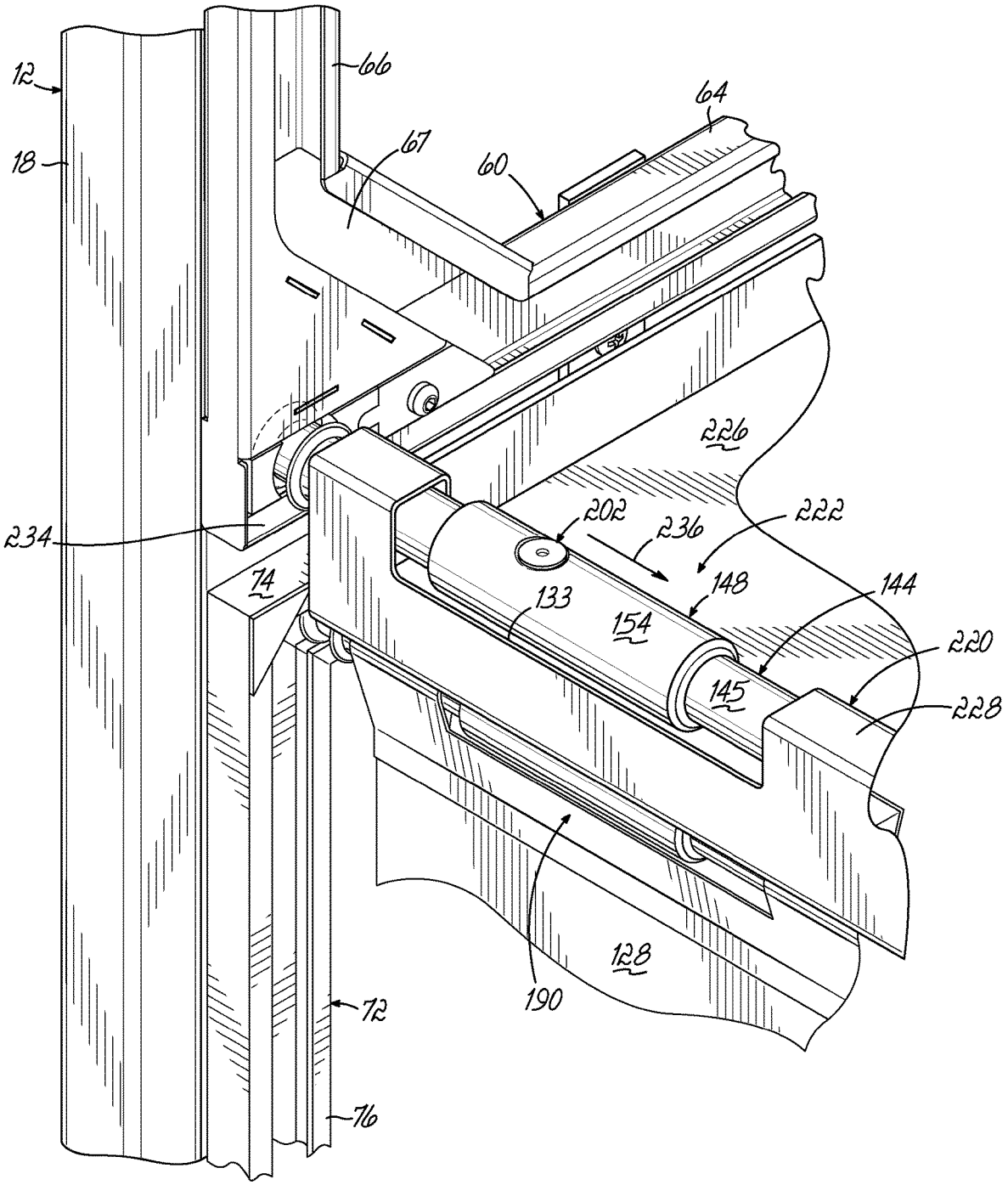
FIG. 5A is an enlarged view of encircled area 5A of FIG. 1.
Figure 5B:
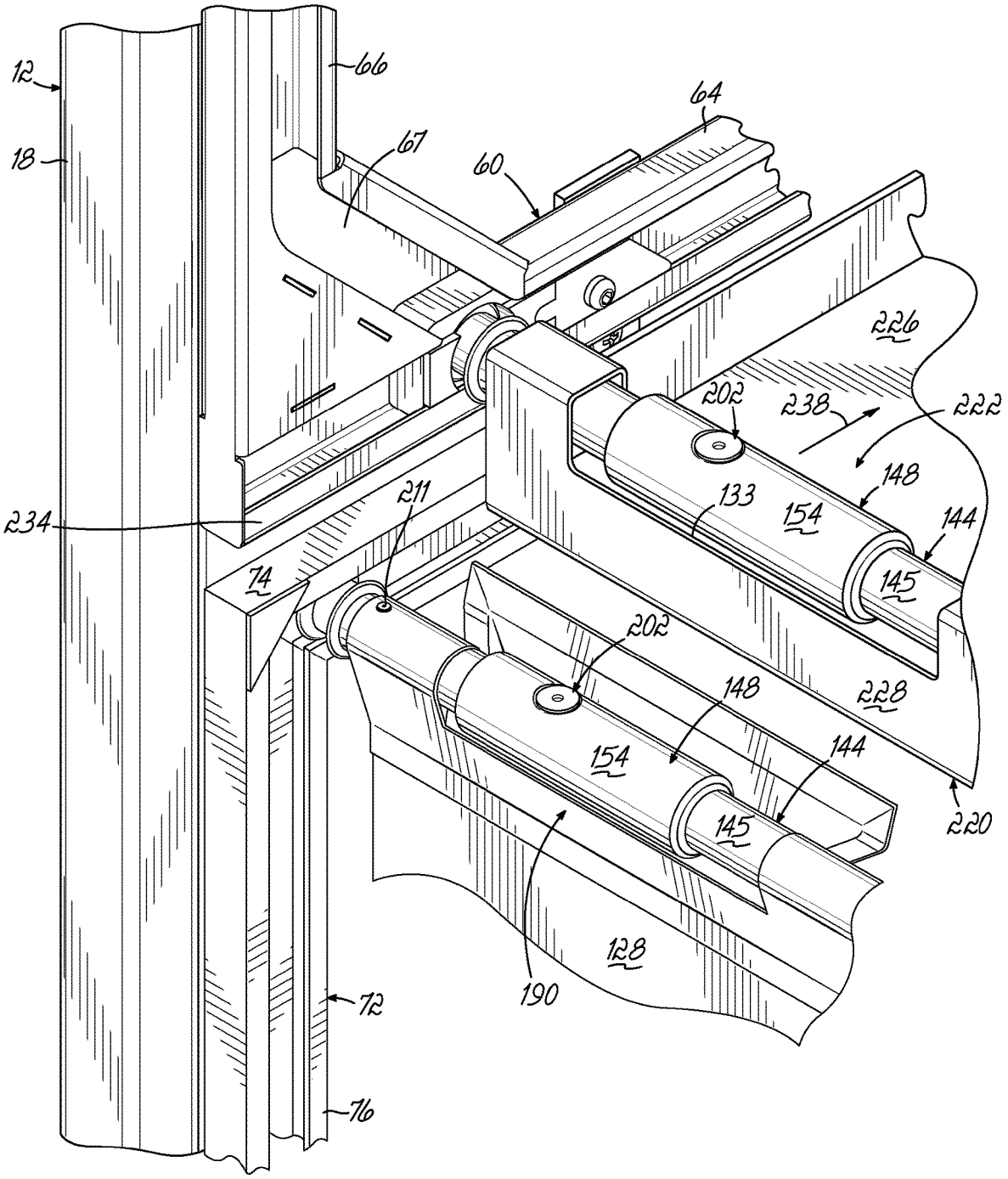
FIG. 5B is an enlarged view of a portion of the container of FIG. 1, showing the movable shelf assembly being pushed rearwardly.

As best shown in FIG. 1B, movable shelf assembly 220 comprises a front lockable shelf support 222, which is each identical to lockable crossbar assembly 190, and a rear unlockable shelf support 224, which is each identical to unlockable crossbar assembly 90. The movable shelf assembly 220 further comprises a middle shelf 226, including a hollow front portion 228 and hollow rear portion 230. As best shown in FIGS. 5A and 5B, the front lockable shelf support 222 resides inside the interior of the hollow front portion 228 of the movable shelf assembly 220. The hollow front portion 228 of the movable shelf assembly 220 has two cut-outs 133, one being shown in FIGS. 5A and 5B, which allow an operator access to the handles 148 of the front lockable shelf support 222.

As shown in FIG. 5A, the movable shelf assembly 220 extends between extensions 234 of the generally horizontally oriented lower portions 64 of generally U-shaped upper tracks 60, which enable the movable shelf assembly 220 to be locked or parked in place. After all the product 5 have been removed from the upper level of dunnage 126*a*, and the dunnage 126*a* is stored on top of movable shelf assembly 220, as shown in FIG. 7C, lockable crossbar assembly 190, which was originally the front crossbar assembly of upper crossbar assemblies, is now the rear crossbar assembly extending between the generally horizontally oriented lower portions 64 of the generally U-shaped upper tracks 60.

As shown in FIG. 5A, once all the crossbar assemblies extend between the generally horizontally oriented lower portions 64 of the generally U-shaped upper tracks 60 and the associated upper layer of dunnage is resting on the front piece of the movable shelf assembly 220, the handles 148 are pushed inwardly in the direction of arrows 236 to unlock the front lockable shelf support 222, such that the movable shelf assembly 220 may be pushed rearwardly in the direction of arrows 238, as shown in FIG. 5B.

Figure 7E:
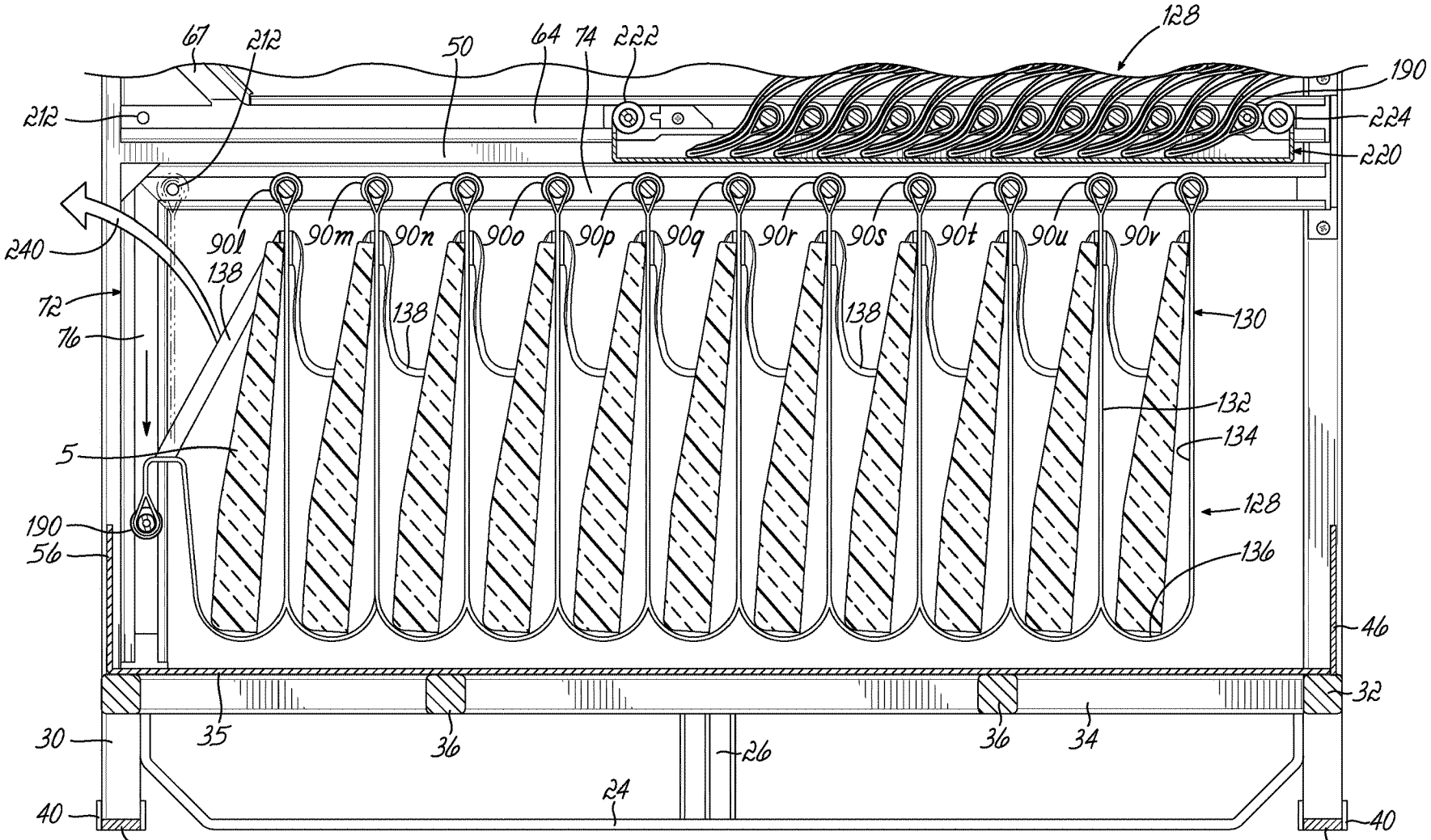
FIG. 7E is a cross-sectional view of a portion of the container of FIG. 1, showing the front product of the lower layer of dunnage being removed.

As shown in FIG. 7E, the process of unloading product 5 from container 10 is continued by an operator one level at a time moving downwardly. The unloading method comprises another step of moving the front crossbar assembly 190 of the crossbar assemblies extending between the generally horizontally oriented portions 74 of generally L-shaped lower tracks 72 from its position shown in FIG. 6 to a position extending between the generally vertically oriented portions 76 of the generally L-shaped lower tracks 72.

Figure 7F:
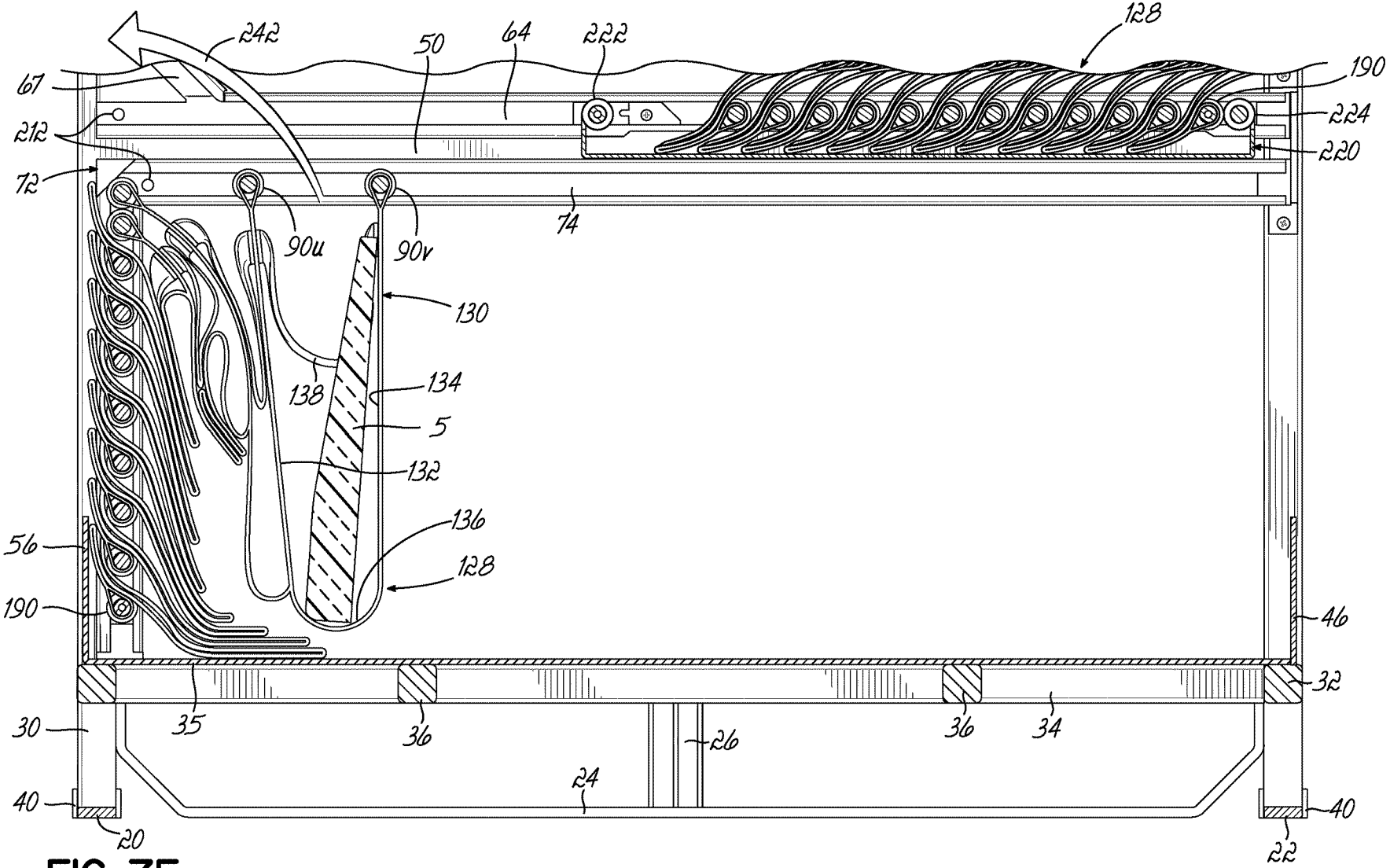
FIG. 7F is a cross-sectional view of a portion of the container of FIG. 1, showing the rear product of the lower layer of dunnage being removed.

As shown in FIG. 7E, the next step comprises removing the front product 5 (closest to the front of the container) out of the dunnage pouch 130 in the lower or bottom level of dunnage 126*b* in the direction of arrow 240. As shown in FIG. 7F, removing product from the lower level of dunnage occurs one product at a time until the last product 5 is removed from the rear pouch 130 of the bottom or lower level of dunnage 126*b* in the direction of arrow 242. When all of the product 5 of lower level 126*b* are removed, the container may be shipped to its desired destination. In the event the container has more than two levels, this process of removing product is repeated one layer or level at a time, each time all the product 5 is removed from the pouches 130 of a level, and each of the crossbar assemblies is pushed rearwardly to a rear portion of the container, creating open space for the operator to remove product from the next lowest level.

When the container 10 is empty, the empty container 10 still has the dunnage therein. The container 10 may then be shipped back to its original location or any desired location for loading the empty dunnage with product. During the unloading and loading processes, the upper and lower tracks 60, 72, respectively, remain stationary fixedly secured to the container 10. The crossbar assemblies, and dunnage hanging from the crossbar assemblies, move inside the container with the assistance of an operator during the loading and unloading processes.

Although one specific shape of product 5 is illustrated in the drawings, this document is not intended to limit in any way the size, shape or configuration of product 5 shipped or stored in any of the embodiments described or shown herein.

Figure 8:
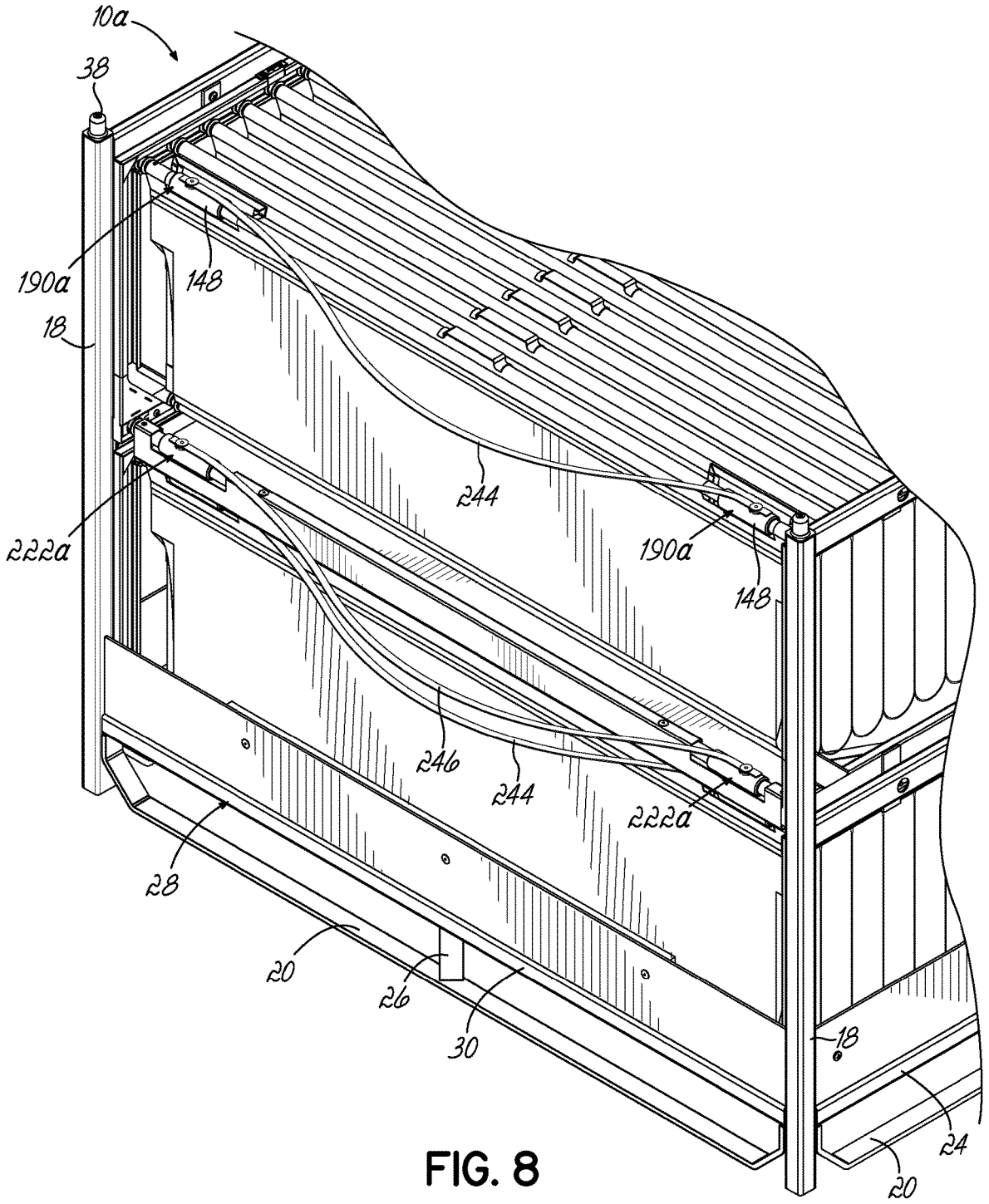
FIG. 8 is a perspective view of a portion of another embodiment of reusable and returnable container.

FIG. 8 illustrates an alternative embodiment of container 10*a*. Container 10*a* is identical to container 10, except for the details of the lockable crossbar assembly 190*a* and lockable shelf support 222*a*. Each lockable crossbar assembly 190*a* of reusable and returnable container 10*a*, as shown, comprises the same components as lockable crossbar assembly 190 described above. However, to move the two handles 148 of lockable crossbar assembly 190*a* towards each other and retract the locking pins 182, an operator need only pull on pull cord 244. The ends of the pull cord 244 are secured in any known manner to the rivets 202 of the lockable crossbar assembly 190*a*. Similarly, to moving the handles 148 of lockable shelf support 222*a* towards each other to retract the locking pins 182, an operator need only pull on pull cord 246 to retract the locking pins 182.

Figure 9:
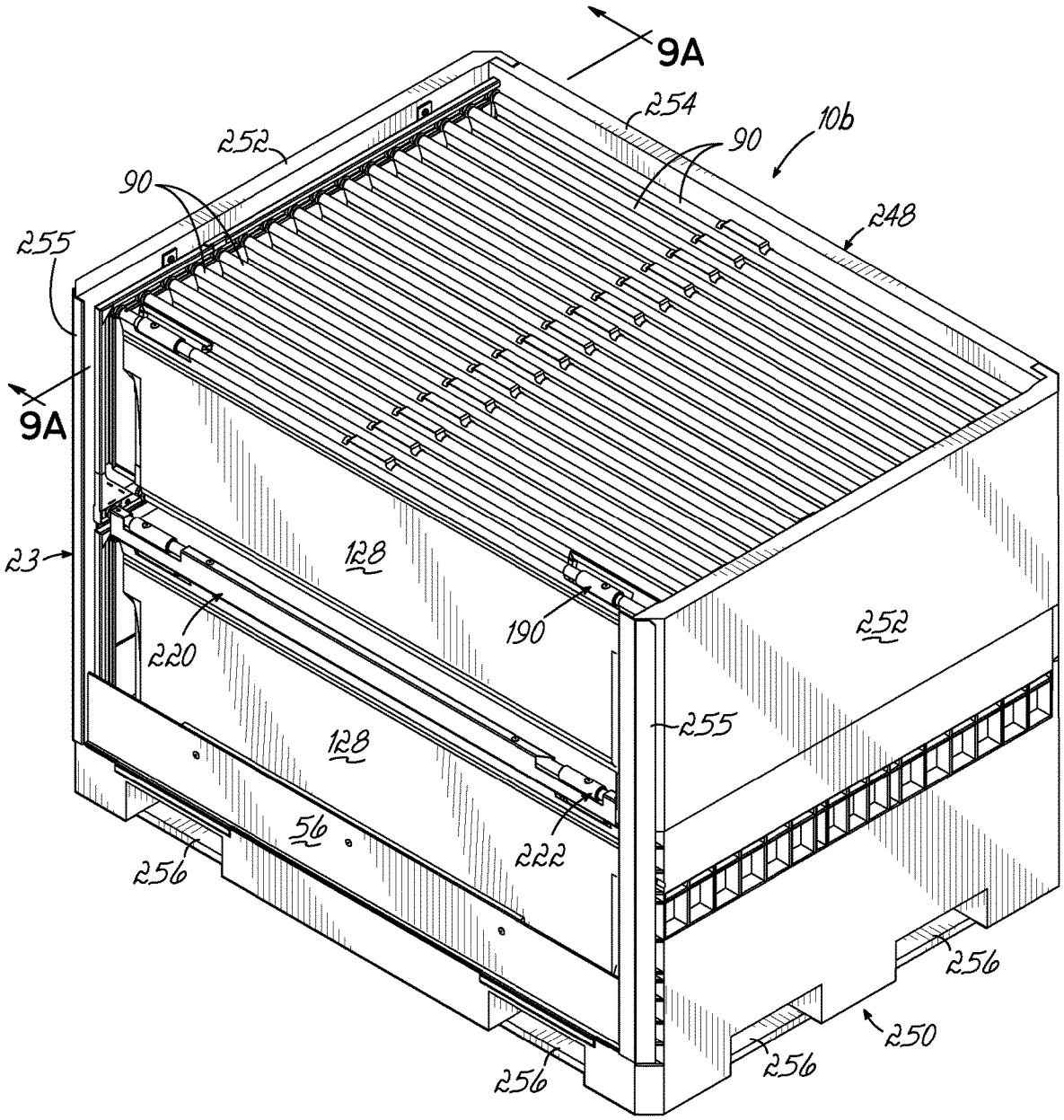
FIG. 9 is a perspective view of another embodiment of reusable and returnable container.
Figure 9A:
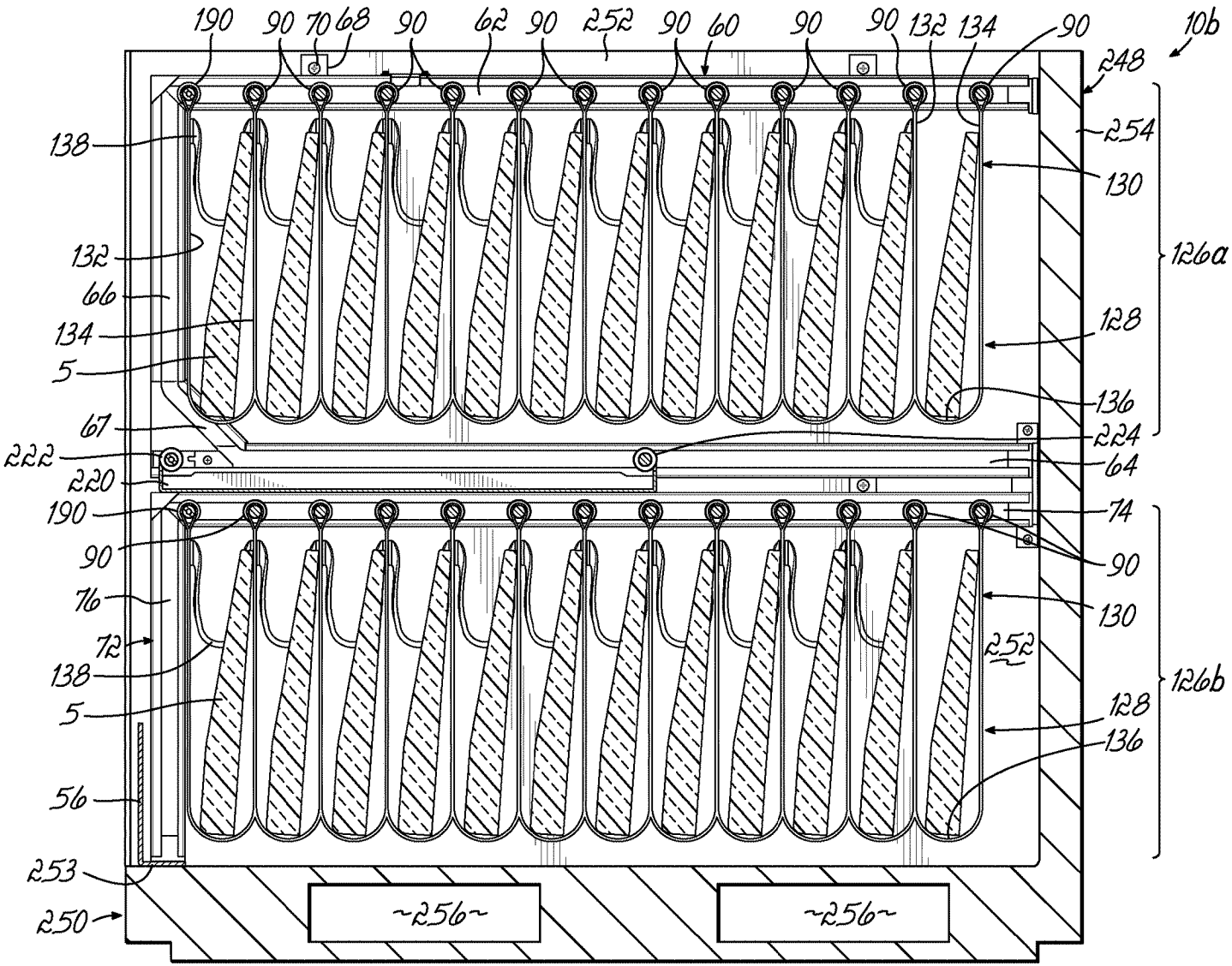
FIG. 9A is a cross-sectional view taken along the line 9A-9A of FIG. 9.

FIGS. 9 and 9A illustrate an alternative embodiment of container 10*b*. Container 10*b* is identical to container 10, except for the outside shell of the container. The reusable and returnable container 10*b*, as shown, comprises a body 248 having a base 250, opposed sides 252 and a rear 254, all extending upwardly from the base 250. The sides 252 and rear 254 may be hingedly secured to the base 250. The base 250 may have a plurality of passages 256 therethrough adapted to receive the prongs of a forklift for purposes of lifting and moving the container 10*b*. Although one configuration of body in the form of a pallet box is illustrated, the present invention may be used with other types or configurations of container bodies. All the remaining components of container 10*b* are identical to those of container 10. For simplicity, like parts have like numbers.

As seen in FIGS. 9 and 9A, a generally U-shaped front frame 23 may be fixedly secured to the body 248 of container 10*b*, including the sides 252 and base 250 and does not move relative to the sides 252 after the container is assembled. The front frame 23 may be made of metal or any other suitable material. As best shown in FIGS. 9 and 9A, the front frame 23 comprises a bottom 253, including a front brace 56 and side members 255 extending upwardly from the bottom 253. The front brace 56 extends between the side members 255 and is generally vertically oriented as shown in the drawings when the container 10*b* is upright. The frame bottom 253 may be fixedly secured to the base 250 of the container 10*b* with rivets or fasteners (not shown), while the side members 255 of the front frame 23 may be secured to the container sides 252 with additional fasteners (not shown). In some instances, the frame bottom may be omitted.

Figure 10:
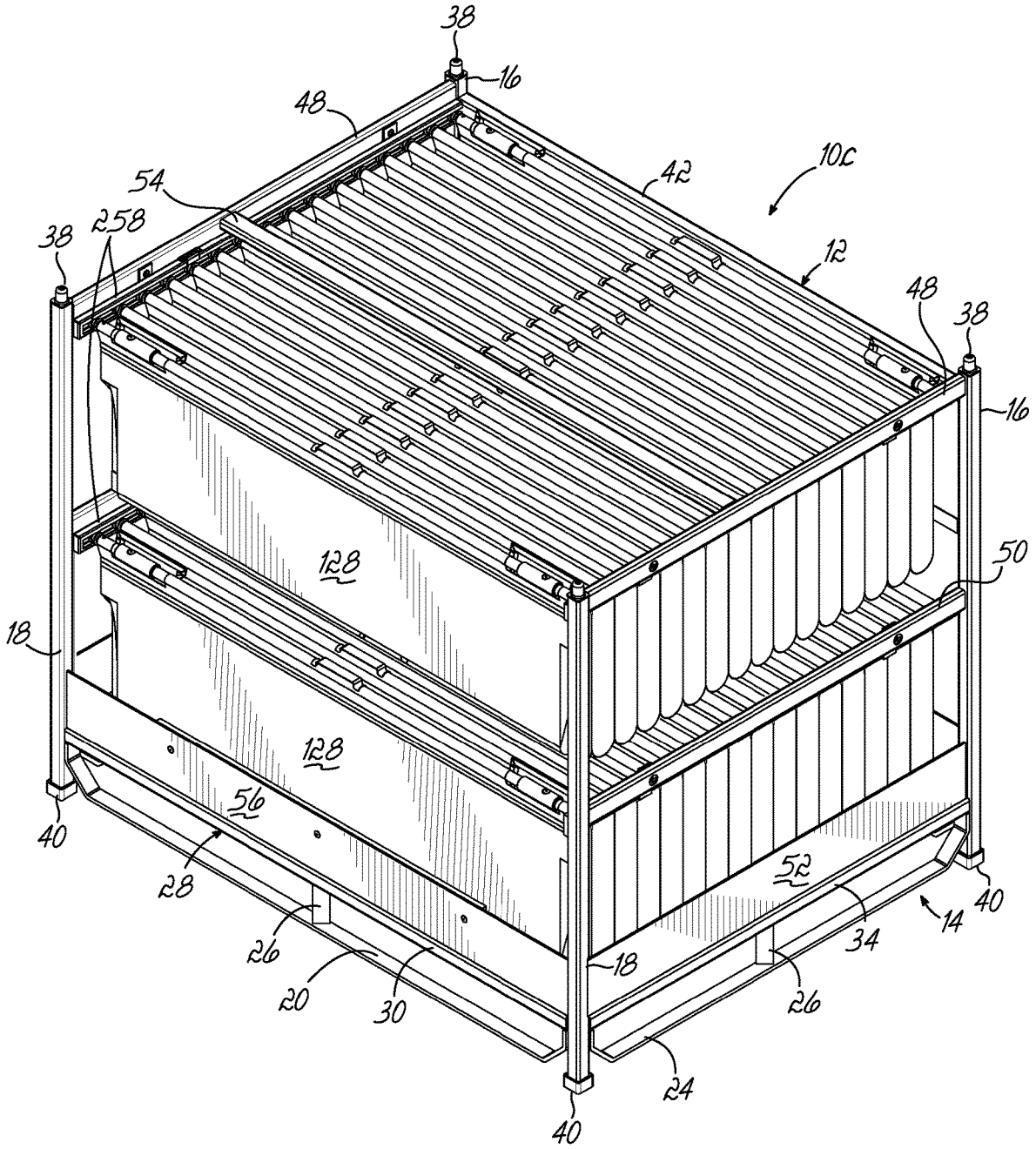
FIG. 10 is a perspective view of another embodiment of reusable and returnable container.
Figure 10A:
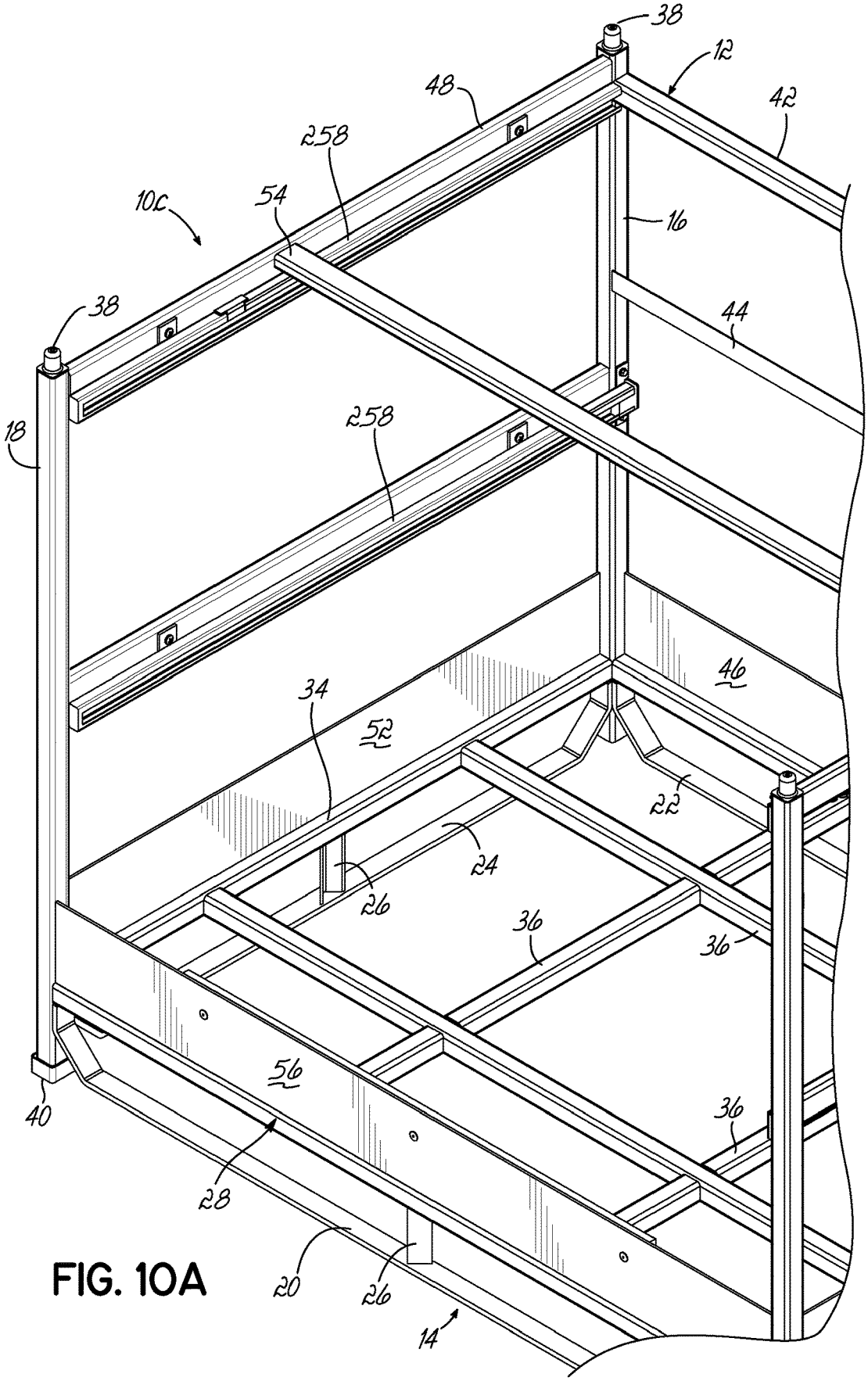
FIG. 10A is a perspective view of a portion of the frame of the container of FIG. 10 showing linear tracks, but not dunnage and crossbar assemblies.

FIGS. 10 and 10A illustrate an alternative embodiment of container 10*c*. Container 10*c* is similar to container 10, but has linear or straight tracks 258. The shelf assembly of container 10 may be omitted. For simplicity, like parts have like numbers. Although two straight tracks 258 per side are shown, the container may have any number of straight tracks per side. Any number of crossbar assemblies at any desired location(s) may be lockable or unlockable in any set of tracks.

Figure 10B:
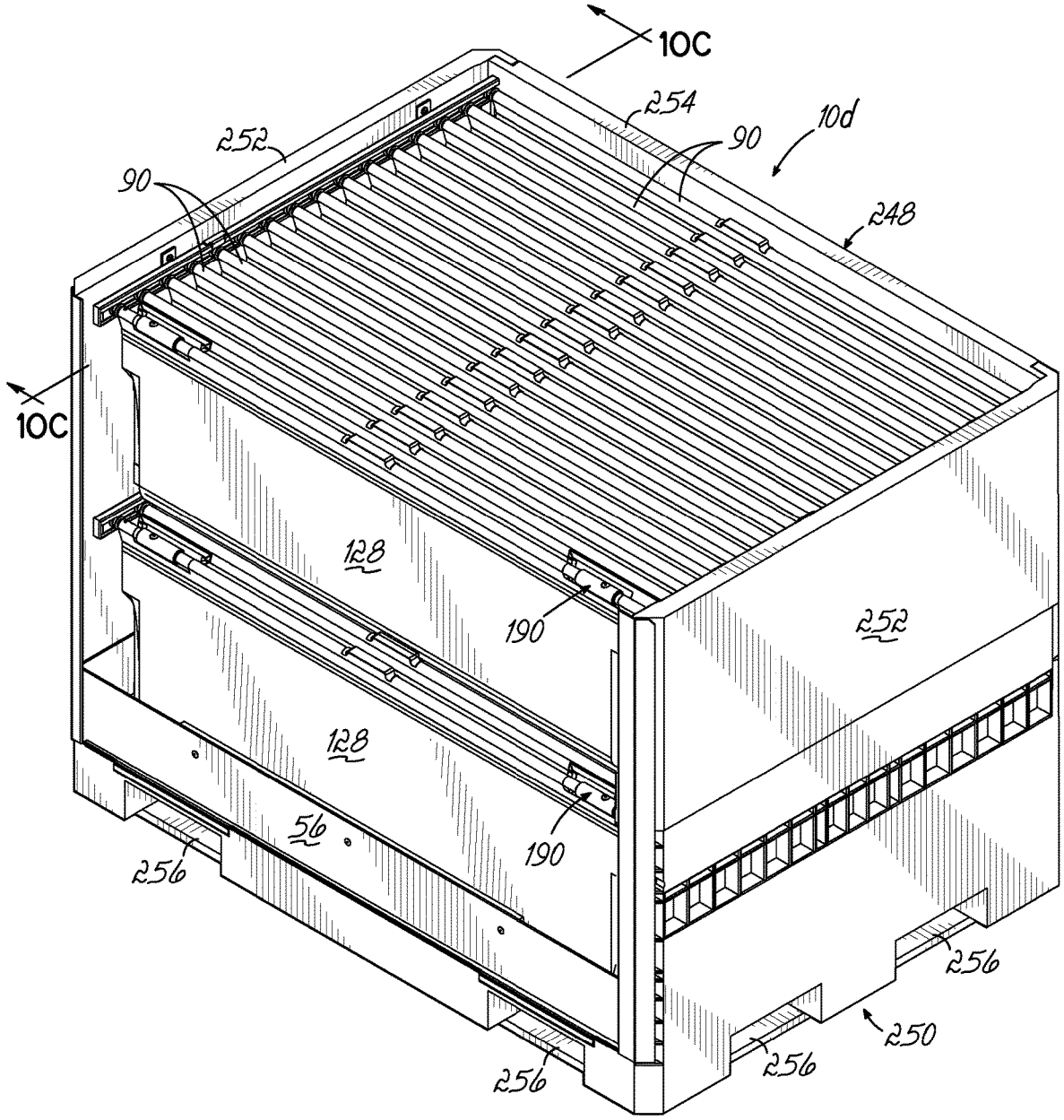
FIG. 10B is a perspective view of another embodiment of reusable and returnable container.
Figure 10C:
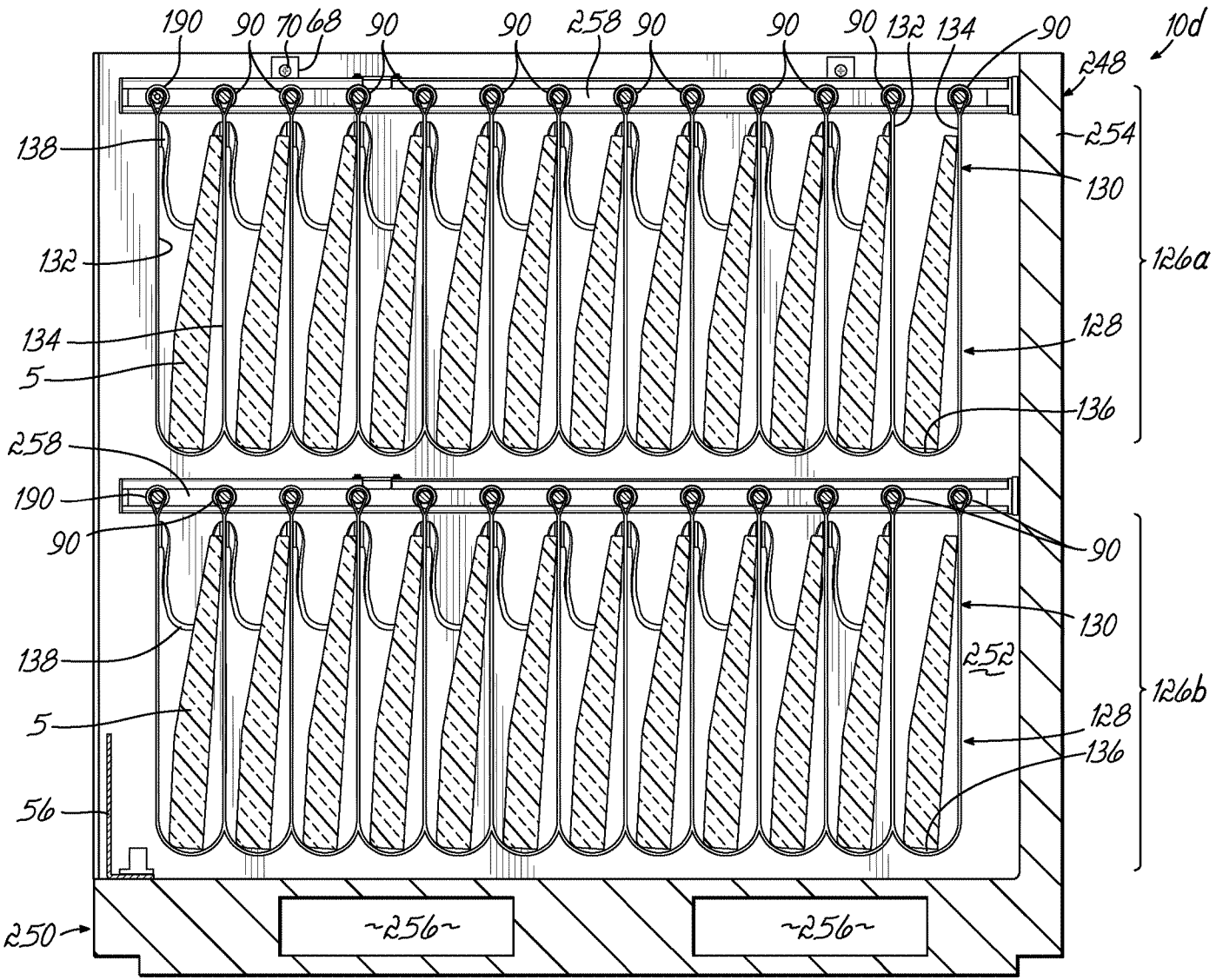
FIG. 10C is a cross-sectional view taken along the line 10C-10C of FIG. 10B.

FIGS. 10B and 10C illustrate an alternative embodiment of container 10*d*. Container 10*d* is identical to container 10*b* shown in FIGS. 9 and 9A, except for the tracks of the container. The reusable and returnable container 10*d*, as best shown in FIG. 10C, comprises linear or straight upper and lower tracks 258. The shelf assembly of container 10 may be omitted. For simplicity, like parts have like numbers. Although two straight tracks per side are shown, the container may have any number of straight tracks per side. Any number of crossbar assemblies at any desired location(s) may be lockable or unlockable and extend between any set of tracks at the same level.

Figure 11:
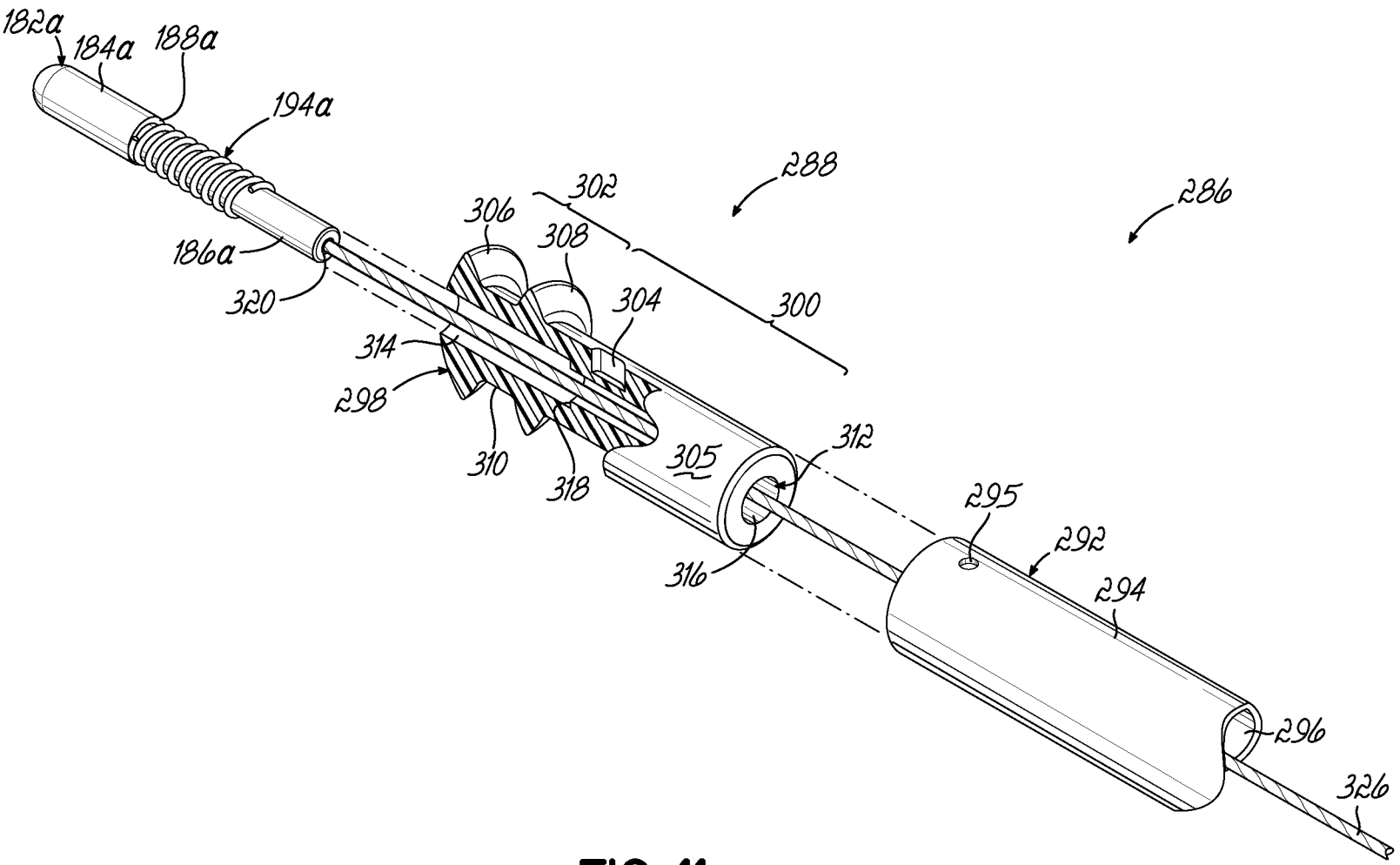
FIG. 11 is a partially disassembled view of a portion of another version of lockable crossbar assembly.
Figure 12A:
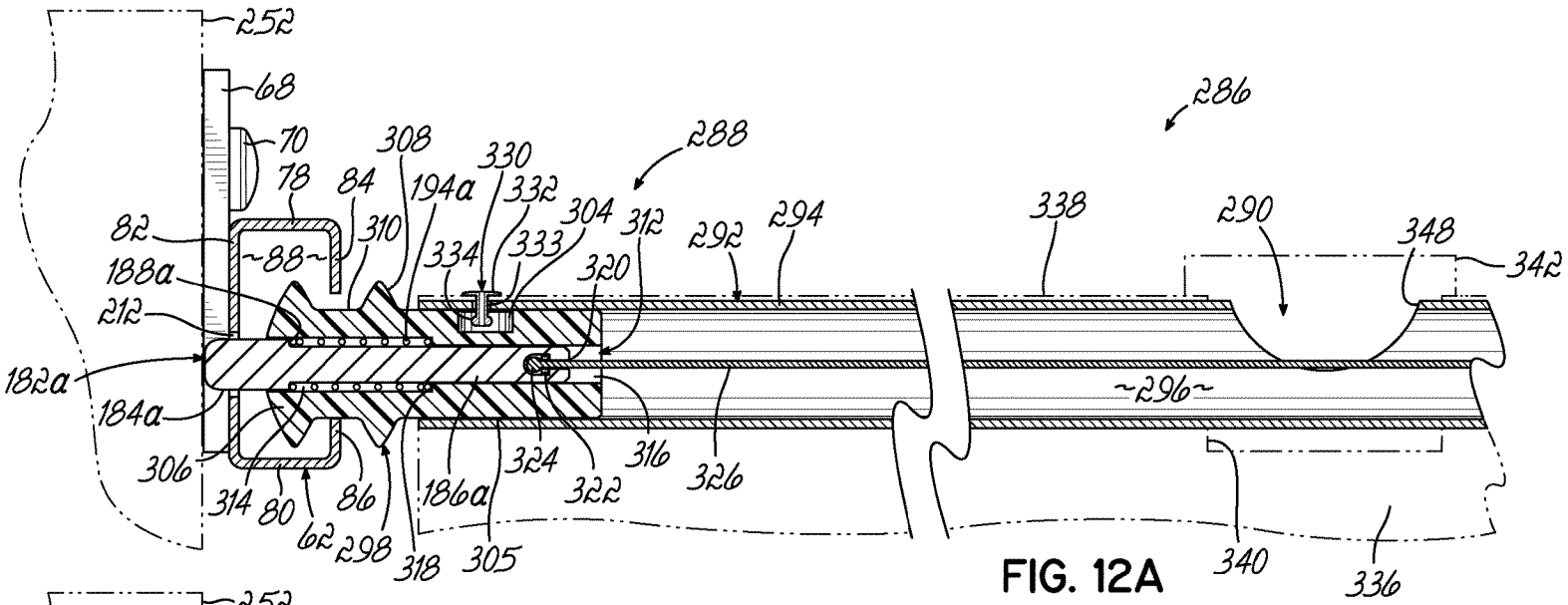
FIG. 12A is a cross-sectional view taken of a portion of the lockable crossbar assembly of FIG. 11 locked in a desired position.
Figure 12B:
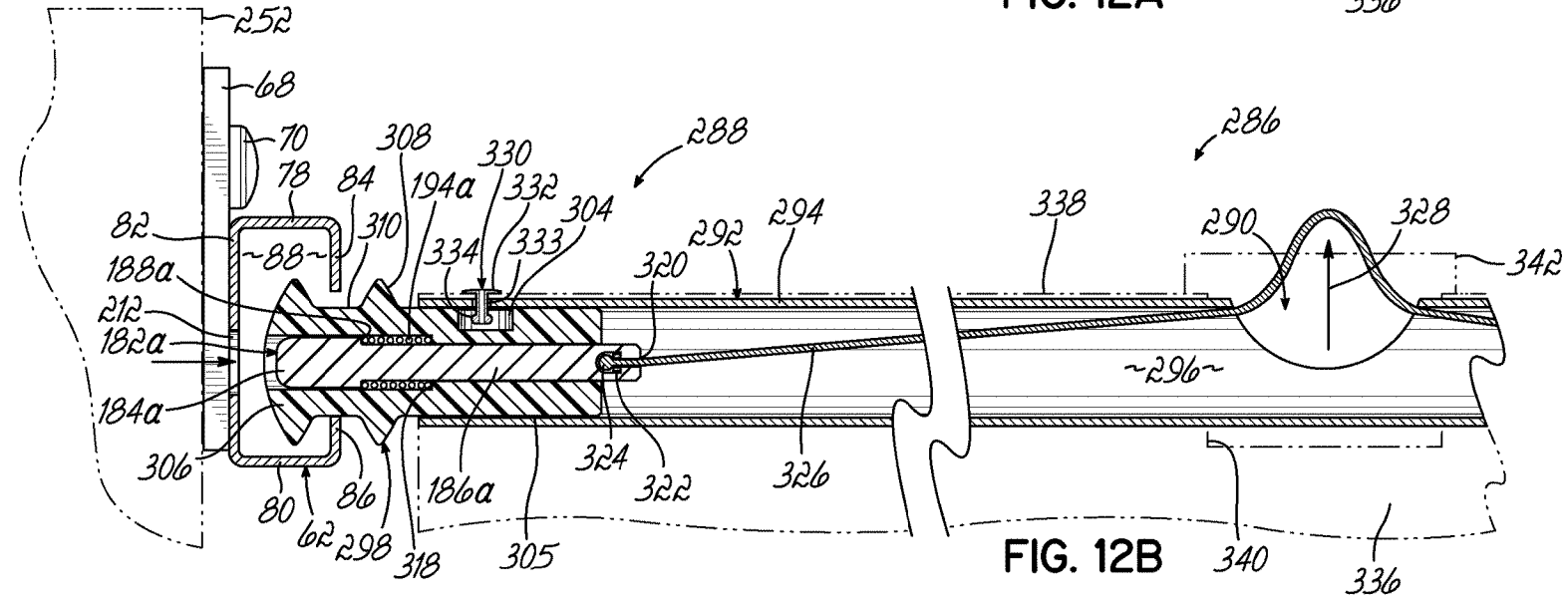
FIG. 12B is a cross-sectional view taken of a portion of the lockable crossbar assembly of FIG. 11, showing one of the locking pins being retracted out of engagement with one of the openings in one of the tracks.

FIGS. 11, 12A and 12B illustrate a portion of an alternative lockable crossbar assembly 286 which may be used in any embodiment of container shown or described herein. For simplicity, like parts have like numbers. Each lockable crossbar assembly 286 has two locking assemblies 288 between which is a crossbar 292. FIGS. 11, 12A and 12B illustrate the components and operation of one of the locking assemblies 288 of one of the lockable crossbar assemblies 286. Although FIGS. 11-23B show different lockable crossbar assemblies lockable relative to a generally horizontally oriented upper portion 62 of a generally U-shaped upper track 60, any of the lockable crossbar assemblies may be used in any of tracks or portions thereof shown or described herein.

As shown in FIG. 11, each lockable crossbar assembly 286 has a crossbar 292 having an outer wall 294 defining a hollow interior 296. As shown in FIGS. 12A and 12B, the outer wall 294 of the crossbar 292 has at least one opening 290 (only one opening 290 being shown) created by removal of a portion of the outer wall 294 of the crossbar 292. The opening (or openings) 290 allows access to the cord 326 extending through the hollow interior 296 of the crossbar 292. The opening (or openings) 290 may be any desired shape(s) and be at any desired location(s). The drawings are not intended to be limiting. At each end, crossbar 292 has an opening 295 which permits a fastener 330 to hold the dunnage in place and secure the crossbar 292 to one of the end members 298. The crossbar 292 is preferably made of metal, but may be made of other suitable material, such as plastic. In some applications, the openings 295 may be omitted and a portion of the crossbar 292 indented into a recess of each end member to secure the crossbar to the end members. In such applications, the dunnage may not be fixed to the crossbar 292.

As best shown in FIG. 11, each locking assembly 288 of lockable crossbar assembly 286 further comprises an end member 298 having two spaced heads 306, 308. Each end member 298 is a unitary member, preferably made of injection molded plastic, such as nylon, but may be made of any other material.

As shown in FIG. 11, each end member 298 has an inner portion 300 and an outer portion 302. The inner portion 300 has a recess 304 extending inwardly from an outer surface 305 of the inner portion 300. The outer portion 302 of end member 298 has spaced outer and inner heads 306, 308, respectively, at the end of the end member 298. Outer head 306 is furthest from the inner portion 300 of the end member 298, and inner head 308 is spaced inwardly from outer head 306. The outer and inner heads 306, 308, respectively, are spaced from one another to define a groove 310 therebetween which receives and retains the upper and lower lips 84, 86, respectively, of a generally U-shaped upper track 60 or any other track disclosed or shown herein.

As shown in FIGS. 12A and 12B, outer head 306 is located inside the interior 88 of generally horizontally oriented upper portion 62 of each generally U-shaped track 60, and inner head 308 is located outside the interior 88 of generally horizontally oriented upper portion 62 of each generally U-shaped upper track 60. Outer head 306 keeps the end member 298 engaged with the track, while inner head 308 keeps the dunnage material out of the interior 48 of the track, thereby ensuring that the end members 298 may move smoothly along the generally U-shaped upper tracks 60 or any other track disclosed or shown herein.

As shown in FIGS. 11, 12A and 12B, each end member 298 has an internal passage 312 extending through the interior of the end member 298. The internal passage 312 has an outer portion 314 of a first diameter and an inner portion 316 of a second diameter, the first diameter being larger than the second diameter. A shoulder 318 exists at the junction of the outer and inner portions 314, 316 of internal passage 312 of end member 298.

As best shown in FIG. 11, each locking assembly 288 of each lockable crossbar assembly 286 further comprises a locking pin 182*a*. Locking pin 182*a* is similar to locking pin 182 described above and shown in detail in FIG. 3, but with one difference. Locking pin 182*a* lacks an opening through the inner portion of the locking pin, but rather has a bore 320 extending inwardly from an inner end of the locking pin 182*a* and terminating at a cavity 322 for securing one end 324 of a cord 326. See FIGS. 12A and 12B. Locking pin 182*a* has an outer portion 184*a* and an inner portion 186*a*, the diameter of the outer portion 184*a* being larger than the diameter of the inner portion 186*a*, thereby creating a shoulder 188*a*. A spring 194*a* surrounds the inner portion 186*a* of locking pin 182*a*. One end of spring 194*a* abuts the shoulder 188*a* of locking pin 182*a* such that inward movement of the locking pin 182*a* by an operator manipulating cord 326 causes compression of the spring 194*a*.

As shown in FIGS. 11, 12A and 12B, upon assembly, each end 324 of flexible cord 326 is secured inside cavity 322 after passing through bore 320 of a locking pin 182*a* (only one being shown). The flexible cord 326 extends through a portion of the internal passage 312 of each end member 298 (only one being shown) and through the hollow interior 296 of crossbar 292.

As best shown in FIGS. 12A and 12B, upon assembly, the locking pin 182*a* and spring 194*a* extend into the internal passage 312 extending through the end member 298. The outer portion 184*a* of locking pin 182*a* and spring 194*a* fit inside the outer portion 314 of internal passage 312 of end member 298, as shown in FIG. 12A. The inner portion 186*a* of locking pin 186*a* fits inside the inner portion 316 of internal passage 312 of end member 298, as shown in FIG. 12A. The spring 194*a* is shown in a relaxed position in FIG. 12A extending between the shoulder 318 of internal passage 312 of end member 298 and shoulder 188*a* of locking pin 182*a*. In FIG. 12B, the spring 194*a* is shown in a compressed position between the shoulder 188*a* of the locking pin 182*a* and the shoulder 318 of internal passage 312 of end member 298. As the locking pin 182*a* moves inwardly towards the center of the lockable crossbar assembly 286 by a user pulling the flexible cord 326 upwardly as shown by arrow 328 in FIG. 12B, thereby shorting the distance of the flexible cord 326 between the two locking pins 182*a* of lockable crossbar assembly 286, the spring 194*a* is compressed between shoulder 188*a* of the locking pin 182*a* and shoulder 318 of internal passage 312 of end member 298. When an operator lets go of the cord 326, the spring 194*a* biases or forces the locking pin 182*a* outwardly (to the left as shown in FIGS. 12A and 12B) to an extended locked position. The shortening of the distance between ends of the cord 326 retracts the locking pins 182*a* of both movable locking assemblies 288 of each lockable crossbar assembly 286.

As shown in FIGS. 12A and 12B, a fabric pocket 338 surrounding each lockable crossbar assembly 286 has at least one cut-out 340 (only one being shown) to allow access to the opening 290 (and cord 326 inside) of crossbar 292. Each cut-out 340 may be covered with a flap 342 to keep rain, snow, debris and other unwanted objects out of the hollow interior 296 of crossbar 292. Each flap 342 may be secured over the opening 290 of crossbar 292 with hook and loop fasteners or any other known closing means or mechanism. See FIG. 2. However, if desired, the flap(s) may be omitted. Flaps 342 may be used to cover any of the dunnage cut-outs and/or crossbar openings disclosed in any of the embodiments shown or described herein.

As best shown in FIGS. 12A and 12B, upon assembly, a fastener 330, such as a rivet, for example, joins end member 298, crossbar 292 and fabric pocket 338 of dunnage 336 surrounding the crossbar 292. Fastener 330 has a generally planar upper portion 332 which resides outside the outer wall 294 of the crossbar 292 and outside the fabric pocket 338 of the dunnage 336 upon assembly. Fastener 330 further comprises a neck 333 extending through the opening 295 in the crossbar 292. See FIG. 11. Fastener 330 further comprises a lower portion 334 which travels in the recess 304 of end member 298, allowing some relative movement between the end member 298 and crossbar 292. Such allowance for relative movement prevents the lockable crossbar assembly 286 from becoming jammed in an undesirable position inside a container between tracks. In place of a fastener 330, a portion of the outer wall 294 of crossbar 292 may be deformed into the recess 304 of end member 298.

Figure 12C:
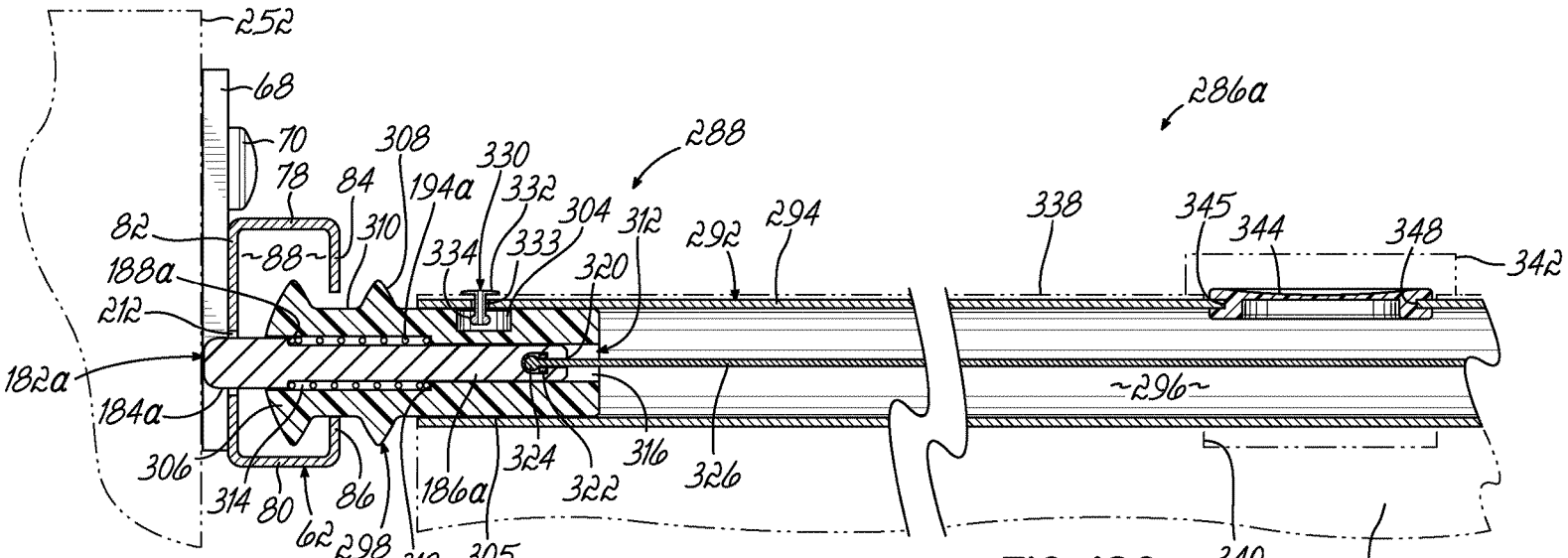
FIG. 12C is a cross-sectional view taken of a portion of another lockable crossbar assembly locked in a desired position.
Figure 12D:
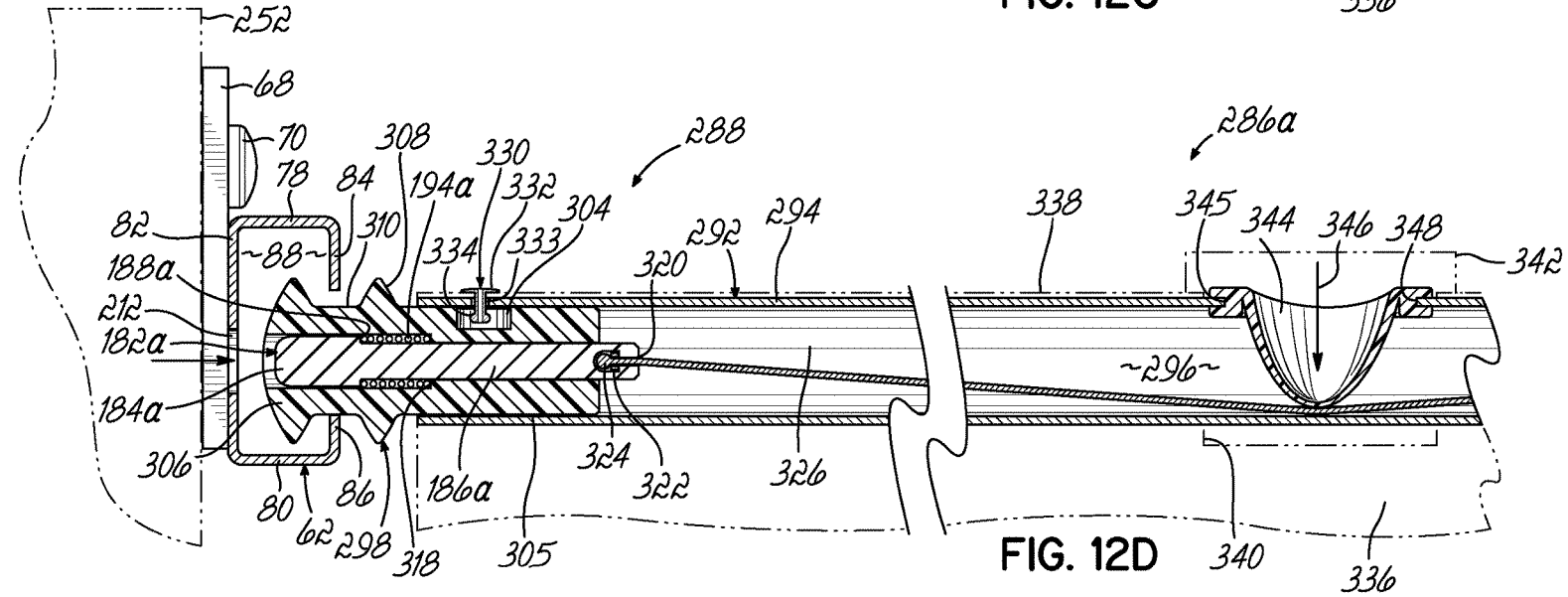
FIG. 12D is a cross-sectional view taken of a portion of the lockable crossbar assembly of FIG. 12C; showing one of the locking pins being retracted out of engagement with one of the openings in one of the tracks.

FIGS. 12C and 12D illustrate another version of lockable crossbar assembly 286*a* which may be used in any of the containers shown or described herein. Lockable crossbar assembly 286*a* is identical to lockable crossbar assembly 286, but has at least one additional component, at least one flexible cover 344. As shown in FIGS. 12C and 12D, a flexible cover 344 covers each opening 290 (only one being shown) of crossbar 292 to prevent access to the interior 296 of crossbar 292. Each flexible cover 344 has a groove 345 around its perimeter inside which is an edge 348 of the opening 290 of crossbar 292. In order to shorten the distance between ends 324 of cord 326 and move locking pins 182*a* inwardly towards each other out of a locked position, an operator need simply push down on flexible cover(s) 344 to move the cord 326 downwardly, as shown in FIG. 12D. Downward movement of cover(s) 344 in the direction of arrow 346 shortens the distance between the ends 324 of cord 326, thereby moving the locking pins 182*a* (only one being shown) towards each other to enable movement of the lockable crossbar assembly 286*a*. Flexible covers 344 may be used to cover any crossbar opening in any version of lockable crossbar assembly having at least one opening shown or described herein.

In operation, shortening the distance between ends 324 of cord 326 by an operator causes inward movement of the ends 324 of cord 326, which causes inward movement of the locking pins 182*a* against the outward bias of springs 194*a*. The locking pins 182*a* move towards each other and move relative to the crossbar 292 and end members 298. As shown in FIGS. 12A and 12B, movement of the cord 326 by an operator causes the locking pins 182*a* to move from extended locked positions extending through openings 212 in side walls 82 of the generally horizontally oriented upper portions 62 of the generally U-shaped upper tracks 60. Although one locking assembly 288 (left side) of the lockable crossbar assembly 286 is shown in FIGS. 12A and 12B, the right side is a mirror image. To unlock the lockable crossbar assembly 286 from a locked position shown in FIG. 12A to an unlocked position shown in FIG. 12B, an operator must shorten the length of the cord 326 extending between the locking pins 182*a* of the locking assemblies 288. Shortening this distance moves the locking pins 182*a* inwardly towards each other, compressing the spring 194*a* of each locking assembly 288 and moving each locking pin 182*a* of each locking assembly 288 out of opening 212 of the generally horizontally oriented upper portion 62 of the generally U-shaped upper track 60. Once the locking pins 182*a* are in their unlocked positions as shown in FIG. 12B, an operator is free to move the lockable crossbar assembly 286, 286*a* to its desired position, including another position in the tracks. Such an operation may be used in any of the tracks shown or described herein and with any of the embodiments of container shown or described herein.

Figure 13A:
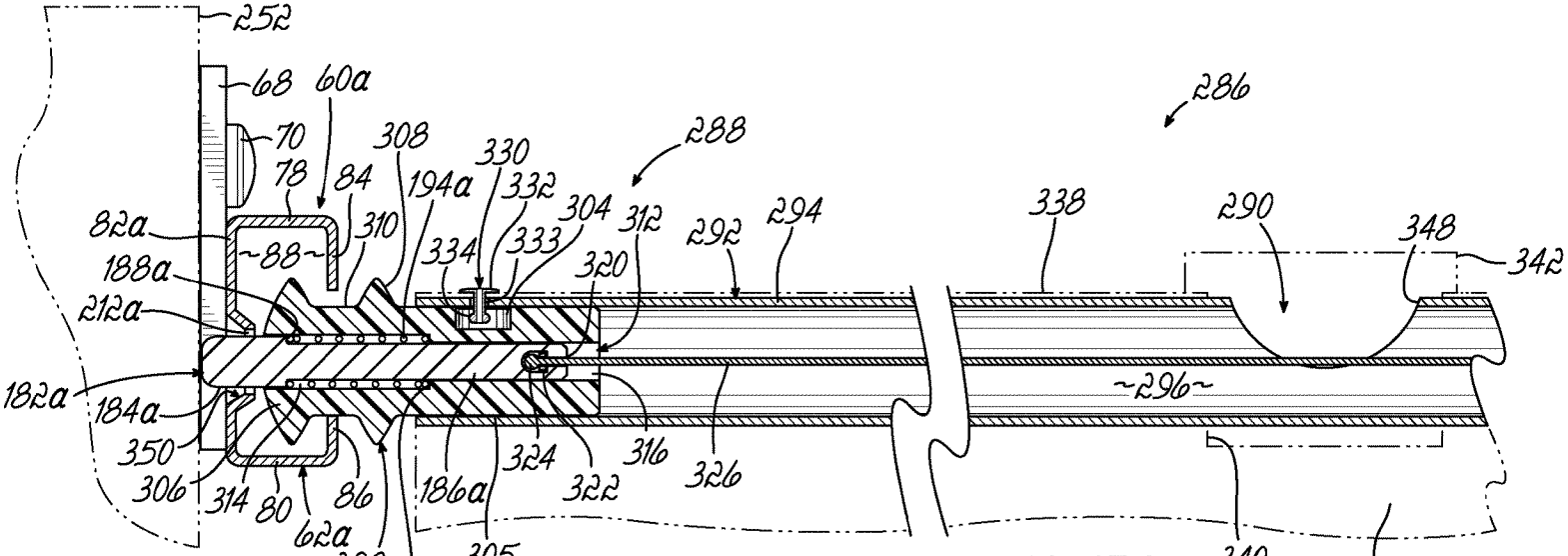
FIG. 13A is a cross-sectional view taken of a portion of the lockable crossbar assembly of FIG. 11 being locked in a desired position in a different track.
Figure 13B:
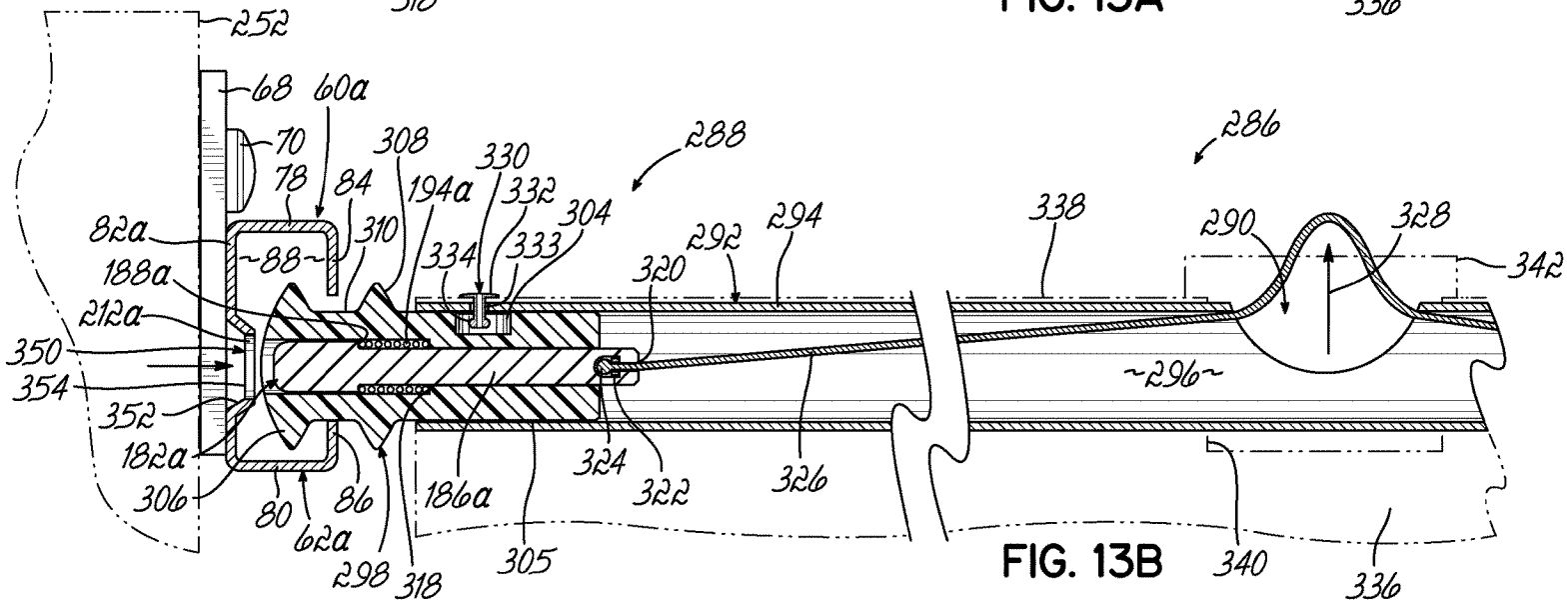
FIG. 13B is a cross-sectional view taken of a portion of the lockable crossbar assembly of FIG. 11, showing one of the locking pins being retracted out of engagement with the opening in the track shown in FIG. 13A.

FIGS. 13A and 13B illustrate views similar to FIGS. 12A and 12B with the same lockable crossbar assembly 286, including the same locking assemblies 288. However, the generally horizontally oriented upper portion 62*a* of the generally "U-shaped" upper track 60*a* is different than the generally horizontally oriented upper portion 62 of the generally "U-shaped" upper track 60 described above and illustrated herein. The same may be true of any portion of the generally "U-shaped" upper track 60.

Rather than being generally planar, the side wall 82*a* of the generally horizontally oriented upper portion 62*a* of the generally "U-shaped" upper track 60*a* has a track indentation 350, which increases the distance between the track opening 212*a* and the inside surface of the container side wall 252, thereby eliminating the need for a cavity in the container side wall 252. More particularly, the track indentation 350 comprises upper and lower slanted portions 352 joined by an inner portion 354 of side wall 82*a*, the opening 212*a* extending through the inner portion 354 of track side wall 82*a*. See FIG. 13B. Such a configuration of the track side wall 82*a* of the generally horizontally oriented upper portion 62*a* of the generally "U-shaped" upper track 60*a* provides greater distance for the locking pin 182*a* to travel between engaged and disengaged positions shown in FIGS. 13A and 13E, respectively. Although shown only in FIGS. 13A and 13B, this configuration or shape of track/track indentation 350 may be used in any embodiment of track shown or described herein and in any container shown or described herein and with any lockable or unlockable crossbar assembly or combination thereof.

Figure 14A:
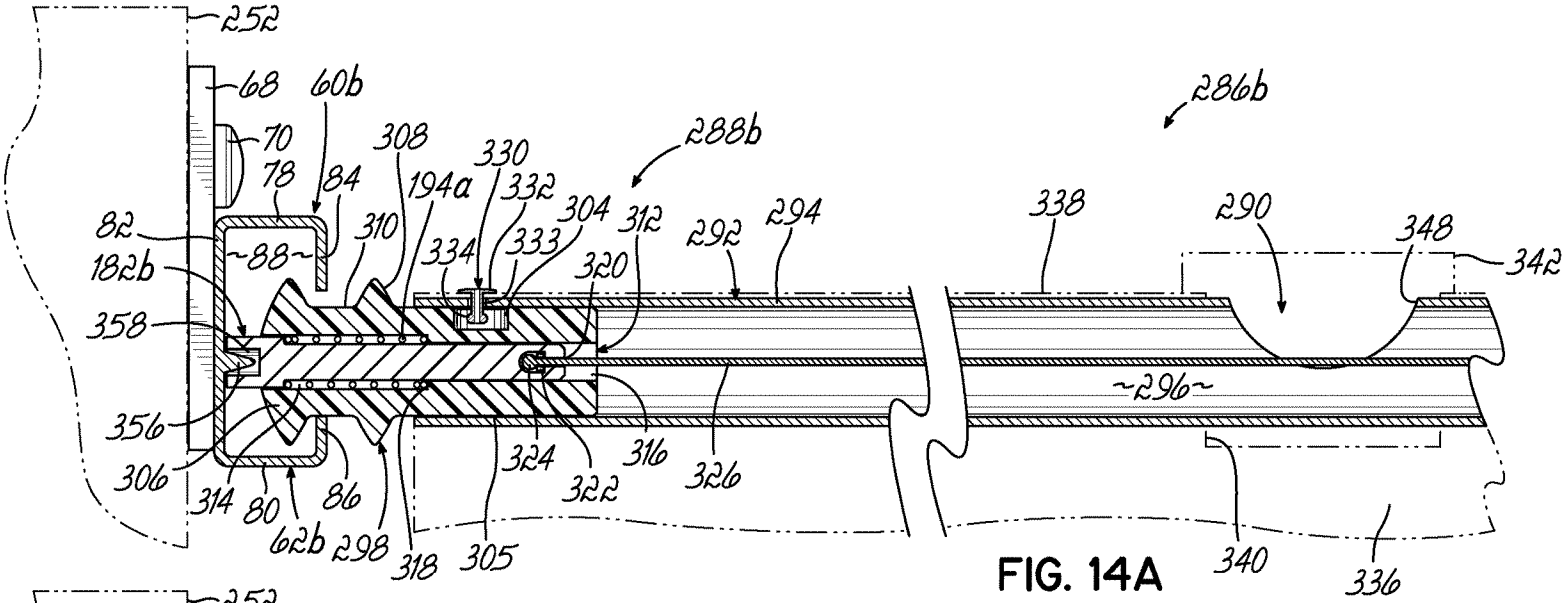
FIG. 14A is a cross-sectional view of a portion of another version of lockable crossbar assembly and another version of track.
Figure 14B:
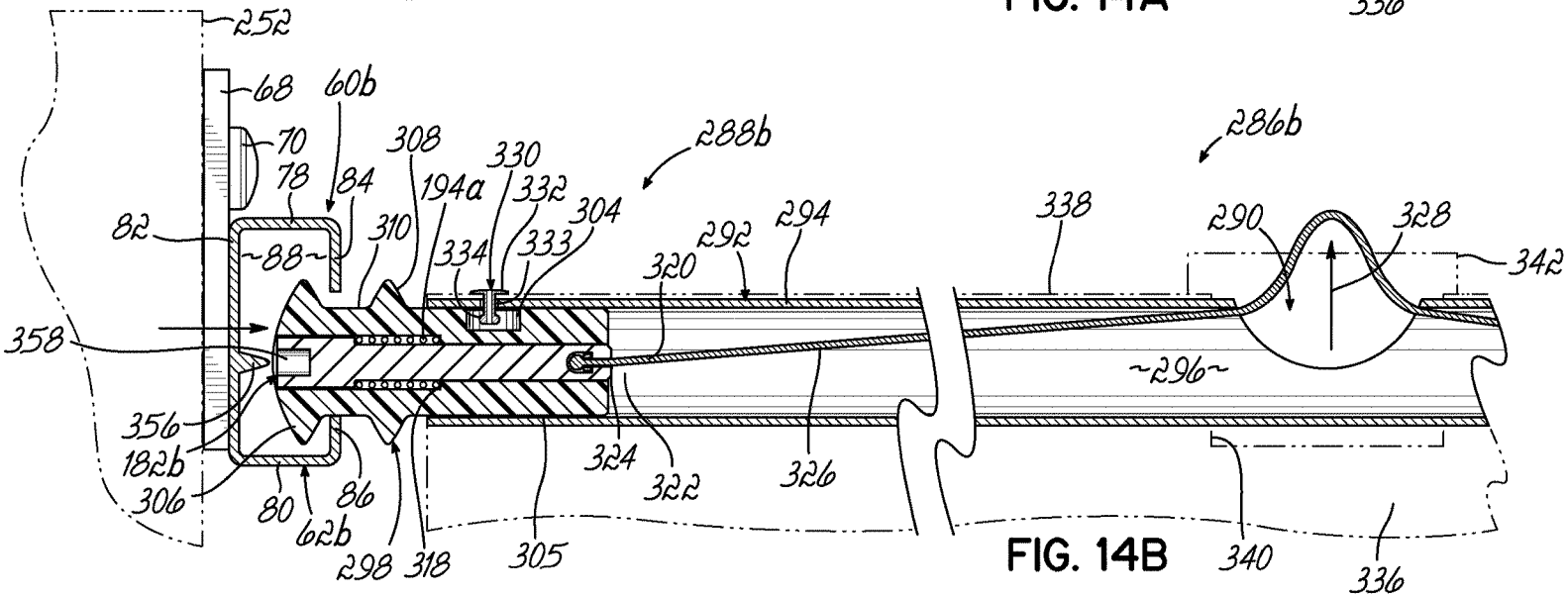
FIG. 14B is a cross-sectional view taken of a portion of the lockable crossbar assembly of FIG. 14A; showing one of the locking pins being retracted out of engagement with the opening in the track of FIG. 14A.

FIGS. 14A and 14B illustrate views similar to FIGS. 12A and 12B with different lockable crossbar assemblies 286*b* and different generally "U-shaped" upper tracks 60*b*. Each lockable crossbar assembly 286*b* comprises two outer locking assemblies 288*b* (only one being shown) between which is a crossbar 292. FIGS. 14A and 14B show the generally horizontally oriented upper portion 62*b* of the generally "U-shaped" upper track 60*b* having at least one projection 356. Any number of projections 356 of any desired shape may be located at any desired locations along the generally horizontally oriented upper portions 62*b* and along the generally vertically oriented track portions (not shown) of the generally "U-shaped" upper tracks 60*b*. As best shown in FIG. 14B, the locking pin 182*b* of each movable locking assembly 288*b* has a recess 358 adapted to receive and retain one of the projections 356 to lock the lockable crossbar assembly 286*b* in a desired location. Although the drawings show conical-shaped projections 356, the projections may be any desired shape or size; same with the recesses 358. The drawings are not intended to be limiting. Although shown only in FIGS. 14A and 14B, this combination of track and locking pin may be used in any embodiment of container shown or described herein in any shape of track shown or described herein, including generally L-shaped tracks, straight tracks, generally U-shaped tracks, etc. This combination of track and locking pin may be used in any embodiment of lockable crossbar assembly shown or described herein.

Figure 15:
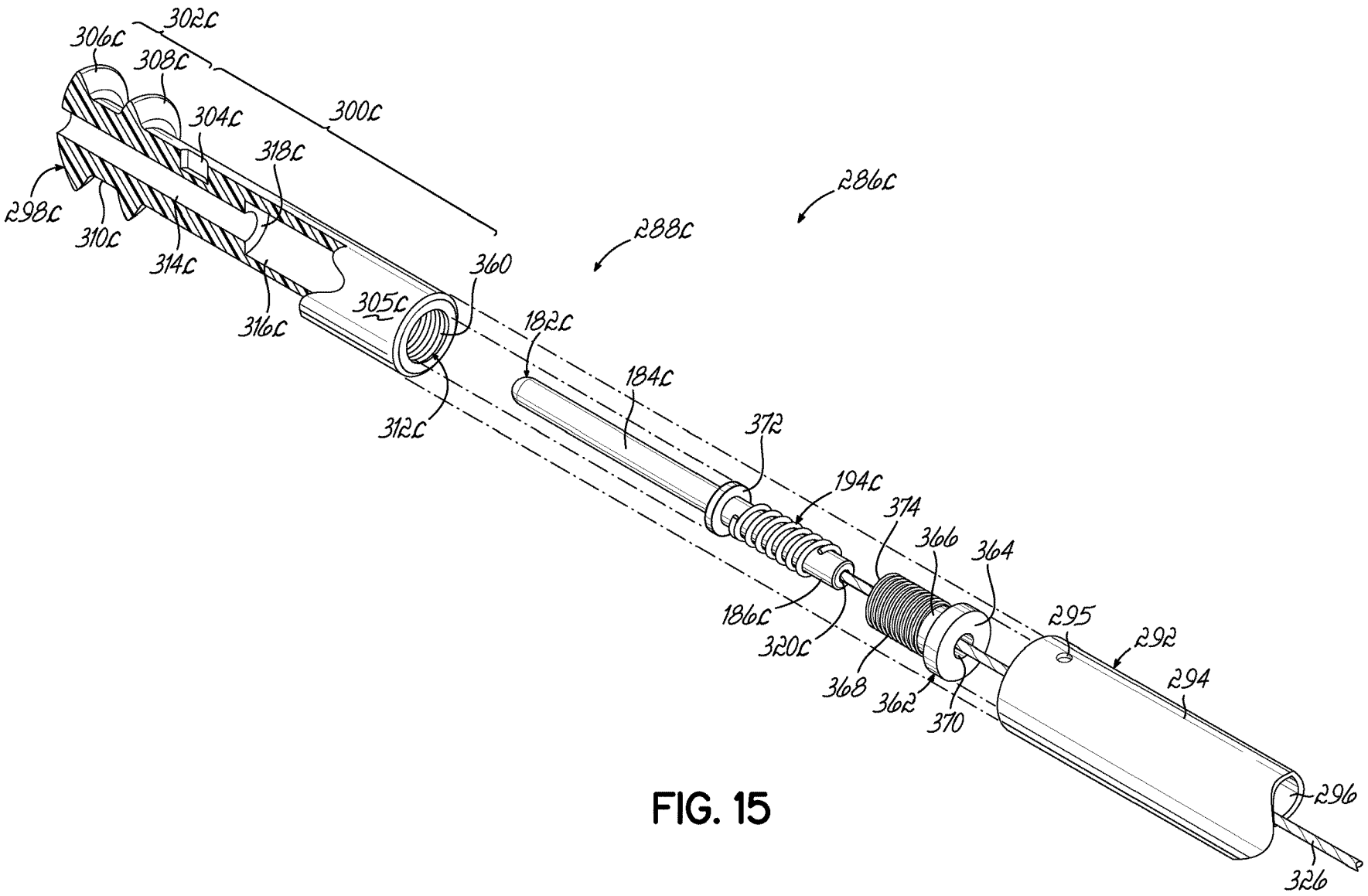
FIG. 15 is a partially disassembled view of a portion of another version of lockable crossbar assembly.
Figure 16A:
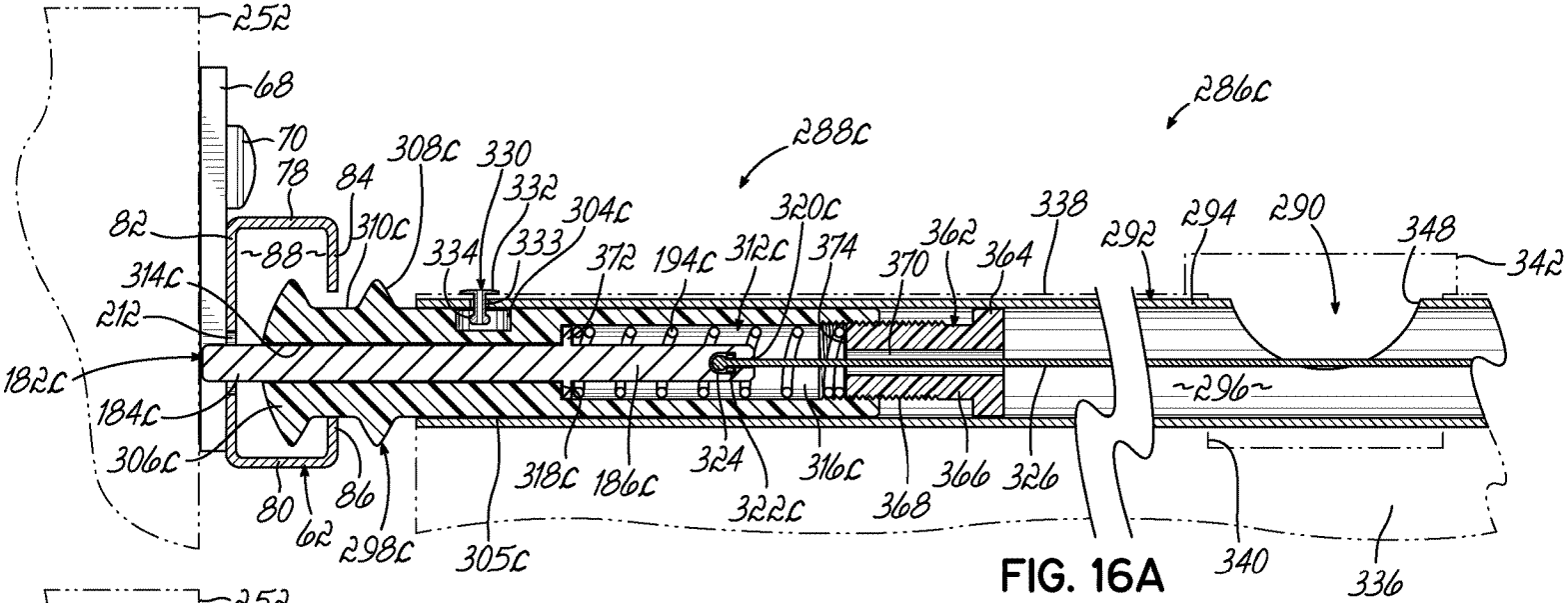
FIG. 16A is a cross-sectional view of a portion of another version of lockable crossbar assembly locked in a desired position.
Figure 16B:
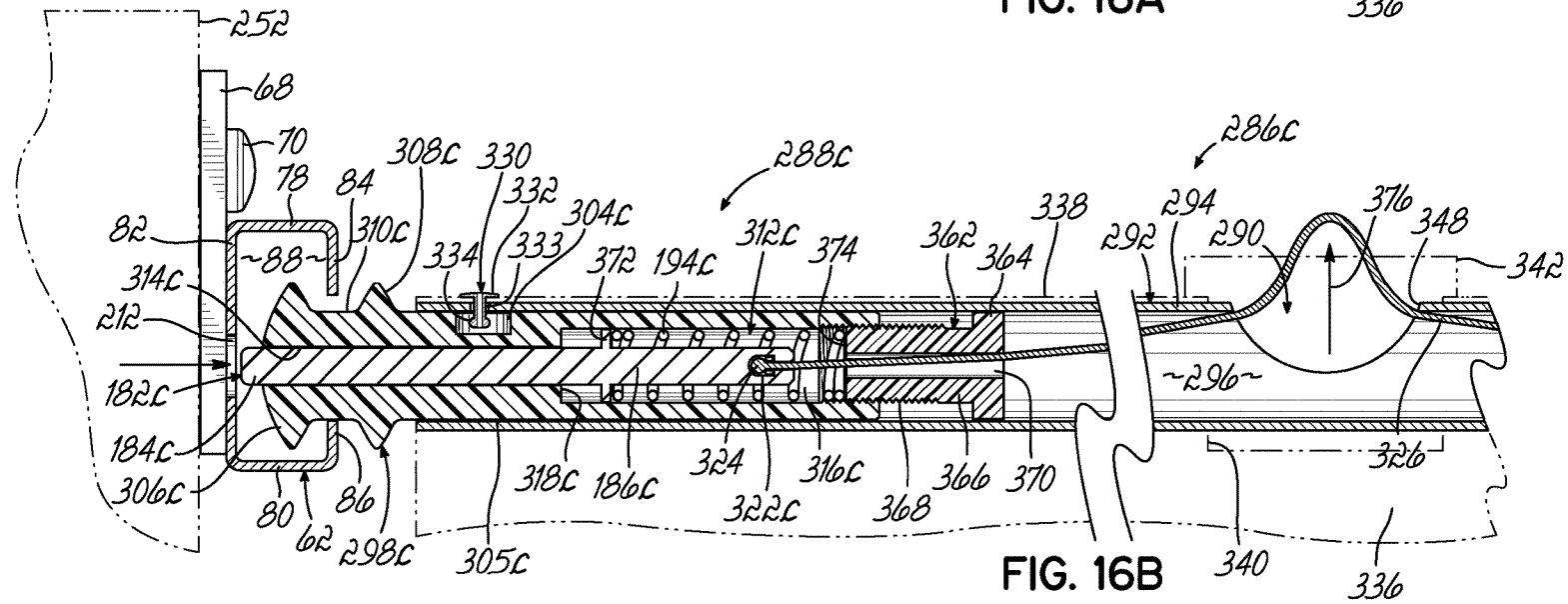
FIG. 16B is a partially disassembled view of a portion of the lockable crossbar assembly of FIG. 16A, showing one of the locking pins being retracted out of engagement with one of the openings in one of the tracks.

FIGS. 15, 16A and 16B illustrate a portion of an alternative lockable crossbar assembly 286*c* which may be used in any embodiment of container shown or described herein in any shape of track shown or described herein, including generally L-shaped tracks, straight tracks, generally U-shaped tracks, etc. For simplicity, like parts have like numbers. Each lockable crossbar assembly 286*c* has two locking assemblies 288*c* (only one being shown) between which is a crossbar 292. FIGS. 15, 16A and 16B illustrate the components and operation of one of the lockable assemblies 288*c* of one of the lockable crossbar assemblies 286*c*. FIGS. 16A and 16B illustrate cross-sectional views of a portion of an assembled lockable crossbar assembly 286*c*, showing the same tracks as FIGS. 12A and 12B. However, lockable crossbar assembly 286*c*, like the other lockable crossbar assemblies shown and described herein, may be used in any track, or portion thereof, shown or described herein.

As best shown in FIG. 15, each locking assembly 288*c* of lockable crossbar assembly 286*c* comprises an end member 298*c* having two spaced heads 306*c*, 308*c*. Each end member 298*c* is a unitary member, preferably made of injection molded plastic, such as nylon, but may be made of any other material.

As shown in FIG. 15, each end member 298*c* preferably has an inner portion 300*c* and an outer portion 302*c*. The inner portion 300*c* has a recess 304*c* extending inwardly from an outer surface 305*c* of the inner portion 300*c*. The outer portion 302*c* of end member 298*c* has spaced outer and inner heads 306*c*, 308*c*, respectively, at the end of the end member 298*c*. Outer head 306*c* is furthest from the inner portion 300*c* of the end member 298*c*, and inner head 308*c* is spaced inwardly from outer head 306*c*. The outer and inner heads 306*c*, 308*c*, respectively, are spaced from one another to define a groove 310*c* therebetween which receives and retains the upper and lower lips 84, 86, respectively, of each generally U-shaped upper track 60 or the lips of any track shown or described herein. As shown in FIGS. 16A and 16B, outer head 306*c* is shown located inside the interior 88 of generally horizontally oriented upper portion 62 of each generally U-shaped upper track 60, and inner head 308*c* is shown located outside the interior 88 of generally horizontally oriented upper portion 62 of each generally U-shaped upper track 60. Outer head 306*c* keeps the end member 298*c* engaged with the track, while inner head 308*c* keeps the dunnage material out of the interior 88 of the track, thereby ensuring that the end members 298*c* may move smoothly along the generally U-shaped upper tracks 60 or any of the tracks shown or described herein.

As shown in FIGS. 15, 16A and 16B, each end member 298*c* has an internal passage 312*c* extending through the interior of the end member 298*c*. The internal passage 312*c* has an outer portion 314*c* of a first diameter and a partially threaded inner portion 316*c* of a second diameter, the second diameter being larger than the first diameter. As best shown in FIG. 15, a shoulder 318*c* exists at the junction of the outer and inner portions 314*c*, 316*c* of internal passage 312*c* of end member 298*c*. The inside surface of the inner portion 316*c* has internal threads 360 shown extending along at least a portion of the length of the inner portion 316*c* of internal passage 312*c* of end member 298*c*. The internal threads 360 may extend along the entire length of the inner portion 316*c* of internal passage 312*c* or any portion thereof. In other words, they may extend for any desired length of the inner portion 316*c* of internal passage 312*c*.

As shown in FIGS. 15, 16A and 16B, each locking assembly 288*c* of lockable crossbar assembly 286*c* further comprises a plug 362 having a flange 364 and a narrow portion 366. The narrow portion 366 has an end surface 374 and external threads 368 adapted to engage the internal threads 360 of the end member 298*c*. The flange 364 is sized to fit inside the hollow interior 296 of the crossbar 292, as shown in FIGS. 16A and 16B. A bore 370 extends the length of the plug 362 to allow the cord 326 to pass through the plug 362, as shown in FIGS. 16A and 16B. The plug 362 may be secured inside the hollow interior 296 of the crossbar 292 at a desired location via engagement of its external threads 368 with the internal threads 360 of the inner portion 316*c* of internal passage 312*c* of end member 298*c*.

As best shown in FIG. 15, each locking assembly 288*c* of each lockable crossbar assembly 286*c* further comprises a locking pin 182*c*. As best shown in FIGS. 16A and 16B, locking pin 182*c* has a bore 320*c* terminating in a cavity 322*c* for securing one end 324 of a cord 326. As best shown in FIG. 15, locking pin 182*c* has an outer portion 184*c* and an inner portion 186*c*, the diameter of the inner portion 186*c* is shown being identical to the diameter of the outer portion 184*c*, but may be different. The locking pin 182*c* further comprises a stop 372 between the inner and outer portions 186*c*, 184*c*, respectively. A spring 194*c* surrounds the inner portion 186*c* of locking pin 182*c*, one end of spring 194*c* abutting the stop 372 of locking pin 182*c*.

As shown in FIGS. 15, 16A and 16B, upon assembly, each end 324 of cord 326 is secured inside a cavity 322*c* after passing through bore 320*c* of locking pin 182*c* (only one being shown). As shown in FIGS. 16A and 16B, from one end 324 to the other, cord 326 extends through the bore 370 of each plug 362 (only one being shown) and through the hollow interior 296 of crossbar 292. The compression of spring 194*c* may be adjusted by rotation of plug 362 and shortening the distance between the end surface 374 of plug 362 and the stop 372 of locking pin 182*c*.

As best shown in FIGS. 16A and 16B, upon assembly, the locking pin 182*c* and spring 194*c* extend into the internal passage 312*c* extending through the end member 298*c*. The outer portion 184*c* of locking pin 182*c* fits inside the outer portion 314*c* of internal passage 312*c* of end member 298*c*, as shown in FIG. 16A. The inner portion 186*c* of locking pin 182*c* and spring 194*c* fit inside the inner portion 316*c* of internal passage 312*c* of end member 298*c*, as shown in FIG. 16A. The stop 372 of locking pin 182*c* abuts the shoulder 318*c* of internal passage 312*c* of end member 298*c*, as shown in FIG. 16A.

The spring 194*c* is shown in a relaxed position in FIG. 16A extending between the stop 372 of locking pin 182*c* and the end surface 374 of plug 362 of locking assembly 288*c*. In FIG. 16B, spring 194*c* is shown in a compressed position or condition between the stop 372 of locking pin 182*c* and the end surface 374 of plug 362 of the locking assembly 288*c*, the stop 372 of locking pin 182*c* having moved inwardly (to the left as shown in FIGS. 16A and 16B) by a shortening of the distance between ends 324 of cord 326. The spring 194*c* is compressed as the locking pin 182*c* moves inwardly towards the center of the lockable crossbar assembly 286*c* by a user, shortening the distance between ends 324 of the cord 326 such as, for example, pulling the cord 326*c* upwardly as shown by arrow 376 in FIG. 16B. By shortening of the distance between ends 324 of cord 326, the distance between the two locking pins 182*c* of lockable crossbar assembly 286*c* shortens the spring 194*c* being compressed between the stop 372 of locking pin 182*c* and the end surface 374 of plug 362 of the locking assembly 288*c*. When an operator lets go of the cord 326, the spring 194*c* biases or forces the locking pin 182*c* outwardly (to the left as shown in FIGS. 16A and 16B) to an extended locked position in which the locking pin 182*c* is inside an opening 212 of generally horizontally oriented upper portion 62.

As best shown in FIGS. 16A and 16B, upon assembly, a fastener 330, such as a rivet, for example, joins end member 298*c*, crossbar 292 and dunnage 336 surrounding the crossbar 292. Fastener 330 has a generally planar upper portion 332 which resides outside the fabric pocket 338 surrounding lockable crossbar assembly 286*c* upon assembly and neck 333 extending through the opening 290 in the crossbar 292. See FIG. 15. Fastener 330 further comprises a lower portion 334 which travels in the recess 304 of end member 298*c*, allowing some movement between the end member 298*c* and crossbar 292. Such allowance for movement prevents the lockable crossbar assembly 286*c* from becoming jammed in an undesirable position inside the container. In place of a fastener 330, a portion of the outer wall 294 of the crossbar 292 may be deformed into the recess 304 of end member 298*c*. In such a configuration, the fabric pocket 338 of dunnage 336 surrounding lockable crossbar assembly 286*c* would be free to move relative to the lockable crossbar assembly 286*c*.

Figure 17:
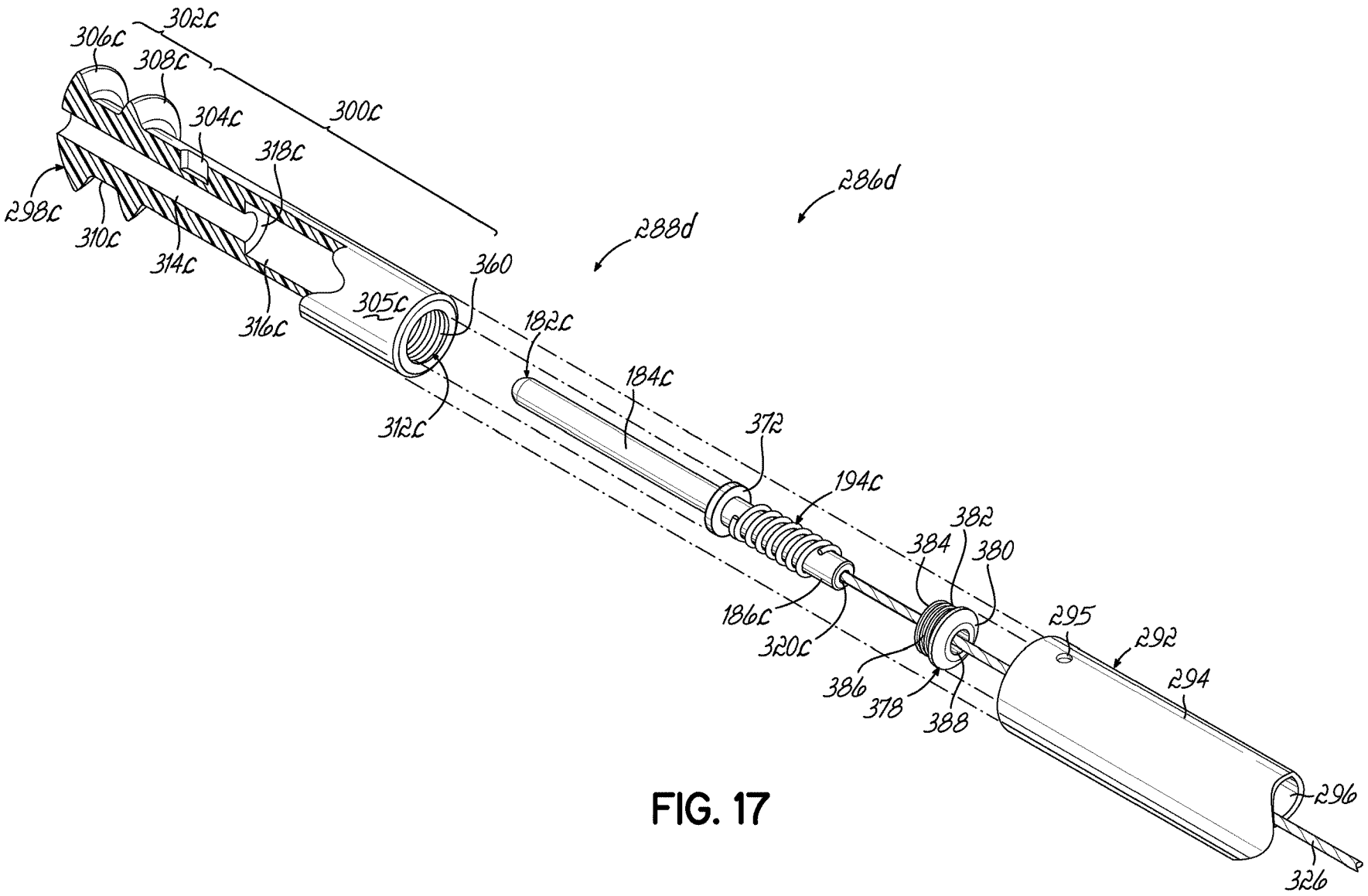
FIG. 17 is a partially disassembled view of a portion of another version of lockable crossbar assembly.
Figure 18A:
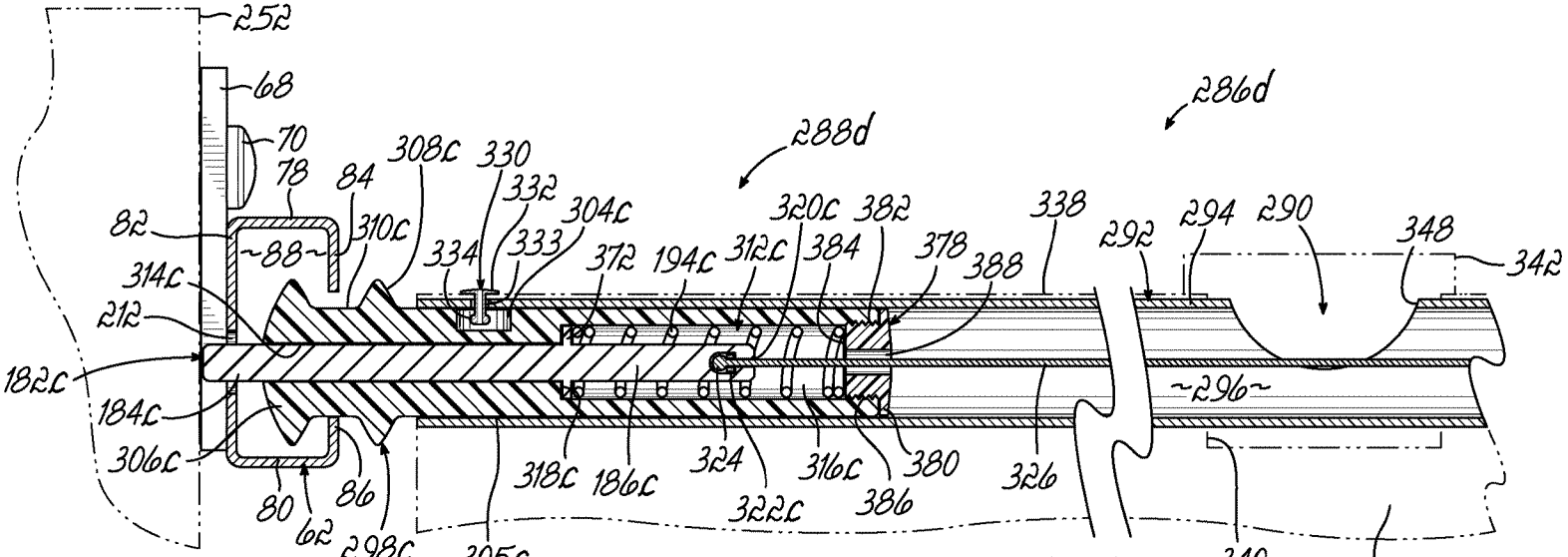
FIG. 18A is a cross-sectional view of a portion of another version of lockable crossbar assembly locked in a desired position.
Figure 18B:
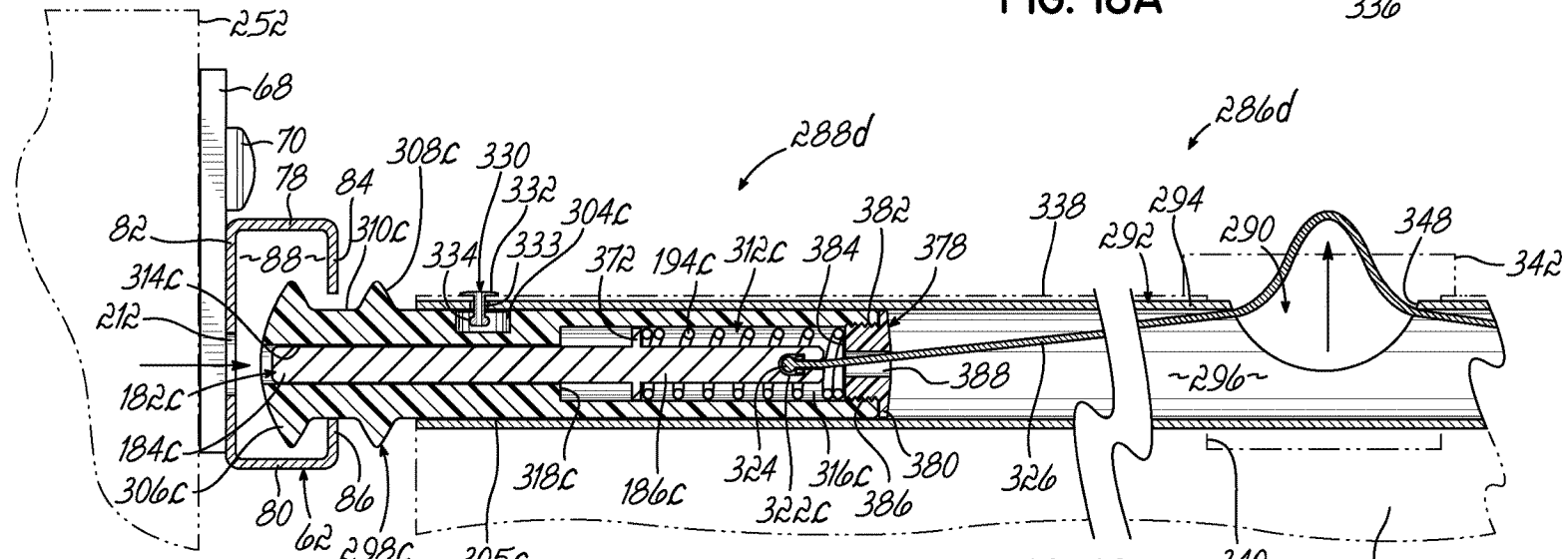
FIG. 18B is a partially disassembled view of a portion of the lockable crossbar assembly of FIG. 18A, showing one of the locking pins being retracted out of engagement with one of the openings in one of the tracks.

FIGS. 17, 18A and 18B illustrate a portion of an alternative lockable crossbar assembly 286*d*, which may be used in any embodiment of container shown or described herein in any shape of track shown or described herein, including generally L-shaped tracks, straight tracks, generally U-shaped tracks, etc. For simplicity, like parts have like numbers. Each lockable crossbar assembly 286*d* has two locking assemblies 288*d* (only one being shown) between which is a crossbar 292. FIGS. 17, 18A and 18B illustrate the components and operation of one of the locking assemblies 288*d* of one of the lockable crossbar assemblies 286*d*. Each locking assembly 288*d* is similar to locking assembly 288*c* shown in FIG. 15, having the same parts except for the plug. In place of plug 362 shown in FIG. 15, locking assembly 288*d* uses a plug 378 which is shorter in length than plug 362. See FIGS. 15 and 17.

As best shown in FIG. 17, plug 378 has a flange 380 and a narrow portion 382. The narrow portion 382 has an end surface 384 and external threads 386 adapted to engage the internal threads 360 of the end member 298*c*. The flange 380 is sized to fit inside the hollow interior 296 of the crossbar 292. A bore 388 extends the length of the plug 378 to allow the cord 326 to pass through the plug 378, as shown in FIGS. 18A and 18B. The plug 378 may be secured inside the hollow interior 296 of the crossbar 292 at a desired location via engagement of its external threads 386 with the internal threads 360 of the inner portion 316*c* of internal passage 312*c* of end member 298*c*.

FIGS. 18A and 18B illustrate cross-sectional views of a portion of an assembled lockable crossbar assembly 286*d*, showing the same tracks as FIGS. 12A and 12B. However, lockable crossbar assembly 286*d*, like the other lockable crossbar assemblies shown and described herein, may be used in any track, or portion thereof, shown or described herein.

Figure 19:
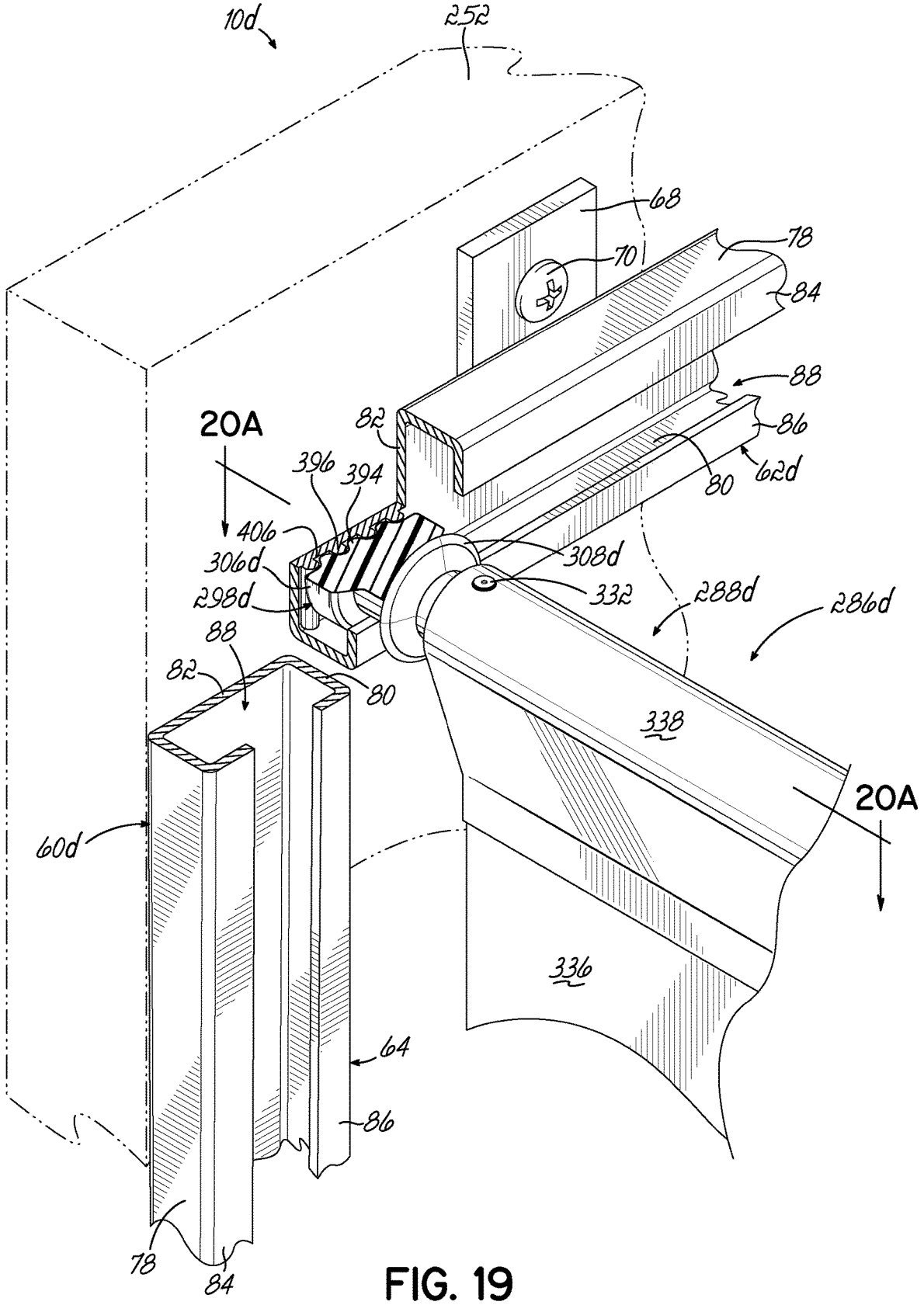
FIG. 19 is a perspective view of a portion of another version of lockable crossbar assembly locked in a desired position engaged with another version of track.
Figure 20A:
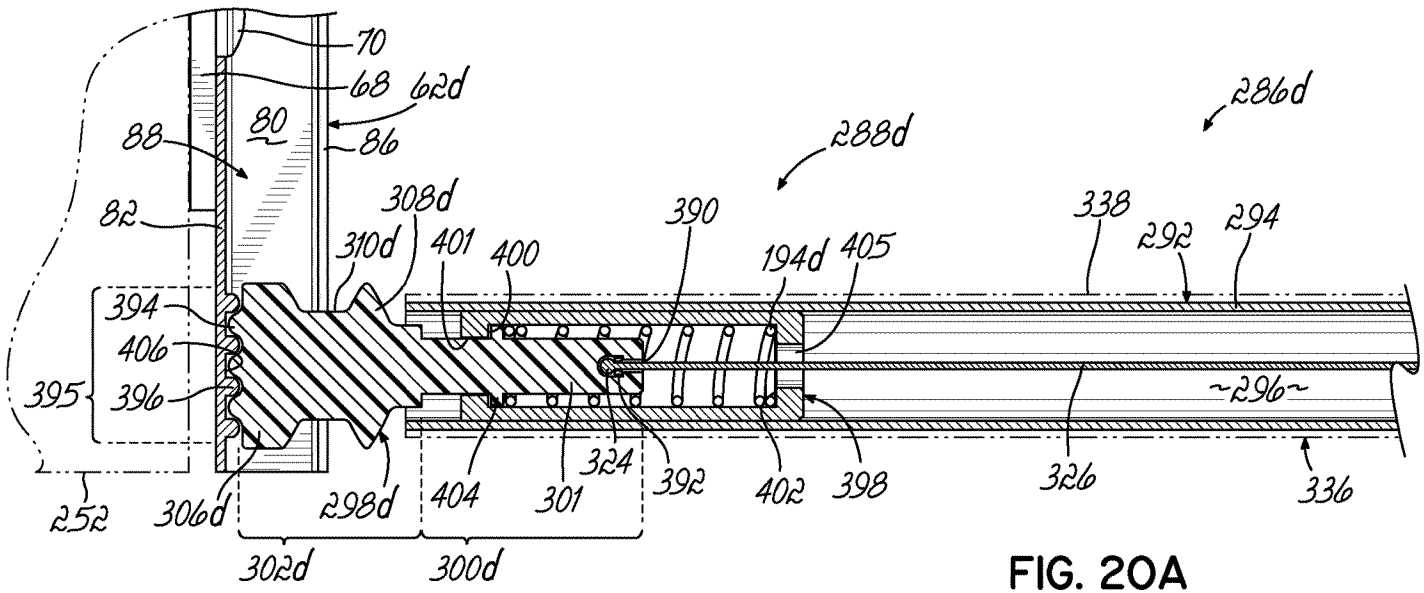
FIG. 20A is a cross-sectional view taken along the line 20A-20A of FIG. 19.
Figure 20B:
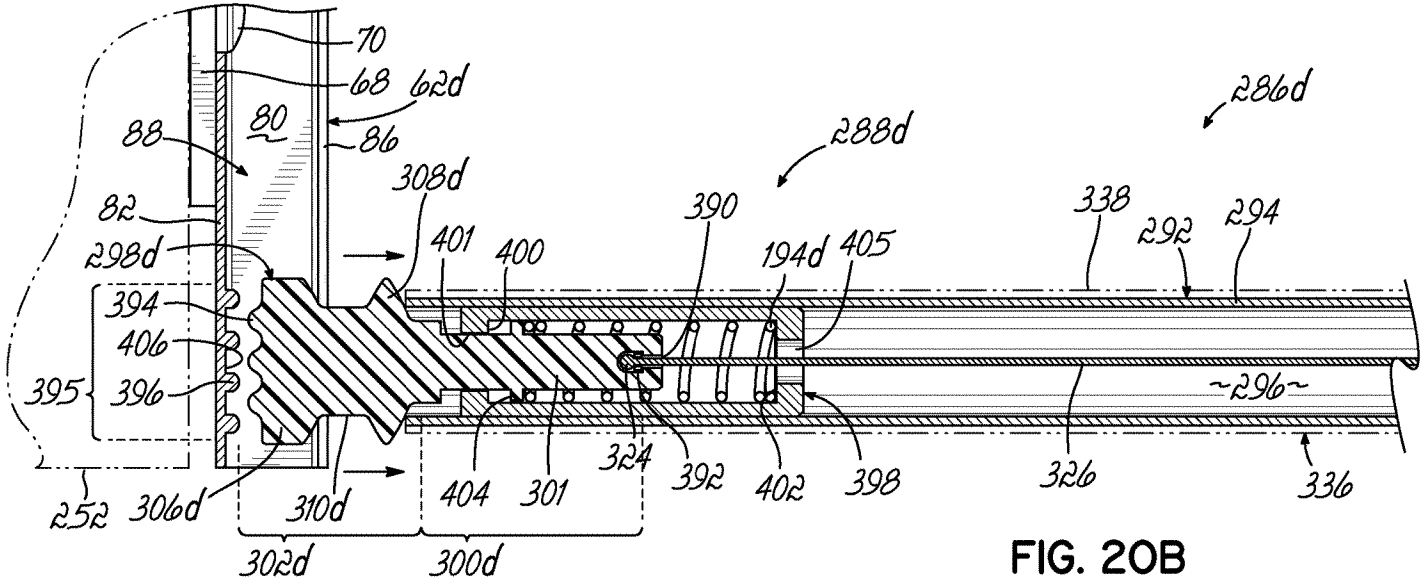
FIG. 20B is a cross-sectional view taken of a portion of the lockable crossbar assembly of FIG. 20A; showing one of the locking pins being retracted out of engagement with the opening in the track shown in FIG. 19.

FIGS. 19, 20A and 20B illustrate a portion of an alternative lockable crossbar assembly 286*d*, which may be used in any embodiment of container shown or described herein in any shape of track shown or described herein, including generally L-shaped tracks, straight tracks, generally U-shaped tracks, etc. For simplicity, like parts have like numbers. Each lockable crossbar assembly 286*d* has two locking assemblies 288*d* (only one being shown) between which is a crossbar 292. FIGS. 19, 20A and 20B illustrate the components and operation of one of the locking assemblies 288*d* of one of the lockable crossbar assemblies 286*d*.

As shown in FIGS. 20A and 20B, each lockable crossbar assembly 286*d* has a crossbar 292 with at least one opening (not shown in FIG. 19, 20A or 20B). As best shown in FIG. 19, each locking assembly 288*d* of lockable crossbar assembly 286*d* further comprises an end member 298*d* having two spaced heads. Each end member 298*d* is a unitary member preferably made of injection molded plastic, such as nylon, but may be made of any other material.

As best shown in FIGS. 20A and 20B, each end member 298*d* has an inner portion 300*d* and an outer portion 302*d*. The inner portion 300*d* of end member 298*d* comprises a stem 301 having a bore 390 extending into a cavity 392. One end 324 of cord 326 is anchored inside the cavity 392. The inner portion 300*d* of end member 298*d* further comprises a stop 404 which functions to compress a spring 194*d* in a manner described below.

The outer portion 302*d* of end member 298*d* has spaced outer and inner heads 306*d*, 308*d*, respectively, at the end of the end member 298*d*. Outer head 306*d* is furthest from the inner portion 300*d* of the end member 298*d*, and inner head 308*d* is spaced inwardly from outer head 306*d*. The outer and inner heads 306*d*-308*d*, respectively, are spaced from one another to define a groove 310*d* therebetween which receives and retains the upper and lower lips 84, 86, respectively, of each generally U-shaped upper track 60*d*. As shown in FIGS. 20A and 20B, outer head 306*d* is located inside the interior 88 of generally horizontally oriented upper portion 62 of each generally U-shaped upper track 60*d*, and inner head 308*d* is located outside the interior 88 of each generally U-shaped upper track 60*d*. Outer head 306*d* keeps the end member 298*d* engaged with the track, while inner head 308*d* keeps the dunnage material out of the interior 88 of the track, thereby ensuring that the end members 298*d* may move smoothly along the generally U-shaped upper tracks 60*d*. Outer head 306*d* of each end member 298*d* has a set of teeth 394, which engage with a set 395 of teeth 396 of generally U-shaped upper track 60*d*. See FIG. 20B.

As shown in FIGS. 20A and 20B, each locking assembly 288*d* of lockable crossbar assembly 286*d* has a cassette 398. Each cassette 398 is secured inside the hollow interior 296 of crossbar 292. Each cassette 398 has an outer wall 400 and an inner wall 402. A spring 194*d* is trapped between the stop 404 of the end member 298*d* and inner wall 402 of cassette 398. The outer wall 400 of cassette 398 has a bore 401 inside which end member 298*d* travels. Inner wall 402 has a bore 405 through which the cord 326 travels.

In operation, shortening the distance between ends 324 of cord 326 by an operator causes inward movement of the ends 324 of cord 326, which causes inward movement of the end members 298*d* against the outward bias of springs 194*d*. The end members 298*d* move relative to the crossbar 292. As shown in FIGS. 20A and 20B, movement of the cord 326 by an operator causes the end members 298*d* to move from extended locked positions in which the teeth 394 of end member 298*d* engage the recesses 406 between the teeth 396 of the tracks 32*d*. Although one locking assembly 288*d* (left side) of the lockable crossbar assembly 286*d* is shown in FIGS. 20A and 20B, the right side is a mirror image. To unlock the lockable crossbar assembly 286*d* from a locked position shown in FIG. 20A to an unlocked position shown in FIG. 20B, an operator must shorten the length of the cord 326 extending between the end members 298*d* of the locking assemblies 288*d*. Shortening this distance moves the end members 298*d* inwardly towards each other, compressing the spring 194*d* of each locking assembly 288*d* and moving each end member 298*d* of each locking assembly 288*d* inwardly out of engagement with the set 395 of teeth 396 of the track 32*d*. Once the end members 298*d* are in their unlocked position shown in FIG. 20B, an operator is free to move the lockable crossbar assembly 286*d* to its desired position, including another position in the tracks 32*d*.

Figure 21:
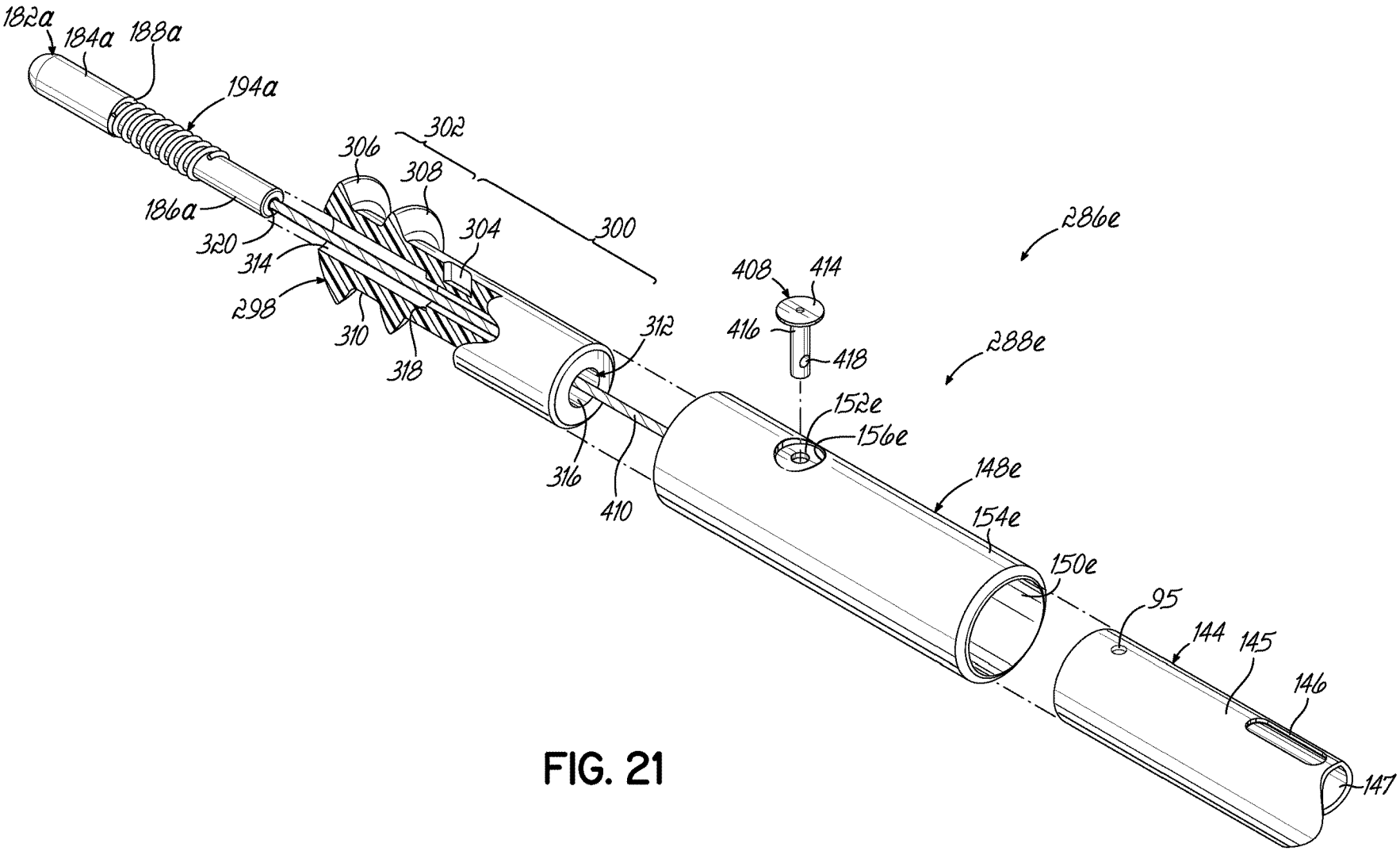
FIG. 21 is a partially disassembled view of a portion of another version of lockable crossbar assembly.
Figure 22A:
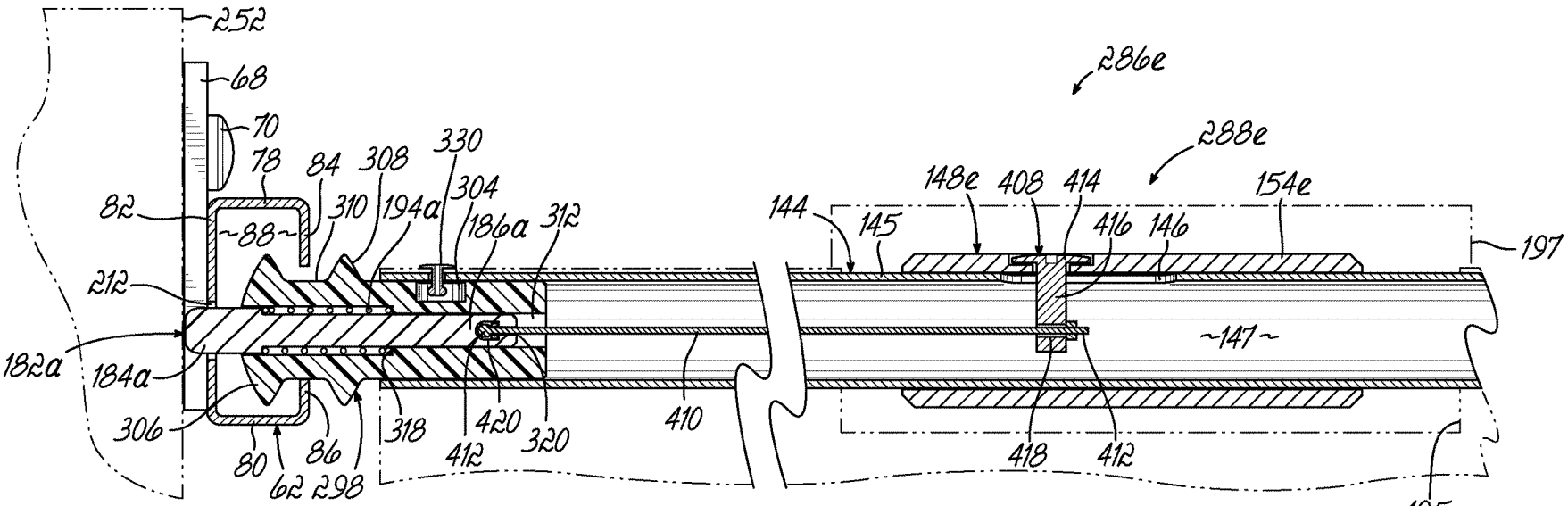
FIG. 22A is a cross-sectional view taken of a portion of the lockable crossbar assembly of FIG. 21 being locked in a desired position.
Figure 22B:
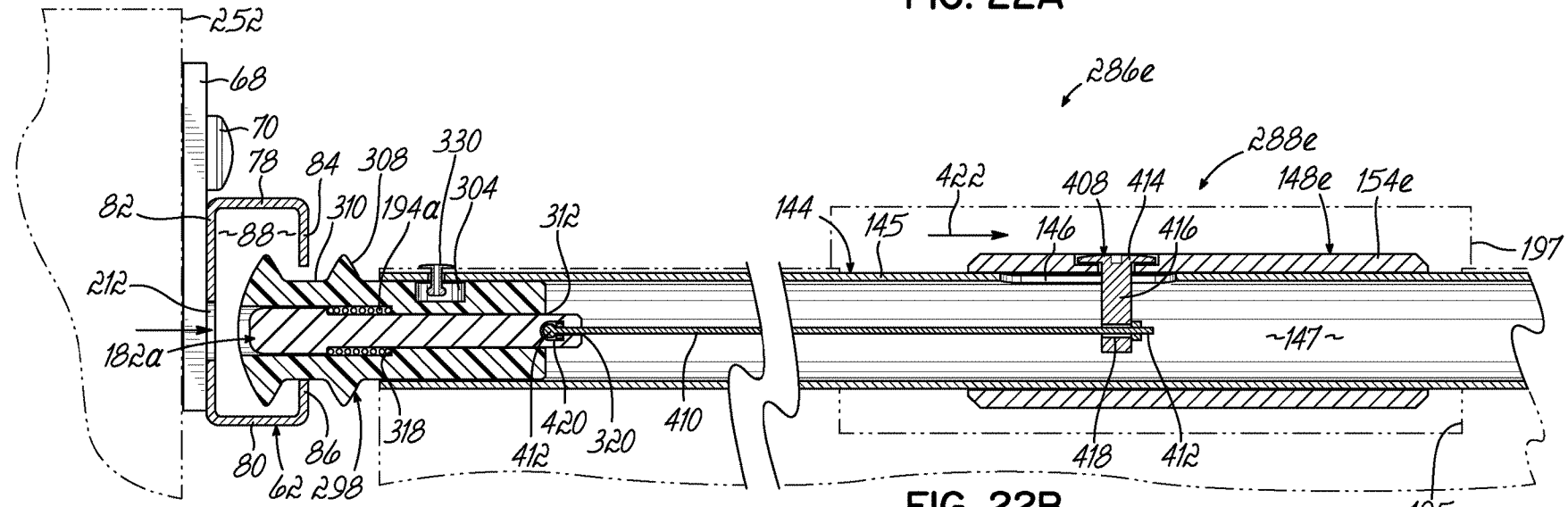
FIG. 22B is a cross-sectional view taken of a portion of the lockable crossbar assembly of FIG. 21; showing one of the locking pins being retracted out of engagement with one of the openings in one of the tracks.

FIGS. 21, 22A and 22B illustrate a portion of an alternative lockable crossbar assembly 286*e*, which may be used in any embodiment of container shown or described herein in any shape of track shown or described herein, including generally L-shaped tracks, straight tracks, generally U-shaped tracks, etc. For simplicity, like parts have like numbers. Each lockable crossbar assembly 286*e* has two locking assemblies 288*e* (only one being shown) between which is a crossbar 144. Crossbar 144 is the same crossbar described above and shown in detail in FIGS. 3, 4A and 4B. FIGS. 21, 22A and 22B illustrate the components and operation of one of the locking assemblies 288*e* of one of the lockable crossbar assemblies 286*e*. At each end, crossbar 144 has an opening 95 which permits a fastener 330 to hold the dunnage in place and secure the crossbar 144 to one of the end members 298.

As shown in FIGS. 21, 22A and 22B, each locking assembly 288*e* has the same locking pin 182*a*, spring 194*a* and end member 298 as locking assembly 288, best shown in FIG. 11. Each locking assembly 288*e* further comprises a handle 148*e*, an anchor 408 and a cord 410 having opposed ends 412. As best shown in FIGS. 20A and 20B, upon assembly, anchor 408 joins end member 298, handle 148*e* and crossbar 144. More particularly, anchor 408 has a generally planar upper portion 414 which resides in the recess 156*e* of handle 148*e* upon assembly. Anchor 408 has a lower portion 416 with a passage 418. As shown in FIGS. 20A and 20B, the lower portion 416 of the anchor 408 travels along the slot 146 of crossbar 144.

The handle 148*e*, best shown in FIG. 21, may be identical to handle 148, best shown in FIG. 3, or may be different in size or configuration. As best shown in FIG. 21, each locking assembly 288*e* of each lockable crossbar assembly 286*e* comprises a handle 148*e* having a hollow interior 150*e* inside which is located a portion of crossbar 144. The handle 148*e* has an opening 152*e* extending through its wall 154*e* and a recess 156*e* surrounding the opening 152*e*. The opening 152*e* is illustrated as being circular, but may be another shape; same with recess 156*e*.

As shown in FIGS. 21, 22A and 22B, upon assembly, one end 412 of cord 410 is secured inside cavity 420 of locking pin 182*a* after passing through bore 320 of locking pin 182*a* (only one being shown). The other end of cord 410 extends through the passage 418 of the lower portion 416 of the anchor 408 and is secured to the lower portion 416 of the anchor 408. Along its length, cord 410 extends through the internal passage 312 of end member 298 (only one being shown) and through the hollow interior 147 of crossbar 144.

In operation, inward movement of the handles 148*e* and associated anchors 408 by an operator, shown by the arrow 422 of FIG. 22B towards each other, causes inward movement of the locking pins 182*a* against the outward bias of springs 194*a*. The locking pins 182*a* move relative to the crossbar 92 and end members 298. As shown in FIGS. 22A and 22B, inward movement of the handles 148*e* by an operator causes the locking pins 182*a* to move from extended locked positions extending through openings 212 in the side walls 82 of the upper generally horizontally oriented upper portion 62 of the generally U-shaped upper tracks 60. Although one locking assembly 288*e* (left side) of the lockable crossbar assembly 286*e* is shown in FIGS. 22A and 22B, the right side is a mirror image. To unlock the lockable crossbar assembly 286*e* from a locked position shown in FIG. 22A to an unlocked position shown in FIG. 22B, an operator must move handles 148*e* of the locking assemblies 288*e* inwardly towards each other, compressing the spring 194*a* on each side of the lockable crossbar assembly 286*e* and moving two locking pins 182*a* of the lockable crossbar assembly 286*e* inwardly out of the openings 212 of the generally horizontally oriented upper portions 62 of the generally U-shaped upper tracks 60. Once the locking pins 182*a* are in their unlocked position shown in FIG. 22B, an operator is free to move the lockable crossbar assembly 286*e* to its desired position, including a position in the connecting portions 66 of the generally U-shaped upper tracks 60.

Figure 23A:
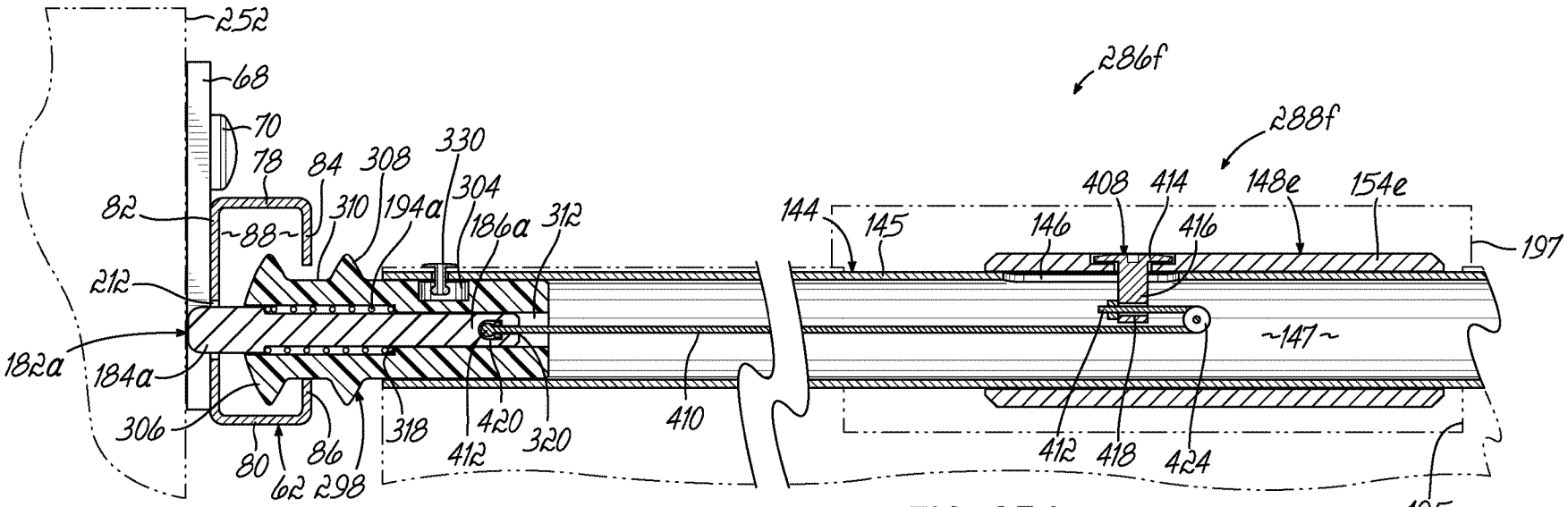
FIG. 23A is a cross-sectional view of a portion of another version of lockable crossbar assembly.
Figure 23B:
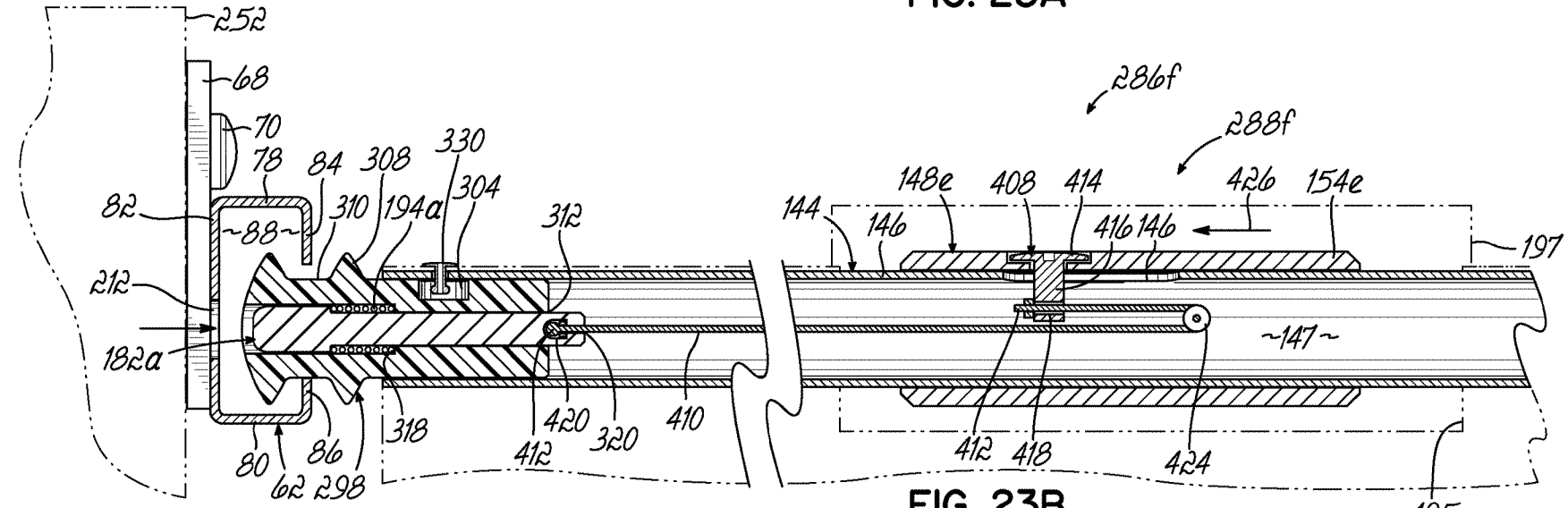
FIG. 23B is a cross-sectional view taken of the portion of the lockable crossbar assembly of FIG. 23A; showing one of the locking pins being retracted out of engagement with an opening in the track shown in FIG. 23A.

FIGS. 23A and 23B illustrate a portion of an alternative lockable crossbar assembly 286*f*, which may be used in any tracks shown or described herein in any embodiment of container shown or described herein. For simplicity, like parts have like numbers. Each lockable crossbar assembly 286*f* has two locking assemblies 288*f* (only one being shown) between which is a crossbar 144. FIGS. 23A and 23B illustrate the components and operation of one of the locking assemblies 288*f* of one of the lockable crossbar assemblies 286*f*. Each locking assembly 288*f* is identical to locking assembly 288*e*, but with the addition of a pulley 424, which may be secured to crossbar 144 in any known manner. The inclusion of the pulleys enables an operator to move the handles 148*e* away from each other in the direction of arrow 426 of FIG. 23B to disengage locking pins 182*a* and enable the operator to move crossbar assembly 286*f*.

Figure 24A:
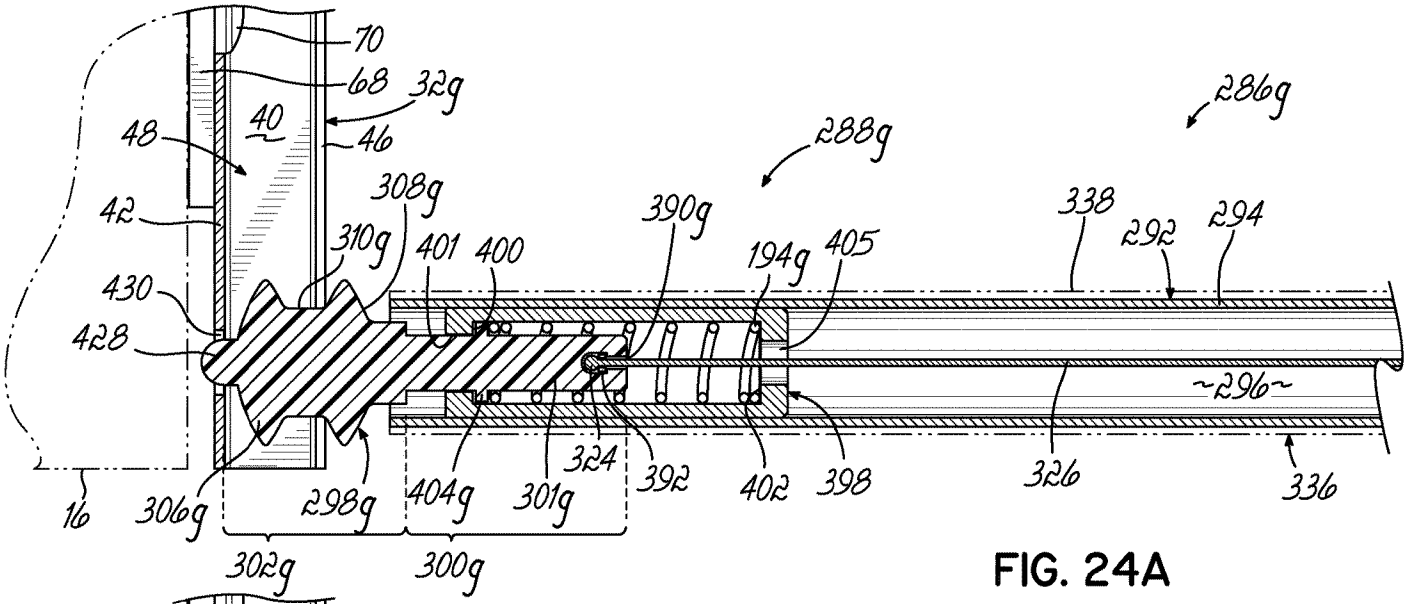
FIG. 24A is a cross-sectional view of a portion of another version of lockable crossbar assembly.
Figure 24B:
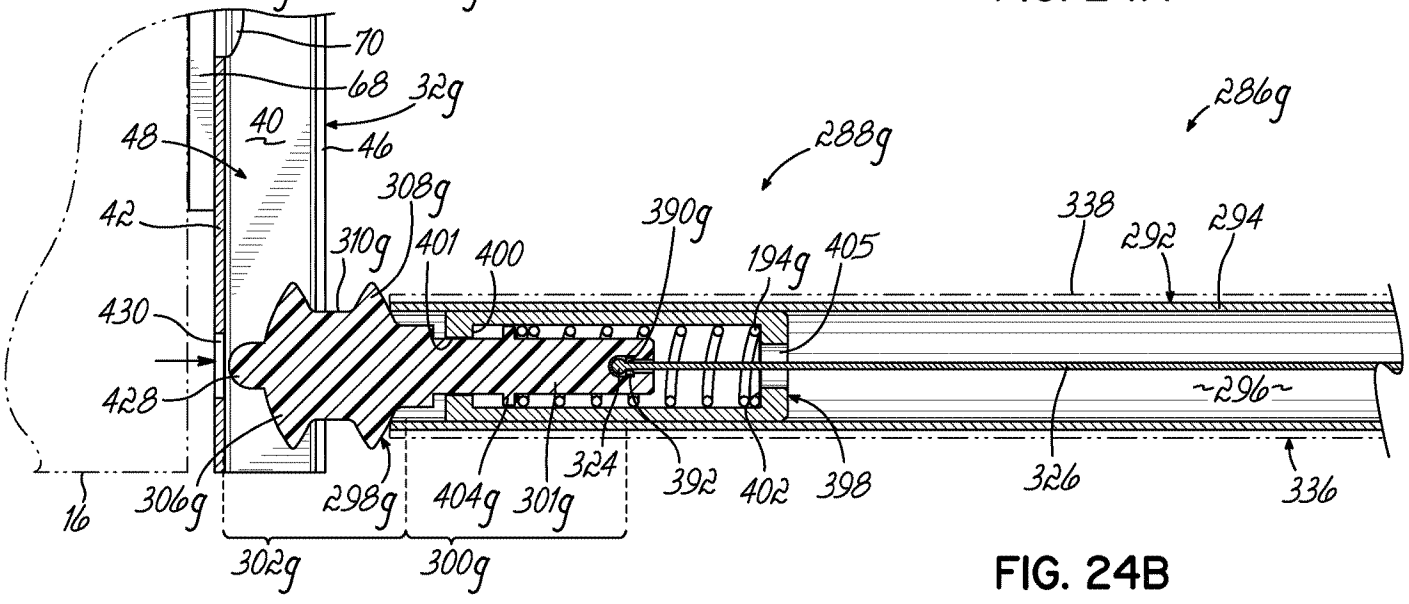
FIG. 24B is a cross-sectional view taken of the portion of the lockable crossbar assembly of FIG. 24A; showing one of the locking pins being retracted out of engagement with an opening in the track shown in FIG. 24A.

FIGS. 24A and 24B illustrate a portion of an alternative lockable crossbar assembly 286*g*, which may be with any tracks shown or disclosed herein and used in any embodiment of container shown or described herein in any shape of track shown or described herein, including generally L-shaped tracks, straight tracks, generally U-shaped tracks, etc. For simplicity, like parts have like numbers. Each lockable crossbar assembly 286*g* has two locking assemblies 288*g* (only one being shown) between which is a crossbar 292. FIGS. 24A and 24B illustrate the components and operation of one of the locking assemblies 288*g* of one of the lockable crossbar assemblies 286*g*.

As shown in FIGS. 24A and 24B, each lockable crossbar assembly 286*g* has a crossbar 292 with at least one opening (not shown in FIG. 24A or 24B). Each locking assembly 288*g* of lockable crossbar assembly 286*g* further comprises an end member 298*g* having two spaced heads. Each end member 298*g* is a unitary member preferably made of injection molded plastic, such as nylon, but may be made of any other material.

As best shown in FIGS. 24A and 24B, each end member 298*g* has an inner portion 300*g* and an outer portion 302*g*. The inner portion 300*g* comprises a stem 301*g* having a bore 390*g* extending into a cavity 392 inside which is one end 324 of cord 326. The inner portion 300*g* of end member 298*g* further comprises a stop 404*g* which functions to compress a spring 194*g* in a manner described below.

The outer portion 302*g* of end member 298*g* has spaced outer and inner heads 306*g*, 308*g*, respectively, at the end of the end member 298*g*. Outer head 306*g* is furthest from the inner portion 300*g* of the end member 298*g*, and inner head 308*g* is spaced inwardly from outer head 306*g*. The outer and inner heads 306*g*, 308*g*, respectively, are spaced from one another to define a groove 310*g* therebetween which receives and retains the upper and lower lips 44, 46, respectively, of each generally L-shaped track 32*g*. As shown in FIGS. 24A and 24B, outer head 306*g* is located inside the interior 48 of generally horizontally oriented portion 34 of each generally L-shaped track 32*g*, and inner head 308*g* is located outside the interior 48 of each track 32*g*. Outer head 306*g* keeps the end member 298*g* engaged with the track, while inner head 308*g* keeps the dunnage material out of the interior 48 of the track, thereby ensuring that the end members 298*g* may move smoothly along the generally L-shaped tracks 32*g*. Outer head 306*g* of each end member 298*g* has a projection 428 which engages an opening 430 extending through track 32*g*.

As shown in FIGS. 24A and 24B, each locking assembly 288*g* of lockable crossbar assembly 286*g* has a cassette 398. Each cassette 398 is secured inside the hollow interior 296 of crossbar 292. Each cassette 398 has an outer wall 400 and an inner wall 402. A spring 194*g* is trapped between the stop 404 of the end member 298*g* and inner wall 402 of cassette 398. The outer wall 400 of cassette 398 has a bore 401 inside which end member 298*g* travels. Inner wall 402 has a bore 405 through which the cord 326 travels.

In operation, shortening the distance between ends 324 of cord 326 by an operator causes inward movement of the ends 324 of cord 326, which causes inward movement of the end members 298*g* against the outward bias of springs 194*g*. The end members 298*g* move relative to the crossbar 292. As shown in FIGS. 24A and 24B, movement of the cord 326 by an operator causes the end members 298*g* to move from extended locked positions in which the projections 428 of end members 298*g* engage the openings 430 of the tracks 32*g*. Although one locking assembly 288*g* (left side) of the lockable crossbar assembly 286*g* is shown in FIGS. 24A and 24B, the right side is a mirror image. To unlock the lockable crossbar assembly 286*g* from a locked position shown in FIG. 28A to an unlocked position shown in FIG. 24B, an operator must shorten the length of the cord 326 extending between the end members 298*g* of the locking assemblies 288*g*. Shortening this distance moves the end members 298*g* inwardly towards each other, compressing the spring 194*g* of each locking assembly 288*g* and moving each end member 298*g* of each locking assembly 288*g* inwardly out of engagement with the opening 430 of the track 32*g*. Once the end members 298*g* are in their unlocked position shown in FIG. 24B, an operator is free to move the lockable crossbar assembly 286*g* to its desired position, including another position in the tracks 32*g*.

Figure 25:
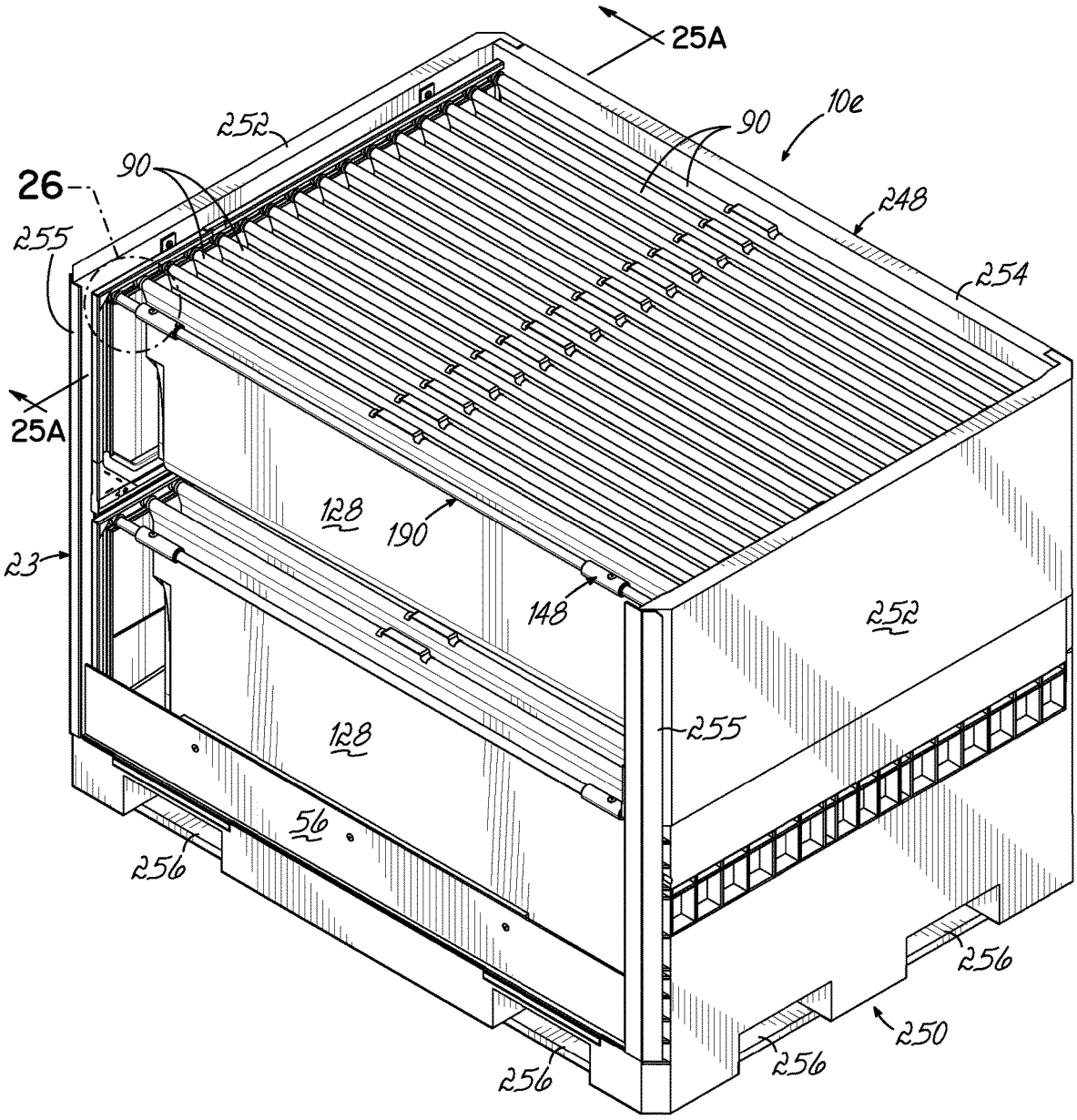
FIG. 25 is a perspective view of another embodiment of reusable and returnable container.
Figure 25A:
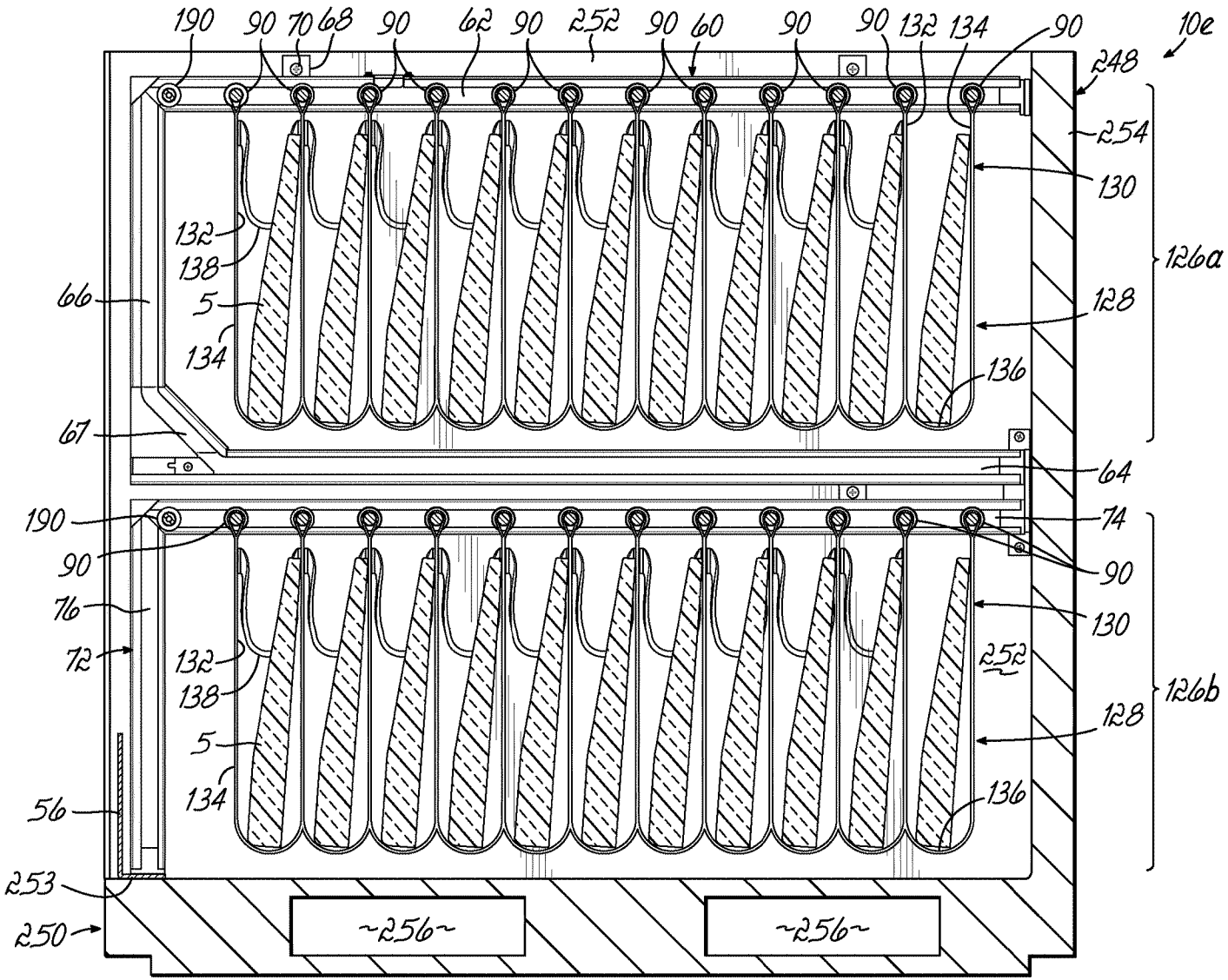
FIG. 25A is a cross-sectional view taken along the line 25A-25A of FIG. 25.

FIGS. 25, 25A and 26 illustrate an alternative embodiment of container 10*e*. Container 10*e* is a pallet box-like container 10*b* shown in FIGS. 9 and 9A. Container 10*e* is shown without a shelf assembly. However, a shelf assembly may be included in container 10*e*. As best shown in FIG. 25A, the front lockable crossbar assembly 190 of each of the two levels acts as a stop and does not supporting dunnage. For simplicity, like parts have like numbers.

Referring to FIG. 25, container 10*d* comprises a plurality of unlockable crossbar assemblies 90 and one lockable crossbar assembly 190 at each level or layer 126*a*, 126*b*. The lockable crossbar assembly 190 is the front crossbar assembly of a set of crossbar assemblies extending between corresponding tracks at the same level. As best shown in FIG. 25A, the front lockable crossbar assembly 190 does not support any dunnage. When in its locked position, the front crossbar assembly 190 functions as a stop, preventing the remaining crossbar assemblies 90 behind it from entering the generally vertically oriented portions of the generally U-shaped tracks or generally L-shaped during shipping, for example. Any lockable crossbar assembly/track combination described herein may be used for the same purposes regardless of the shape of the track and at any level. This concept of using a front lockable crossbar assembly at the front of a level for preventing movement of crossbar assemblies may be used in any container shown or described herein having any number of levels or layers.

Figure 27:
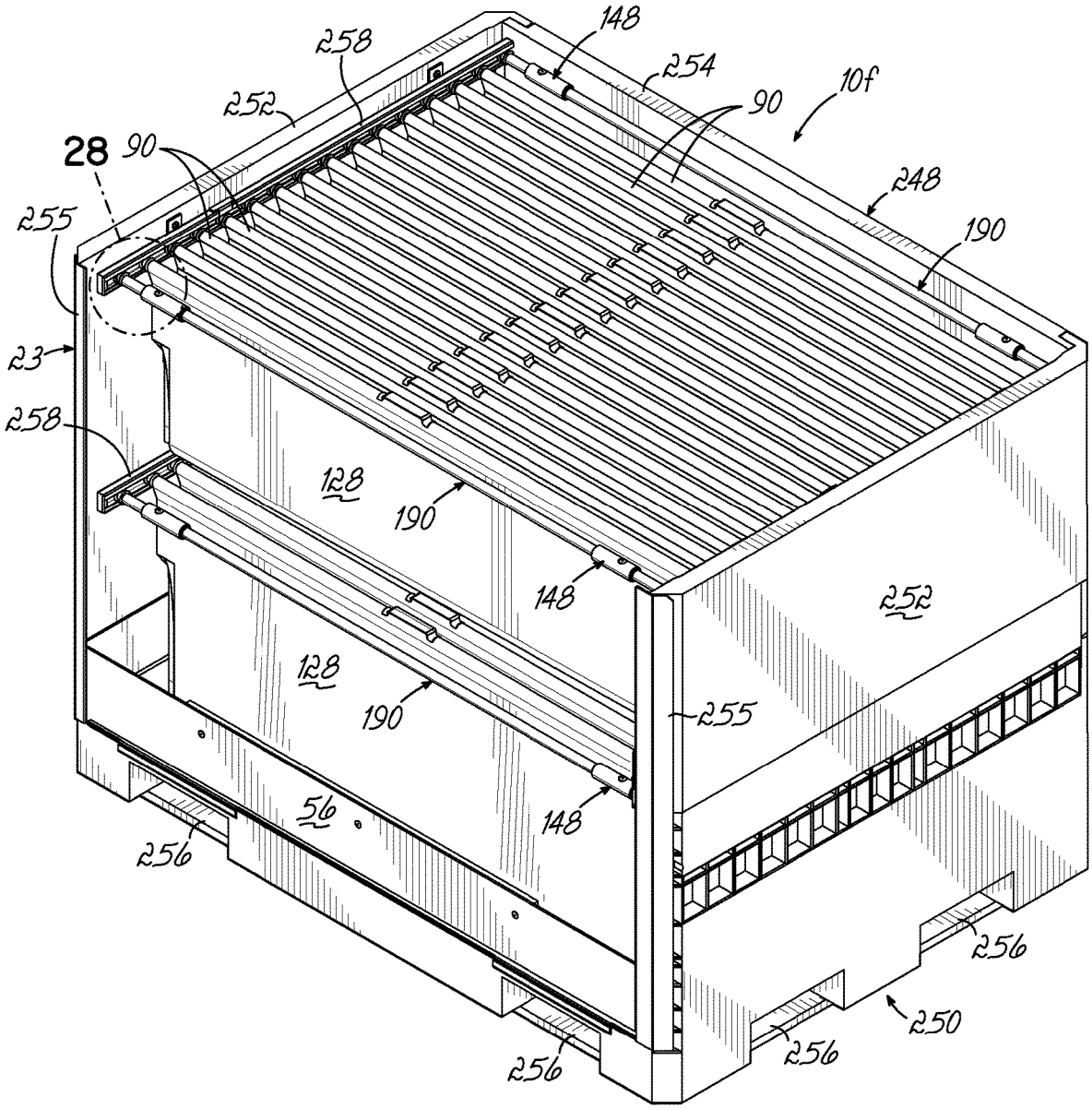
FIG. 27 is a perspective view of another embodiment of reusable and returnable container.
Figure 28:
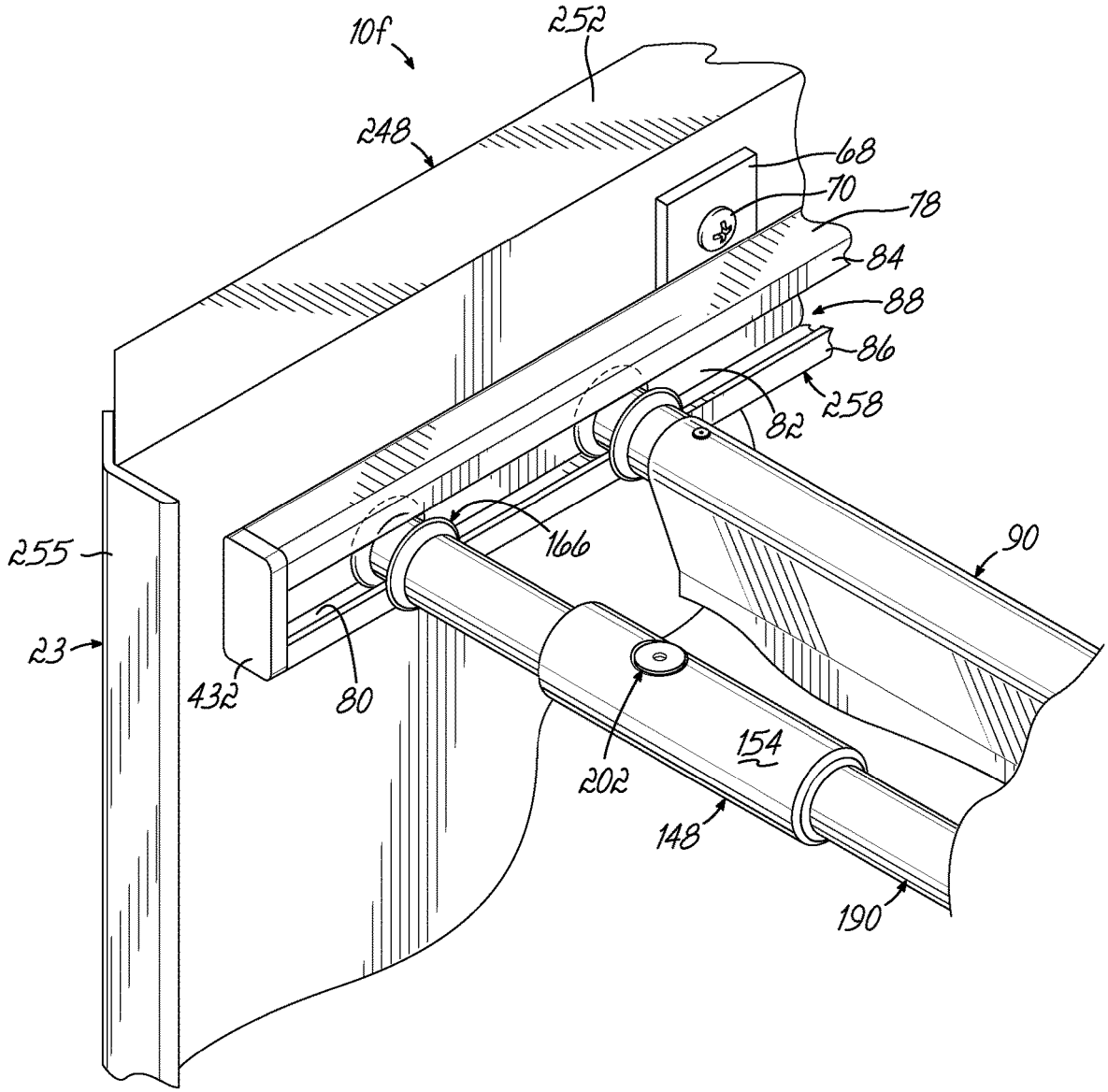
FIG. 28 is an enlarged view of the encircled area 28 of FIG. 27.

FIGS. 27 and 28 illustrate an alternative embodiment of container 10*f*. The outer shell of container 10*f* is identical to the outer shell of container 10*e* shown in FIGS. 25, 25A and 26. However, the tracks of each level of container 10*f* shown in FIGS. 27 and 28 are linear compared to the non-linear tracks of each level of container 10*e* shown in FIGS. 25 and 26. Container 10*f* is shown having two tracks 258 per side and two layers or levels of dunnage, like container 10*c* shown in FIGS. 10 and 10A. However, the container may have any desired number of levels of dunnage.

At each level, the front and rear crossbar assemblies are lockable crossbar assemblies 190 with the interior crossbar assemblies or dunnage supports 90 being unlockable. Both outer lockable crossbar assemblies 190 act as stops for inhibiting movement of the interior crossbar assemblies 90 supporting dunnage during shipping. The outer lockable crossbar assemblies 190 are shown not supporting dunnage. For simplicity, like parts have like numbers.

Referring to FIG. 27, each level of container 10*f* comprises a plurality of interior unlockable crossbar assemblies 90 and two outer lockable crossbar assemblies 190. Each lockable crossbar assembly 190 is the front or rear crossbar assembly of the set of crossbar assemblies extending between corresponding linear tracks 258. Any lockable crossbar assembly/track combination described herein may be used in this container or any other container shown or described herein.

As best shown in FIG. 28, each linear track 258 of container 10*f* has two end caps 432 (only one being shown). For simplicity, the cross-sectional configuration of each track 258 is identical to the upper generally horizontally oriented upper portion 62 of generally U-shaped upper track 60 described above. Each side of container 10*f* has a track 258 proximate an upper edge of the container 10*f* and held in place with mounting brackets 68 welded or otherwise secured to the linear track 258. Each mounting bracket 68 may be secured via at least one fastener 70 to one of the sides 252 of container body 248. The stationary linear track 258 may be secured in any desired manner to each side 252 of the container 10*f*. The apparatus used to hold the tracks in place is not intended to be limiting and is not intended to be part of the present invention. Any combination of tracks and lockable crossbar assemblies described or shown herein may be used in a container like container 10*f*.

Figure 29A:
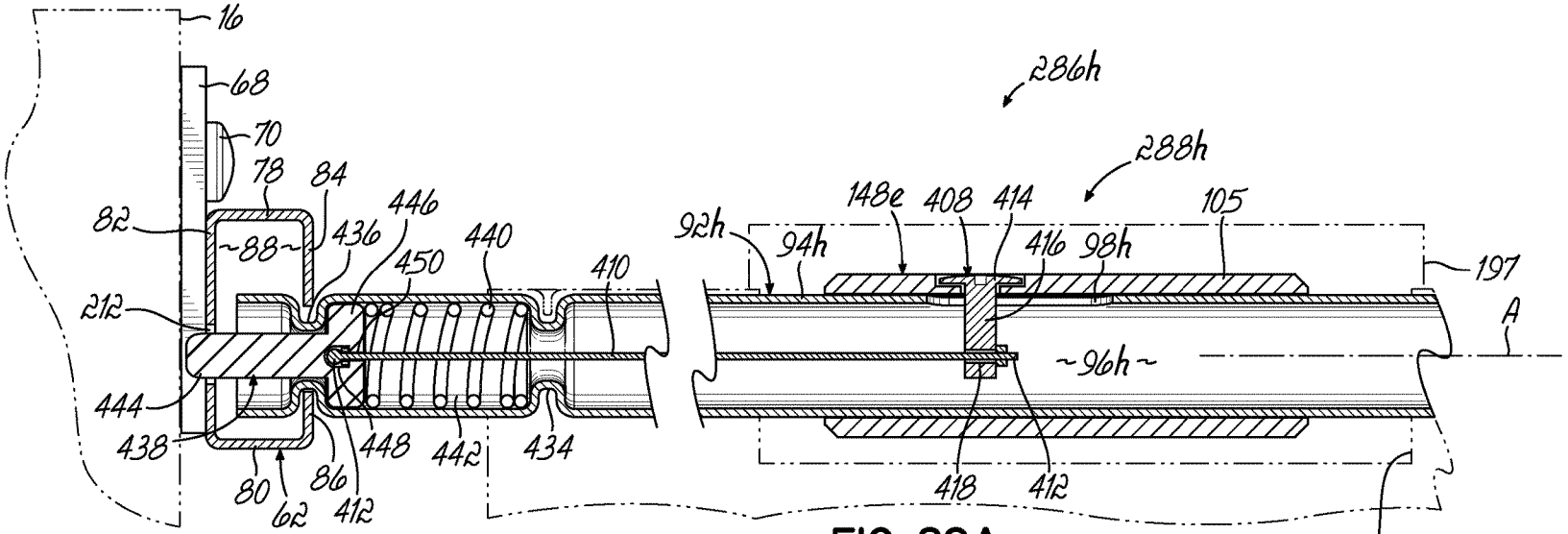
FIG. 29A is a cross-sectional view of a portion of another version of lockable crossbar assembly.
Figure 29B:
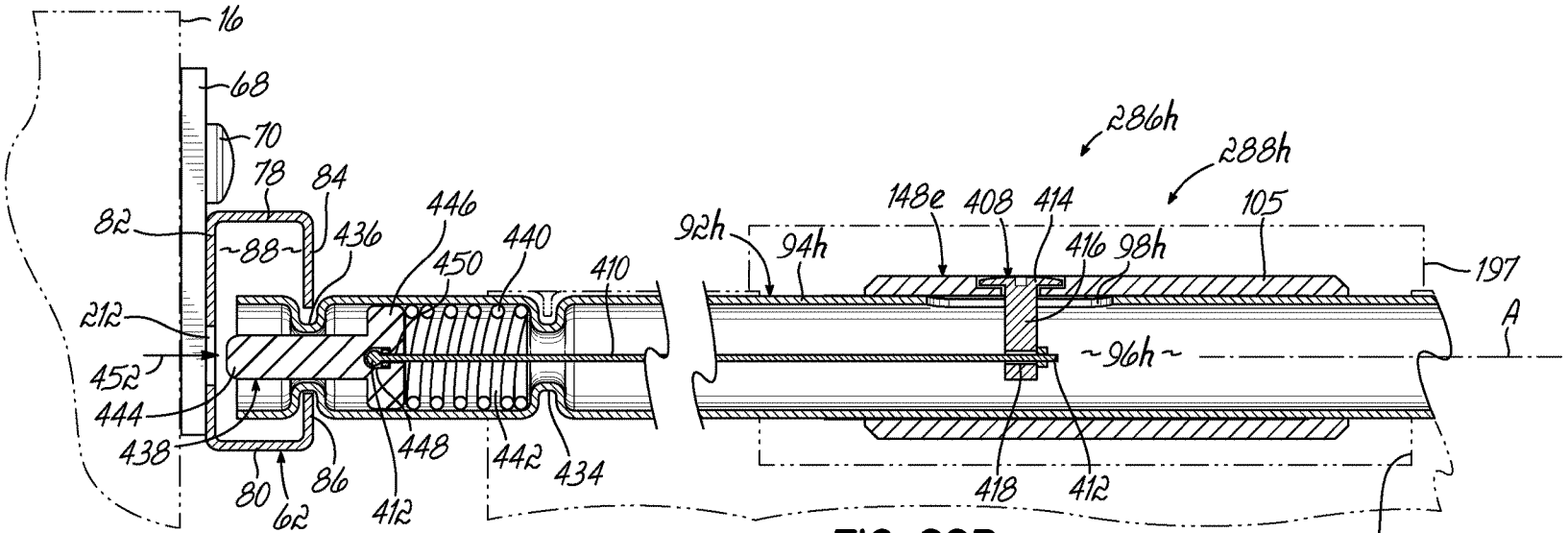
FIG. 29B is a cross-sectional view taken of the portion of the lockable crossbar assembly of FIG. 29A; showing one of the locking pins being retracted out of engagement with an opening in the track shown in FIG. 29A.

FIGS. 29A and 29B illustrate a portion of an alternative lockable crossbar assembly 286*h* which may be used with any tracks shown or described herein in any embodiment of container shown or described herein. For simplicity, like parts have like numbers. Each lockable crossbar assembly 286*h* has two locking assemblies 288*h* (only one being shown) between which is a crossbar 92*h*. Crossbar 92*h* has an outer wall 94*h* defining a hollow interior 96*h*. The outer wall 94*h* of the crossbar 92*h* has an inner groove 434 and an outer groove 436 at each end. See FIGS. 29A and 29B. The crossbar 92*h* is preferably made of metal, but may be made of other suitable material, such as plastic or fibrous material. FIGS. 29A and 29B illustrate the components and operation of one of the lockable assemblies 288*h* of one of the lockable crossbar assemblies 286*h*.

As shown in FIGS. 29A and 29B, each locking assembly 288*h* of lockable crossbar assembly 286*h* (only one being shown) has the same handle 148*e*, anchor 408 and cord 410 having opposed ends 412 as locking assembly 288*e* of lockable crossbar assembly 286*e* shown in FIGS. 21, 22A and 22B. However, each locking assembly 288*h* of lockable crossbar assembly 286*h* (only one being shown) further comprises a generally "T-shaped" locking pin 438 and a spring 440. The generally "T-shaped" locking pin 438 has a first portion 444 extending in a direction parallel the longitudinal axis "A" of the crossbar 92*h* and a second portion 446 extending in a direction perpendicular to the first portion 444. The spring 440 and second portion 446 of generally "T-shaped" locking pin 438 are retained in a holding cavity 442 inside the hollow interior 96*h* of the crossbar 92*h* between inner and outer grooves 434 and 436, respectively.

As best shown in FIGS. 29A and 29B, upon assembly, anchor 408 joins generally "T-shaped" locking pin 438, handle 148*e* and crossbar 92*h*. More particularly, anchor 408 has a generally planar upper portion 414 which resides in the recess 156*e* of handle 148*e* upon assembly. Anchor 408 has a lower portion 416 with a passage 418. As shown in FIGS. 29A and 29B, the lower portion 416 of the anchor 408 travels along a slot 98*h* of crossbar 92*h*.

As shown in FIGS. 29A and 29B, upon assembly, one end 412 of cord 410 is secured inside cavity 448 of generally "T-shaped" locking pin 438 after passing through bore 450 of generally "T-shaped" locking pin 438 (only one being shown). The other end of cord 410 extends through the passage 418 of the lower portion 416 of the anchor 408 and is secured to the lower portion 416 of the anchor 408. Along its length, cord 410 extends through the spring 440 and through the hollow interior 96*h* of crossbar 92*h*.

In operation, inward movement of the handles 148*e* and associated anchors 408 towards each other by an operator, shown by the arrow 452 of FIG. 29B, causes inward movement of the generally "T-shaped" locking pins 438 against the outward bias of springs 440. The generally "T-shaped" locking pins 438 move relative to the crossbar 92*h*. As shown in FIGS. 29A and 29B, inward movement of the handles 148*e* by an operator causes the generally "T-shaped" locking pins 438 to move from extended locked positions extending through openings 212 in side walls 82 of the generally horizontally oriented upper portions 62 of the generally U-shaped upper tracks 60. Although one movable locking assembly 288*h* (left side) of the lockable crossbar assembly 286*h* is shown in FIGS. 29A and 29B, the right side is a mirror image. Although FIGS. 29A and 29B show the lockable crossbar assembly 286*h* extending between generally horizontally oriented upper portions 62 of the generally U-shaped upper tracks 60, the lockable crossbar assembly 286*h* may be used with any of the tracks shown or described herein.

To unlock the lockable crossbar assembly 286*h* from a locked position shown in FIG. 29A to an unlocked position shown in FIG. 29B, an operator must move handles 148*e* of the locking assemblies 288*h* inwardly towards each other. Such movement of the handles 148*e* compresses the springs 440 on each side of the lockable crossbar assembly 286*h* and moves the generally "T-shaped" locking pins 438 of the lockable crossbar assembly 286*h* inwardly out of the openings 212 of the upper generally horizontally oriented upper portions 62 of the generally U-shaped upper tracks 60. Once the generally "T-shaped" locking pins 438 are in their unlocked position shown in FIG. 29B, an operator is free to move the lockable crossbar assembly 286*h* to its desired position, including a position extending between the connecting portions 66 of the generally U-shaped upper tracks 60 or another portion of any track.

Figure 30:
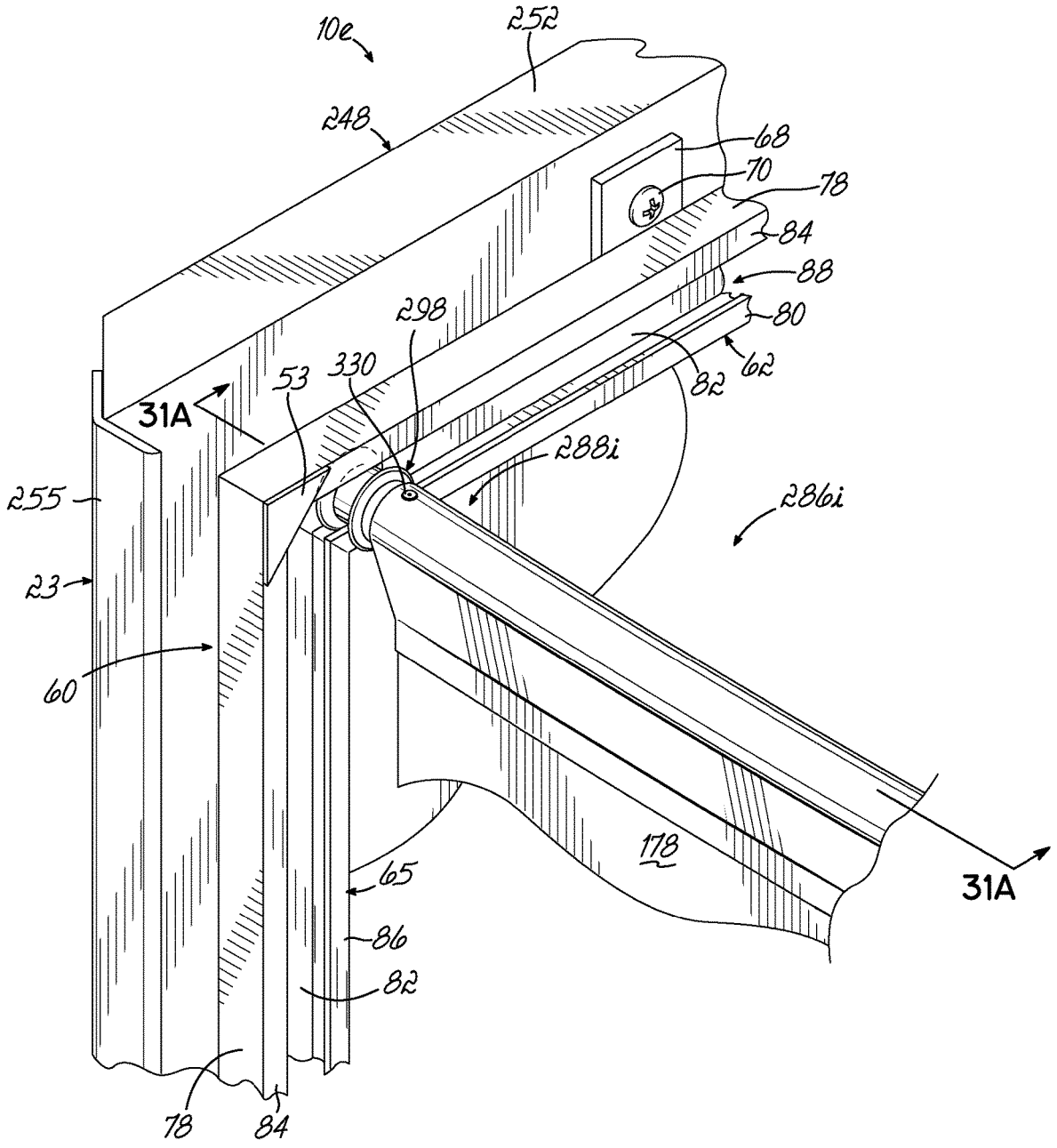
FIG. 30 is a perspective view, like FIG. 26, of a portion of another embodiment of reusable and returnable container.

FIGS. 30, 31, 31A and 31B illustrate an alternative embodiment of lockable crossbar assembly 286*i*, which may be used in any of the tracks shown or described herein in any of the containers shown or described herein. FIG. 30 shows a portion of one of the lockable crossbar assemblies 286*i* locked in a fixed position extending between generally horizontally oriented upper portions 62 of generally U-shaped upper track 60 inside container 10*e*.

Figure 31:
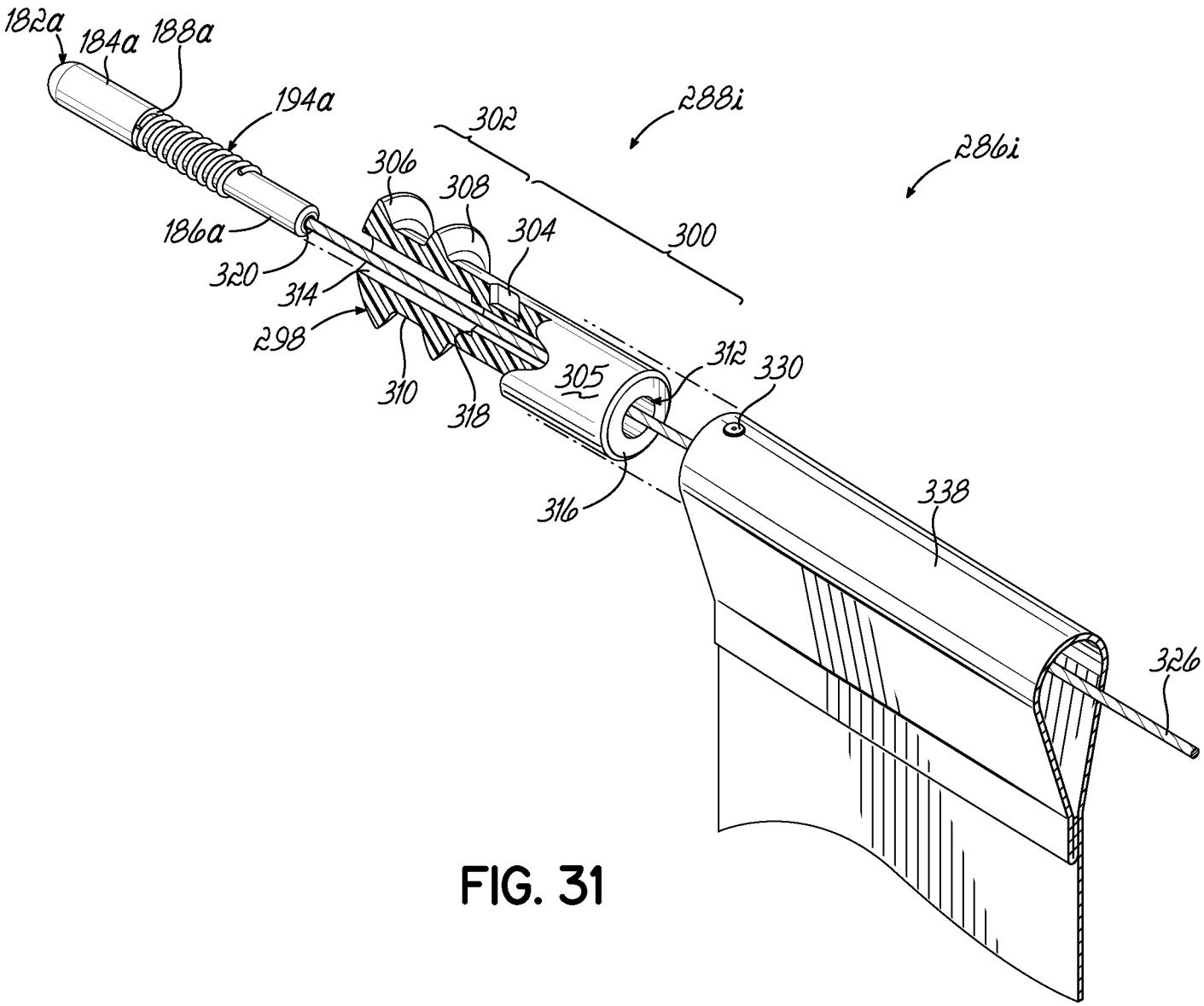
FIG. 31 is a partially disassembled view of a portion of another version of lockable crossbar assembly.
Figure 31A:
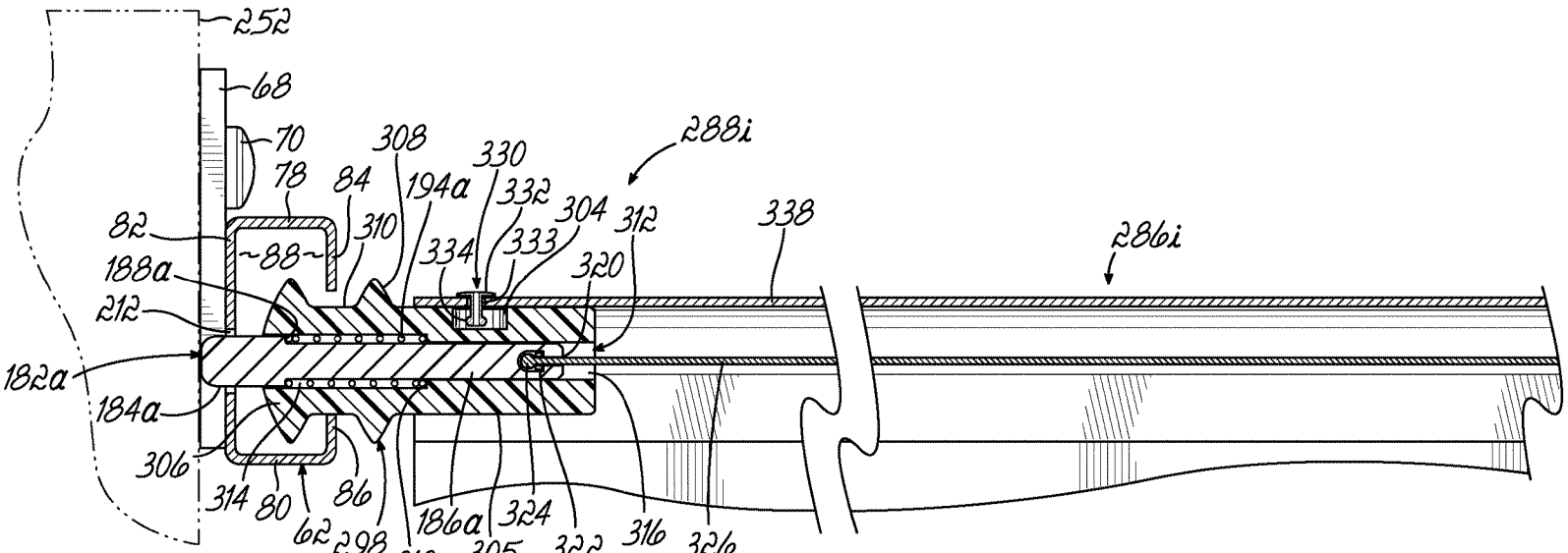
FIG. 31A is a cross-sectional view taken of a portion of the lockable crossbar assembly of FIG. 31 being locked in a desired position.
Figure 31B:
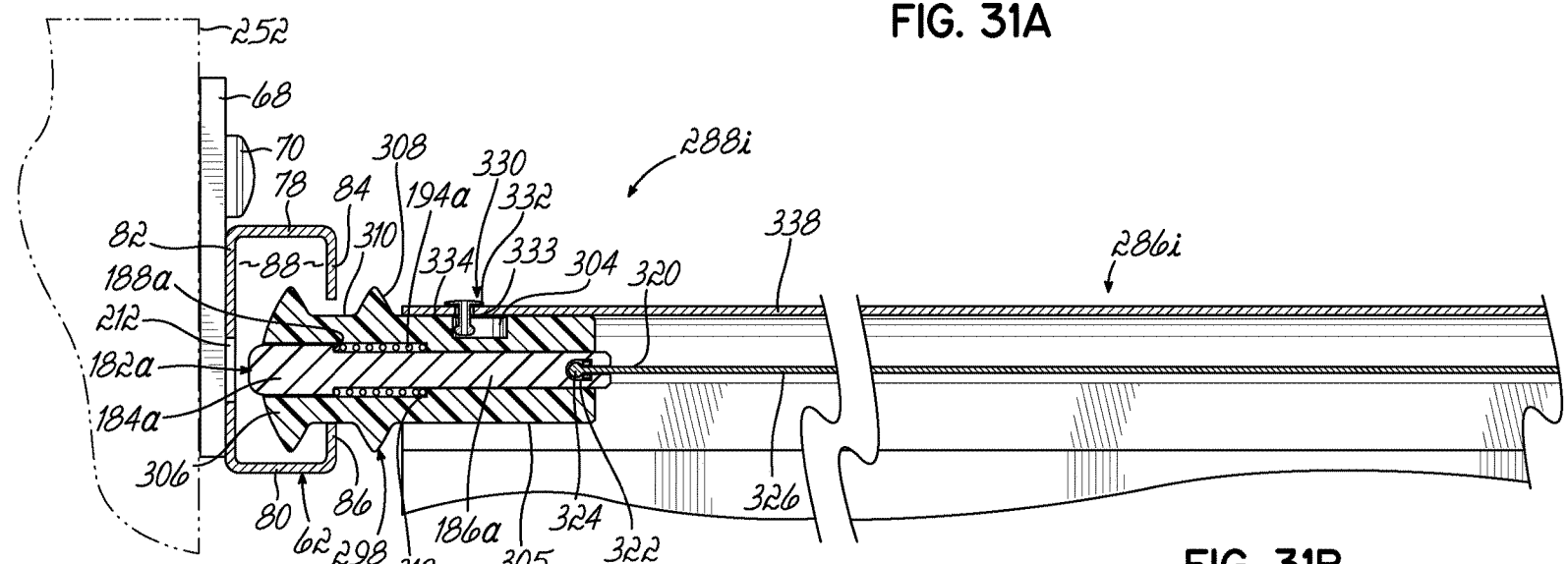
FIG. 31B is a cross-sectional view taken of a portion of the lockable crossbar assembly of FIG. 31; showing one of the locking pins being retracted out of engagement with one of the openings in one of the tracks.

FIGS. 31, 31A and 31B illustrate a portion of an alternative lockable crossbar assembly 286*i*, which may be used in any of the tracks shown or described herein in any embodiment of container shown or described herein. For simplicity, like parts have like numbers. Each lockable crossbar assembly 286*i* has two locking assemblies 288*i* (only one being shown) between which is a cord 326, rather than a crossbar. Cord 326 is the same one described above and shown in detail in FIG. 11. FIGS. 31, 31A and 31B illustrate the components and operation of one of the locking assemblies 288*i* of one of the lockable crossbar assemblies 286*i*.

Each locking assembly 288*i* of lockable crossbar assembly 286*i* is similar to locking assembly 288 shown in FIG. 11, having the same locking pin 182*a*, spring 194*a* and end member 298. Each locking assembly 288*i* does not have a handle. As best shown in FIGS. 31A and 31B, the flexible cord 326 passes through the fabric pocket 338.

In operation, an operator may shorten the distance between ends of the cord 326 in any known manner, thereby moving the locking pins 182*a* of locking assemblies 288*i* of lockable crossbar assembly 286*i* towards each other. Shortening the distance between ends of the cord 326 causes inward movement of the locking pins 182*a* against the outward bias of springs 194*a*. As shown in FIGS. 31A and 31B, shortening the distance between ends of the cord 326 by an operator causes the locking pins 182*a* to move from extended locked positions extending through openings 212 in the side walls 82 of the generally horizontally oriented upper portions 62 of the generally U-shaped upper tracks 60. Although one locking assembly 288*i* (left side) of the lockable crossbar assembly 286*i* is shown in FIGS. 31A and 31B, the right side is a mirror image. To unlock the lockable crossbar assembly 286*i* from a locked position shown in FIG. 31A to an unlocked position shown in FIG. 31B, an operator must shorten the distance between ends of the cord 326, compressing the spring 194*a* on each side of the lockable crossbar assembly 286*i* and moving two locking pins 182*a* of the lockable crossbar assembly 286*i* inwardly out of the openings 212 of the generally horizontally oriented upper portions 62 of the generally U-shaped upper tracks 60. Once the locking pins 182*a* are in their unlocked position shown in FIG. 31B, an operator is free to move the lockable crossbar assembly 286*i* to its desired position, including another position extending between the connecting portions 66 of the generally U-shaped upper tracks 60. Such an operation may be used in any of the tracks shown or described herein and with any of the embodiments of container shown herein.

Figure 32:
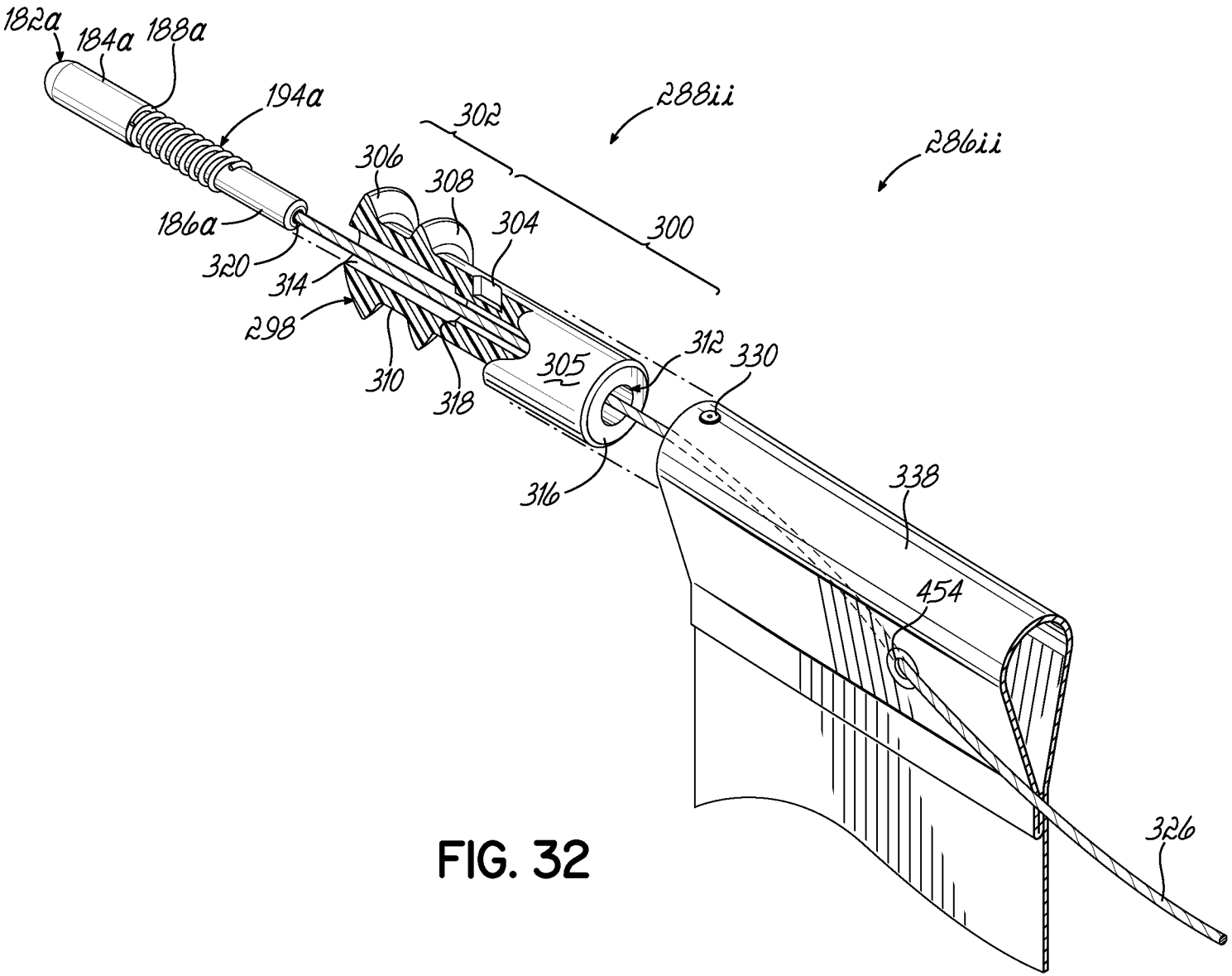
FIG. 32 is a partially disassembled view of a portion of another version of lockable crossbar assembly.

FIG. 32 illustrates a partially disassembled view of a portion of another version of lockable crossbar assembly 286*ii* which may be used in any of the tracks shown or described herein in any of the containers shown or described herein. Each lockable crossbar assembly 286*ii* has two locking assemblies 288*i* (only one being shown) identical to those described above and shown in FIGS. 31, 31A and 31B. In lockable crossbar assembly 286*ii*, the cord 326 does not stay inside the fabric pocket 338 of the dunnage. Instead, it passes through an opening 454 through the dunnage on each side of the container so that an operator may easily shorten the distance between the ends of cord 326 by pulling on the exposed portion of the cord 326. This type of dunnage may be used in any of the lockable crossbar assemblies having a flexible cord.

Figure 33:
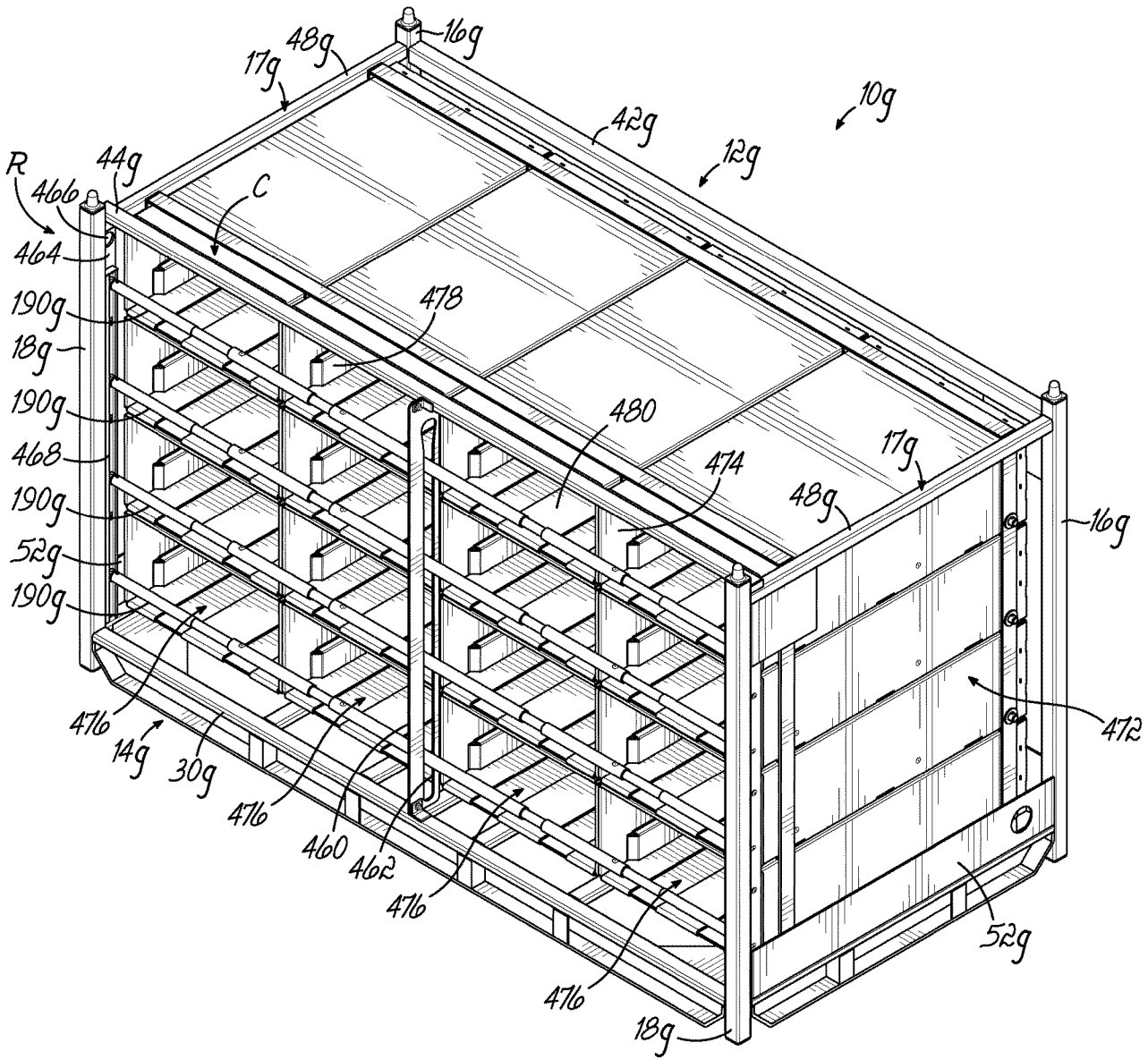
FIG. 33 is a perspective view of another embodiment of reusable and returnable container.
Figure 34:
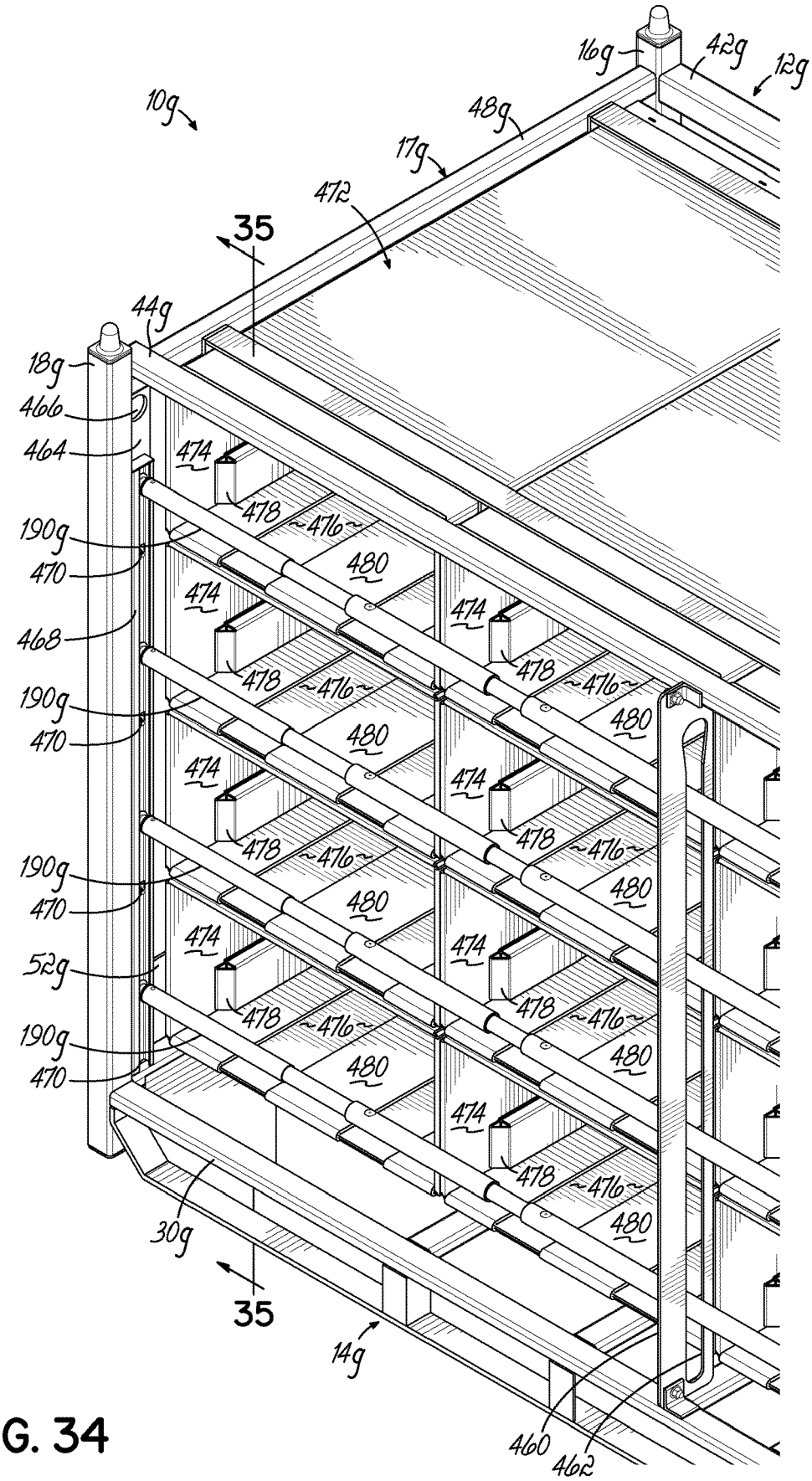
FIG. 34 is an enlarged perspective view of a portion of the container of FIG. 33.
Figure 35:
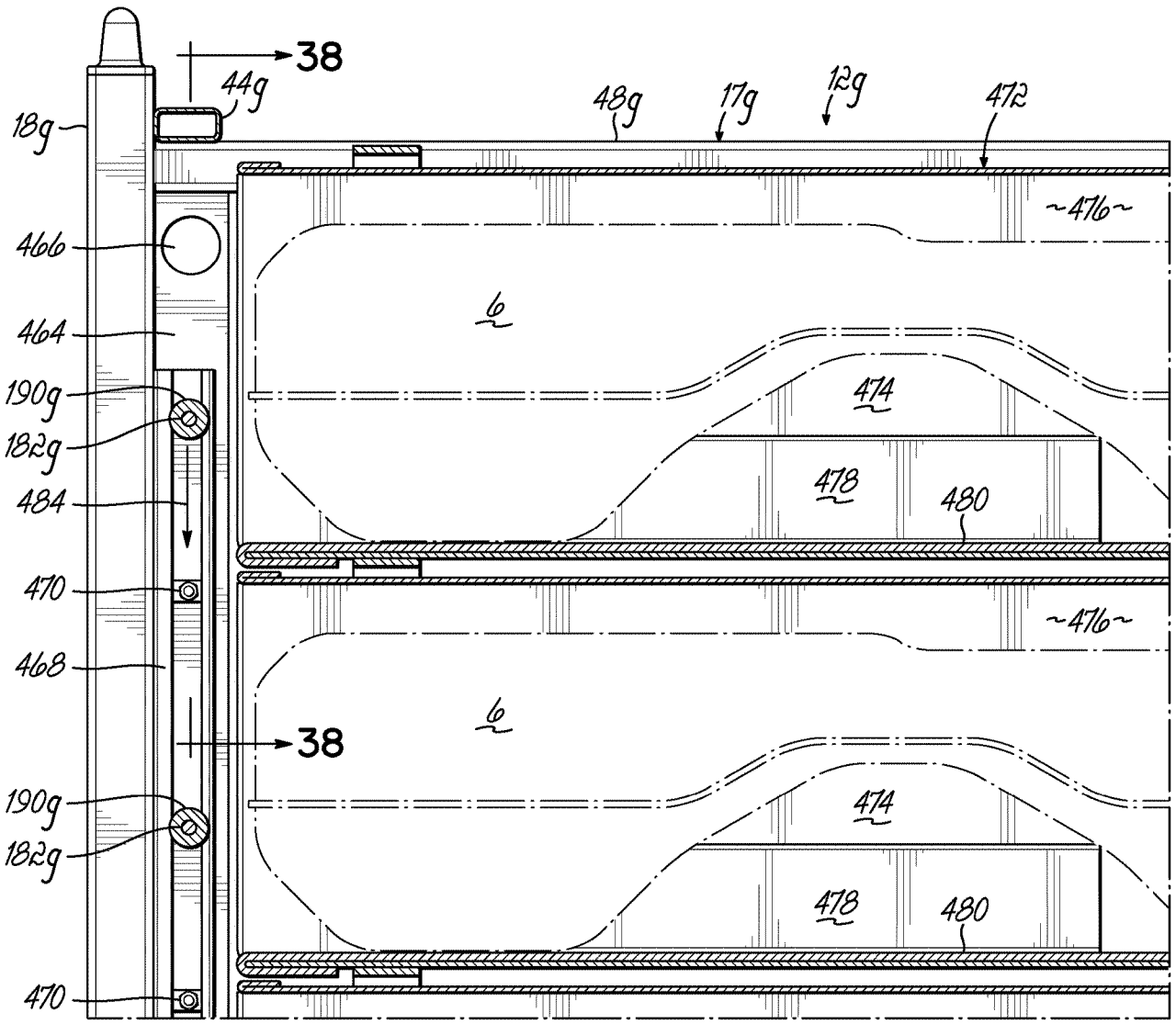
FIG. 35 is a cross-sectional view taken along the line 35-35 of FIG. 34.
Figure 36:
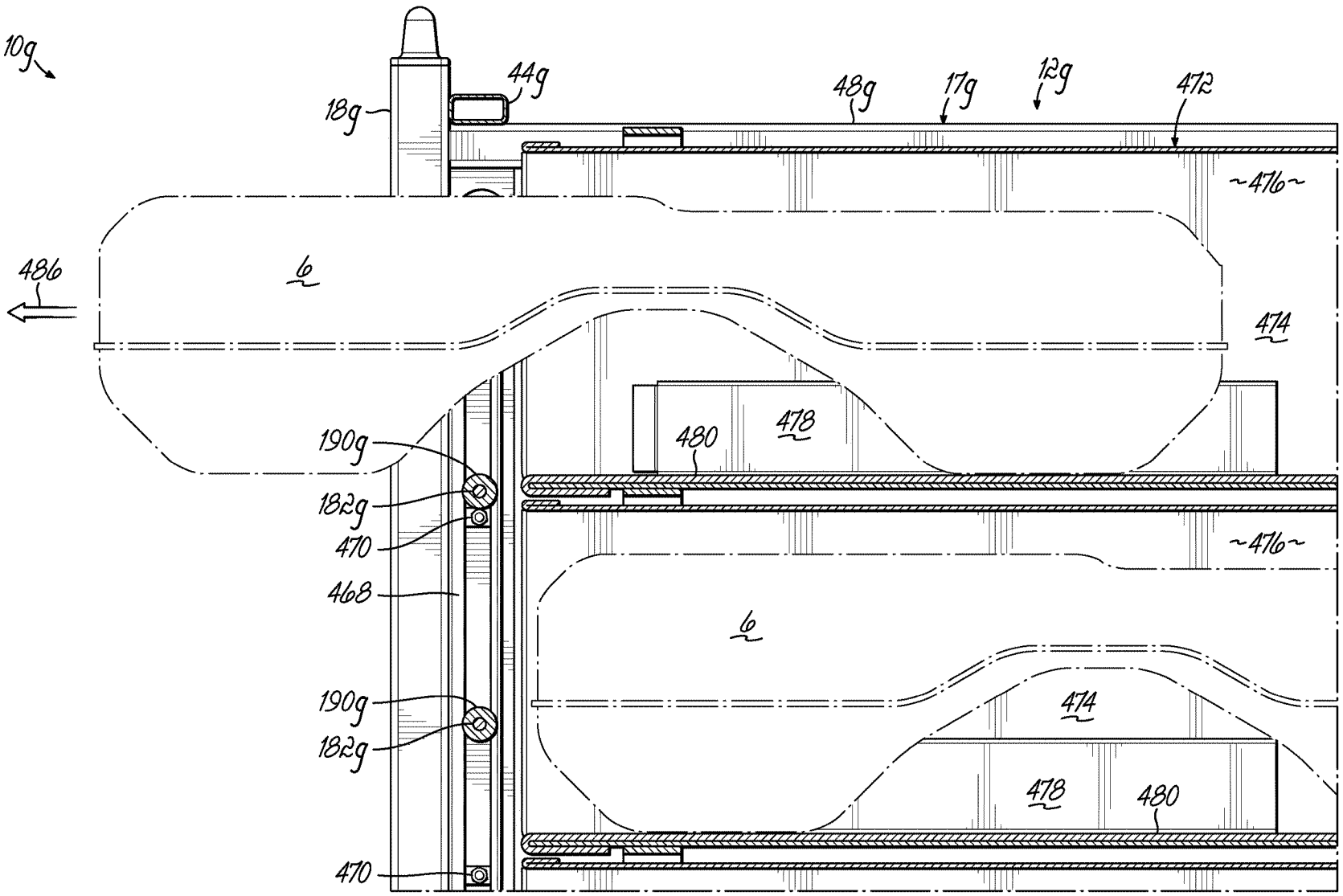
FIG. 36 is a cross-sectional view, like FIG. 35, showing one of the products being removed from the dunnage inside the container of FIG. 33.
Figure 37:
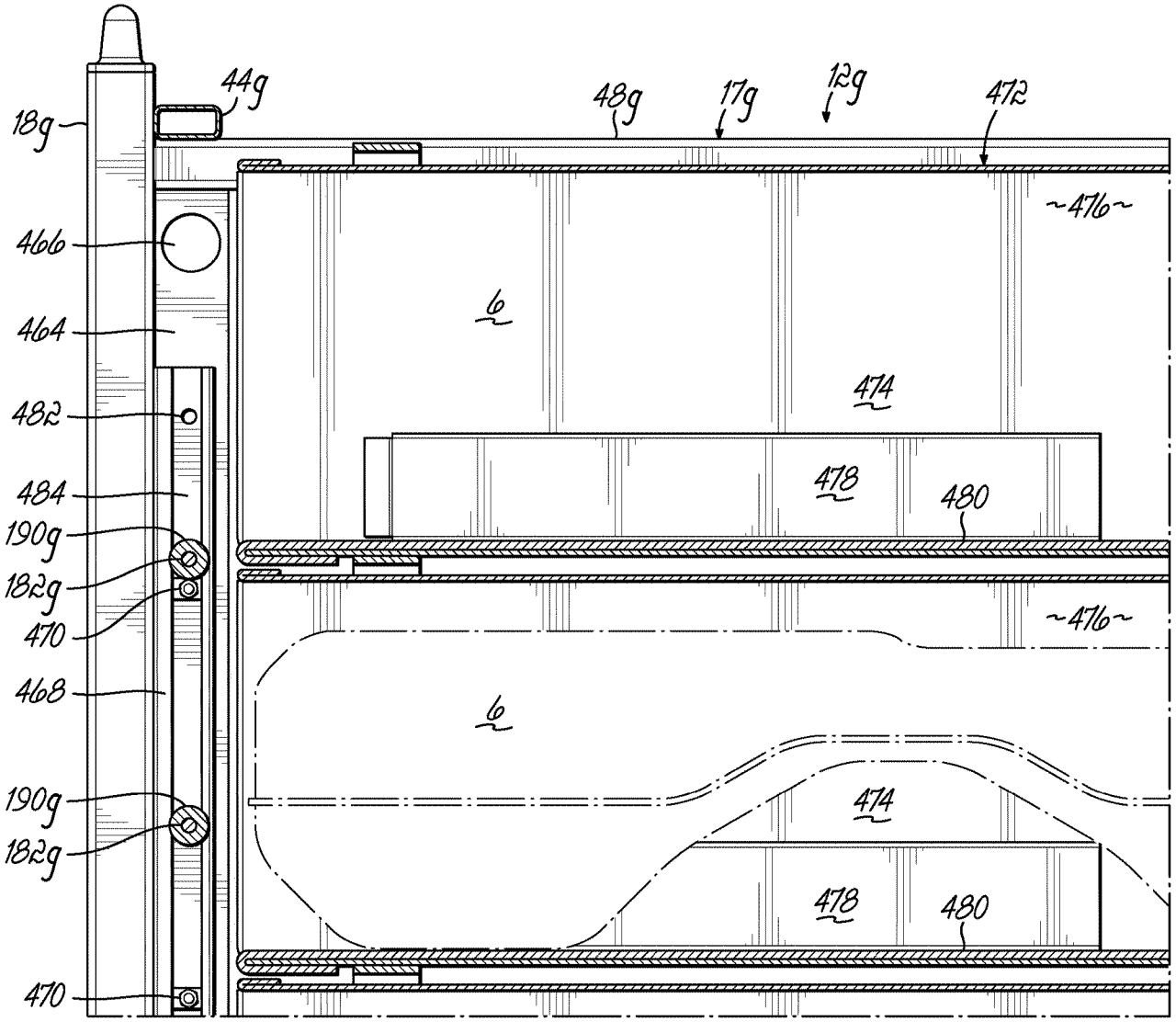
FIG. 37 is a cross-sectional view, like FIG. 36, showing the product of FIG. 36 fully removed from the dunnage inside the container of FIG. 33.
Figure 38:
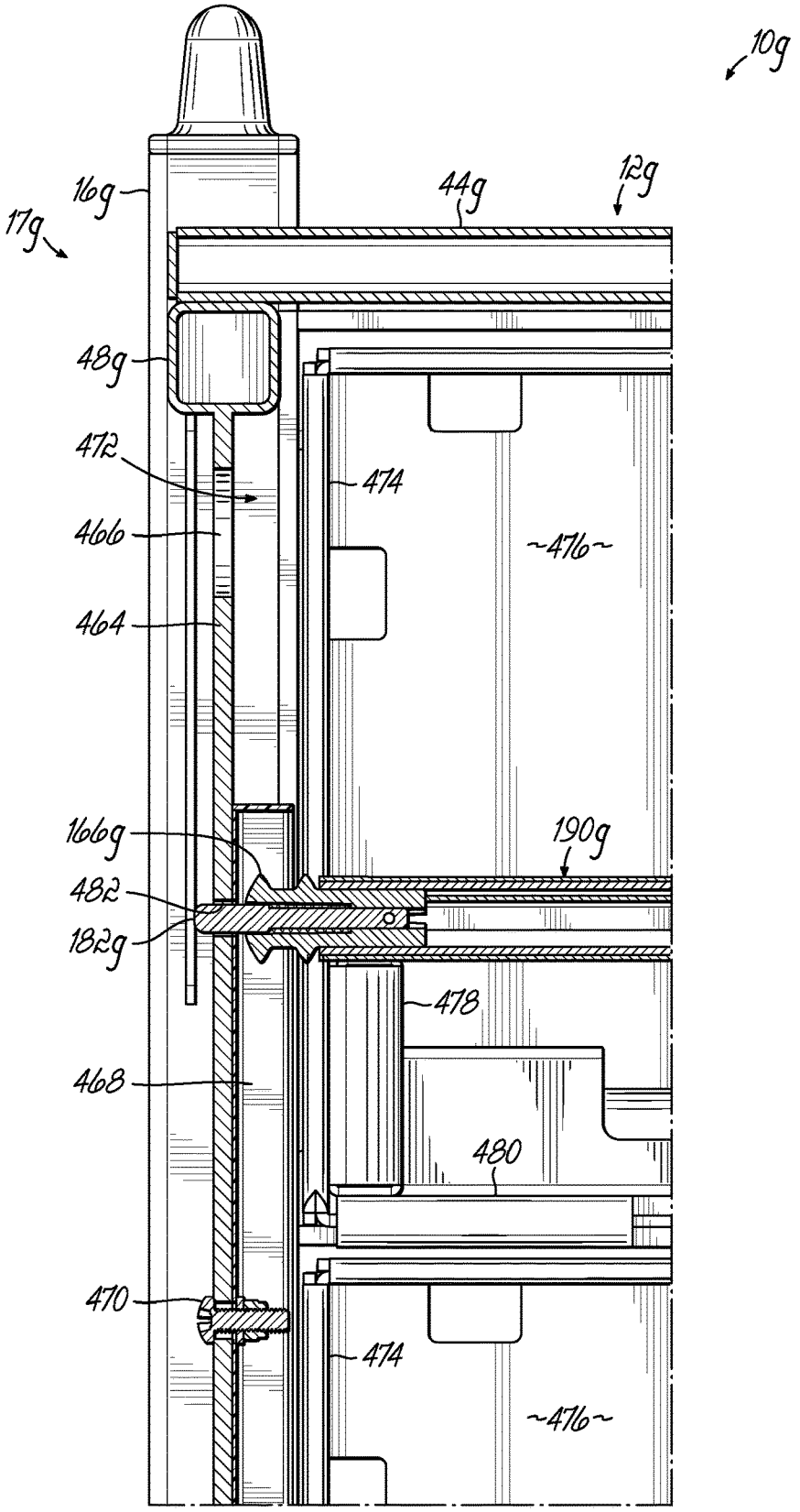
FIG. 38 is a cross-sectional view taken along the line 38-38 of FIG. 35.

FIGS. 33-38 illustrate an alternative embodiment of reusable and returnable container 10*g*. The unique configuration of reusable and returnable container 10*g* allows multiple products 6 to be confined in dunnage during shipment and then easily removed from the dunnage by unlocking and lowering at least one lockable dunnage support assembly incorporated into the reusable and returnable container 10*g*. Although one shape of product 6 is illustrated in FIGS. 35-37, any other shape of products may be used in accordance with the present invention. Although one type of dunnage 476 is illustrated in FIGS. 33-39, any other type of dunnage may be used in accordance with the present invention. For simplicity, like parts have like numbers.

The reusable and returnable container 10*g*, as shown, comprises an outer metal frame 12*g* having a base 14*g* and two opposed sides 17*g*. Each of the opposed sides 17*g* comprises a rear corner post 16*g* and a front corner post 18*g* and structure therebetween, such as an upper side member 48*g* and a lower side member 52*g*. The outer metal frame 12*g* of container 10*g* is similar to outer metal frame 12 of container 10*c* shown in FIGS. 10 and 10A in that it is a metal rack having four corner posts. However, it is slightly different in size and configuration.

As best shown in FIGS. 33 and 34, the outer metal frame 12*g* further comprises an upper rear member 42*g* and an upper front member 44*g*. The upper rear member 42*g* extends between the two rear corner posts 16*g* and is secured thereto. The upper front member 44*g* extends between the two front corner posts 18*g* and is secured thereto. The outer metal frame 12*g* further comprises, on each side of the container, an upper side member 48*g* and a lower side member 52*g*. Each upper side member 48*g* extends between one of the rear corner posts 16*g* and one of the front corner posts 18*g* and is secured thereto. Similarly, each lower side member 52*g* extends between one of the rear corner posts 16*g* and one of the front corner posts 18*g* and is secured thereto. The outer metal frame 12*g* further comprises a lower front member 30*g* extending between the two front corner posts 18*g* and being secured thereto.

As best shown in FIGS. 34-37, a generally planar front corner post extension 464 is welded to each corner post 18*g* and extends from front to back of the container. One purpose of the front corner post extension 464 is to allow a track or tracks to be secured thereto. Although the drawings show a hole 466 at the top of each front corner post extension 464, such a hole may be omitted.

As best shown in FIG. 34, a slotted member 460 is secured to the upper front member 44*g* of the outer metal frame 12*g* at its upper end and is secured to the lower front member 30*g* of the outer metal frame 12*g* at its lower end. The slotted member 460 has a slot 462 extending substantially along the length thereof which enables lockable crossbar assemblies 190*g* to extend across the width of the container 10*g* without bowing outwardly. In some applications, the slotted member 460 may be omitted.

In the embodiment shown in FIGS. 33-38, a single track 468 is secured to each front corner post extension 464 with fasteners 470. See FIG. 38. Each of the fasteners 470 functions alone as a stop preventing further downward movement of one of the end members 166*g* of one of the lockable crossbar assemblies 190*g*. Each of the two tracks 468 of container 10*g* are linear and vertically oriented at the front of the container 10*g*. Each of the tracks 468 is shown having a generally C-shaped cross-section like tracks 60 and 72, as shown and described herein. However, the tracks used in this embodiment may be any shown or described herein and the lockable crossbar assemblies used in connection with such tracks may be any lockable crossbar assemblies shown or described herein.

The container 10*g* further comprises dunnage 472 in the form of intersecting partitions 474 which form horizontally extending rows R and vertically extending columns C of cubicles 476, each cubicle 476 housing a product 6 for shipment. The partitions 472 prevent the product 6 from contacting each other during shipment. The dunnage 472, in addition to partitions 474, may comprise bumpers 478 and folded over sliders 480 to make insertion of a product 6 into a cubicle 476 or removal of a product 6 from a cubicle 476 easier than without a slider 480. Although the drawings illustrate four levels or layers (rows) of vertically spaced cubicles, the dunnage may comprise any desired number of levels of cubicles 476. As shown in FIG. 33, although the drawings illustrate four columns C of horizontally spaced cubicles, the dunnage may comprise any desired number of columns of cubicles.

At each level, a lockable crossbar assembly 190*g* is engaged with the tracks 468 and extends therebetween across with one of the rows of dunnage. Each lockable crossbar assembly 190*g* acts as a stop for inhibiting movement of the product 6 inside a row of cubicles 476 during shipping. Although the container 10*g* has one open side, product 6 are prevented from falling out of their respective cubicles 476 by the lockable crossbar assemblies 190*g* being in their locked positions shown in FIGS. 33, 34 and 35.

FIGS. 35-37 illustrate a method of removing product from the dunnage 472 inside container 10*g*. FIG. 35 illustrates the top or uppermost lockable crossbar assembly 190*g* extending across the top or uppermost row of cubicles 476 in its locked position to prevent product 6 from falling out of the open side of the top or uppermost row of cubicles 476. As best shown in FIG. 37, in its locked position, locking pins 182*g* of lockable crossbar assembly 190*g* are inside openings 482 extending through the tracks 468. FIG. 35 shows the top or uppermost lockable crossbar assembly 190*g* falling in the direction of arrow 484 while the end members 166*g* are still engaged with the tracks 486 as described herein after the locking pins 182*g* have been released from inside the openings 482 of the tracks 468. As shown in FIG. 36, the end members 166*g* of the top or uppermost lockable crossbar assembly 190*g* fall until they are stopped by the stops 470. With the top or uppermost lockable crossbar assembly 190*g* in its unlocked or dropped position, the product 6 in the uppermost row of cubicles 476 may be removed out the open side of the container 10*g* as shown in FIG. 36. In its unlocked or dropped position, the top or uppermost lockable crossbar assembly 190*g* no longer obstructs the exit of the product 6 from the cubicles 476 of the top or uppermost row of dunnage, and product may be pulled out of the cubicles 476 in the direction of arrow 486.

FIG. 37 shows the top or uppermost row R of cubicles 476 empty, but the next lower row R of cubicles 476 full of product 6 (only one being shown). FIG. 37 shows the locking pins 182*g* of the next lowest lockable crossbar assembly 190*g* inside openings 482 extending through the tracks 468, thus locking this lockable crossbar assembly 190*g* in a locked position, preventing the second row of product 6 from exiting their respective cubicles 476.

Figure 39:
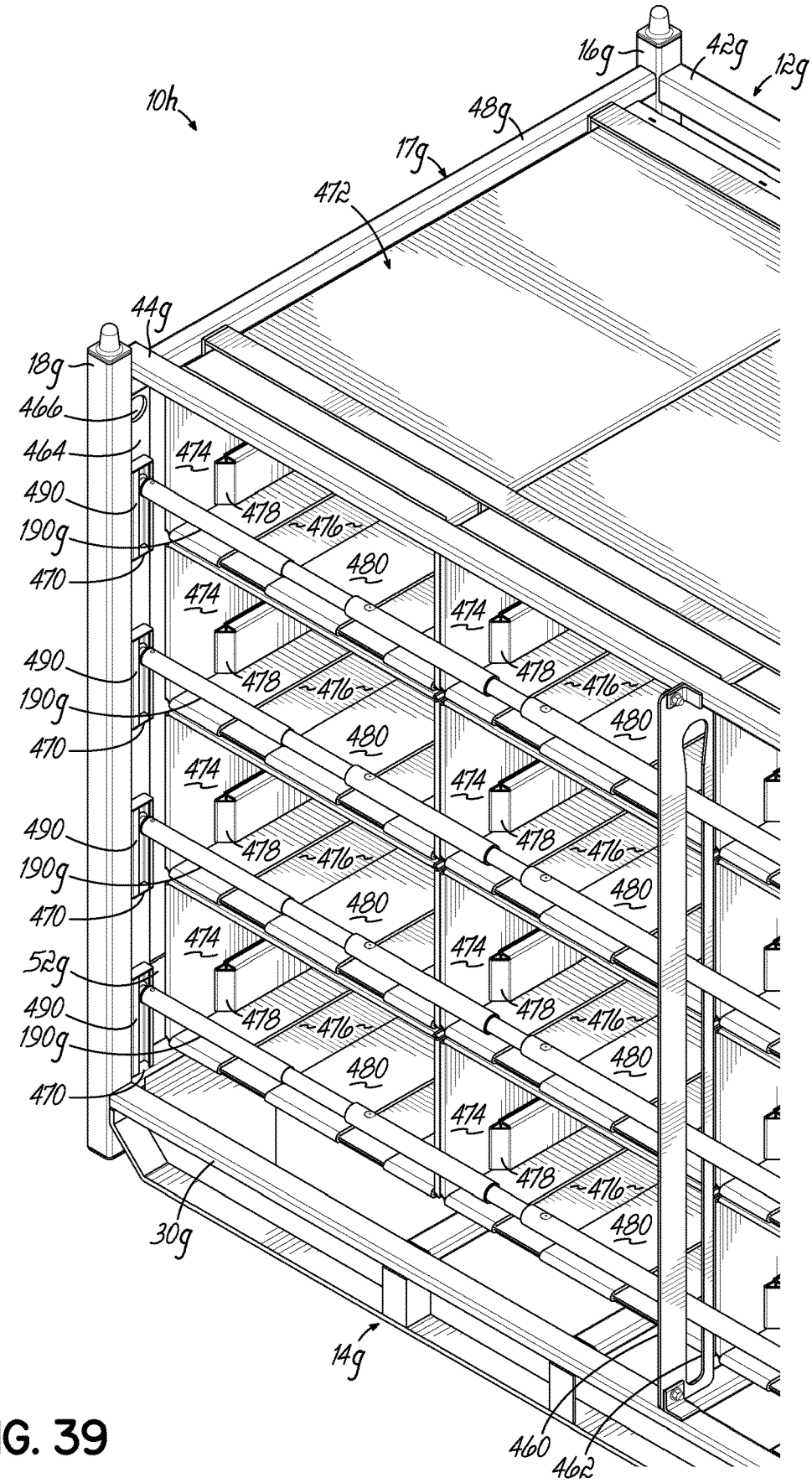
FIG. 39 is an enlarged perspective view of a portion of another embodiment of container having multiple tracks per side.

FIG. 39 illustrates an alternative embodiment of reusable and returnable container 10*h*, which is identical to reusable and returnable container 10*h*, except the tracks. Instead of one track per side, each side of reusable and returnable container 10*h* has multiple tracks 490 (only one side being shown). A lockable crossbar assembly 190*g* extends between each set of tracks 490 at the same vertical level. Instead of stops, the bottoms of the tracks 490 function as stops, preventing further downward movement of the lockable crossbar assemblies 190*g* after they have been unlocked and dropped. Thus, each lockable crossbar assembly 190*g* is in its dropped position when the end members of the lockable crossbar assembly 190*g* abut the ends of tracks 490.

For purposes of this document, the description of the positioning of various components is described with respect to the containers shown herein being in the positions illustrated. In addition, any of the features of the lockable crossbar assemblies may be used in combination. Although different lockable crossbar assemblies described herein are shown being locked and unlocked while extending between generally horizontally oriented upper portions 62 of the generally U-shaped upper tracks 60, any one of them may be locked in any desired position of any track shown or described herein.

While various embodiments of the present invention have been illustrated and described in considerable detail, it is not the intention of the applicant to restrict or in any way limit the scope of the claims to such detail. Additional advantages and modifications will readily appear to those skilled in the art. The invention in its broader aspect is, therefore, not limited to the specific details, representative system, apparatus, and method, and illustrative example shown and described. Accordingly, departures may be made from such details without departing from the spirit or scope of the applicant's general inventive concept.

What is claimed is:

1. A container for holding product therein during shipment, the container comprising:

a base and opposed sides, each side including a front corner post;

a track supported by an extension of each of the front corner posts;

a plurality of lockable crossbar assemblies, each one of the lockable crossbar assemblies extending between the tracks and being engaged with the tracks and being lockable in a locked position in which locking pins extend through openings in the tracks to keep product inside the container, a portion of each lockable crossbar assembly remaining attached to the tracks regardless of whether the lockable crossbar assembly is in the locked position or an unlocked position; and a plurality of stops in each of the tracks for stopping vertical movement of the lockable crossbar assemblies.

2. The container of claim 1 wherein each of the tracks is linear.

3. The container of claim 1 wherein each of the lockable crossbar assemblies has a locking assembly at each end.

4. The container of claim 3, wherein each of the locking assemblies includes a locking pin which may be selectively moved by an operator.

5. The container of claim 1 wherein each of the lockable crossbar assemblies comprises a pair of end members movable along the tracks.

6. The container of claim 1 wherein the container is a metal rack.

7. A container for holding product therein during shipment, the container comprising:

a base and opposed sides, wherein each side of the container comprises a rear corner post and a front corner post and structure therebetween;

a vertically oriented track supported by the front corner post of each of the opposed sides;

a plurality of lockable crossbar assemblies movable along a path defined by opposed, vertically oriented tracks, each one of the lockable crossbar assemblies extending between the opposed, vertically oriented tracks and being engaged with the opposed, vertically oriented tracks and being lockable in a locked position in which locking pins extend through openings in the opposed, vertically oriented tracks to keep product inside the container, a portion of each lockable crossbar assembly remaining attached to the opposed, vertically oriented tracks regardless of whether the lockable crossbar assembly is in the locked position or an unlocked position; and a plurality of stops in each of the opposed, vertically oriented tracks for stopping vertical movement of the lockable crossbar assemblies.

8. The container of claim 7 wherein the stops are fasteners securing the tracks to the front corner posts of the container.

9. The container of claim 7 wherein each of the lockable crossbar assemblies has at least one locking assembly.

10. The container of claim 7 wherein each front corner post has an extension to which one of the opposed, vertically oriented tracks is secured.

11. The container of claim 7 wherein the container the base and opposed sides are metal.

12. The container of claim 7 wherein each lockable crossbar assembly has locking pins which may engage openings to lock the lockable crossbar assembly in a fixed location.

13. The container of claim 7 wherein each lockable crossbar assembly has locking assemblies which may selectively be engaged by an operator to fix the location of the lockable crossbar assembly relative to the tracks.

* * * * *